US012790792B2

(12) United States Patent
Açarçiçek et al.

(10) Patent No.: US 12,790,792 B2
(45) Date of Patent: Nov. 10, 2026

(54) AUTONOMOUS POWERED EARTH-MOVING VEHICLE CONTROL USING LiDAR DATA FROM ON-VEHICLE SENSORS

(71) Applicant: AIM Intelligent Machines, Inc., Monroe, WA (US)

(72) Inventors: Ahmet Haluk Açarçiçek, Feyzullah (TR); Andrija Gajić, Krusevac (RS)

(73) Assignee: AIM Intelligent Machines, Inc., Redmond, WA (US)

( * ) Notice: Subject to any disclaimer, the term of this patent is extended or adjusted under 35 U.S.C. 154(b) by 0 days.

(21) Appl. No.: 19/208,522

(22) Filed: May 14, 2025

(65) Prior Publication Data

US 2025/0361699 A1 Nov. 27, 2025

Related U.S. Application Data

(60) Provisional application No. 63/650,760, filed on May 22, 2024.

(51) Int. Cl.
*E02F 9/26* (2006.01)
*E02F 9/20* (2006.01)

(52) U.S. Cl.
CPC ..... *E02F 9/265* (2013.01); *E02F 9/2045* (2013.01); *E02F 9/205* (2013.01); *E02F 9/262* (2013.01)

(58) Field of Classification Search
CPC ..... E02F 9/265; E02F 9/2045; E02F 9/205; E02F 9/262
See application file for complete search history.

(56) References Cited

U.S. PATENT DOCUMENTS 9,630,321 B2 4/2017 Bradski et al.
10,761,537 B1 9/2020 Ready-Campbell et al.
(Continued)

FOREIGN PATENT DOCUMENTS

CN 111942200 A 11/2020
CN 115205395 A 10/2022
(Continued)

OTHER PUBLICATIONS

Carnegie Mellon University National Robotics Engineering Center—Off-Road Autonomy, retrieved on Aug. 22, 2022 from https://www.nrec.ri.cmu.edu/solutions/defense/other-projects/off-road-autonomy.html, 5 pages.

(Continued)

*Primary Examiner* — Hussein Elchanti
(74) *Attorney, Agent, or Firm* — VLP Law Group LLP; James A. White

(57) ABSTRACT

Systems and techniques are described for implementing autonomous control of powered earth-moving vehicles, including to automatically calibrate a LiDAR sensor's mount location on a powered earth-moving vehicle (e.g., for one or more on-vehicle LiDAR sensors that are mounted or otherwise positioned on movable component parts of a particular powered earth-moving vehicle, such as hydraulic arms, tool attachments, etc.), and to perform further automated vehicle positioning determination using the calibrated LiDAR data. The calibration may include determining at least one transformation for each LiDAR sensor between its mount location and a known position in a global common coordinate system, such as based on RTK-corrected GPS-based vehicle location, and LiDAR-based Simultaneous Localization And Mapping (SLAM) processing may be used with calibrated LiDAR data to determine vehicle position (Continued)

(location and orientation) on a site on which the vehicle is located.

19 Claims, 27 Drawing Sheets

(56) References Cited

U.S. PATENT DOCUMENTS

| | | | | |
|---|---|---|---|---|
| 11,237,558 | B1 | 2/2022 | Kikani et al. | |
| 11,346,086 | B1 * | 5/2022 | Kikani | E02F 3/434 |
| 11,375,041 | B2 | 6/2022 | Theverapperuma et al. | |
| 11,494,930 | B2 | 11/2022 | Theverapperuma et al. | |
| 11,560,690 | B2 | 1/2023 | Halder et al. | |
| 11,567,197 | B2 | 1/2023 | Halder | |
| 11,577,741 | B1 | 2/2023 | Reschka et al. | |
| 11,686,856 | B2 * | 6/2023 | Shimada | E02F 9/267 701/32.4 |
| 11,853,068 | B1 | 12/2023 | Agarwal et al. | |
| 2008/0018271 | A1 * | 1/2008 | Morinaga | E02F 9/123 318/257 |
| 2008/0047170 | A1 | 2/2008 | Nichols | |
| 2009/0048736 | A1 | 2/2009 | Kristensen et al. | |
| 2014/0240690 | A1 | 8/2014 | Newman et al. | |
| 2019/0129436 | A1 | 5/2019 | Sun et al. | |
| 2020/0024828 | A1 | 1/2020 | Asada et al. | |
| 2020/0032483 | A1 | 1/2020 | Ready-Campbell et al. | |
| 2020/0032490 | A1 | 1/2020 | Ready-Campbell et al. | |
| 2020/0111169 | A1 | 4/2020 | Halder et al. | |
| 2020/0150650 | A1 | 5/2020 | Jarlengrip | |
| 2020/0150687 | A1 | 5/2020 | Halder et al. | |
| 2020/0284883 | A1 * | 9/2020 | Ferreira | G01S 7/497 |
| 2020/0310442 | A1 | 10/2020 | Halder et al. | |
| 2021/0017738 | A1 | 1/2021 | Sano | |
| 2021/0095438 | A1 * | 4/2021 | Cámara Puerto | E02F 3/088 |
| 2021/0148089 | A1 | 5/2021 | Lee et al. | |
| 2021/0191409 | A1 | 6/2021 | Ready-Campbell et al. | |
| 2021/0239837 | A1 | 8/2021 | Friend | |
| 2021/0254304 | A1 * | 8/2021 | Konda | E02F 3/32 |
| 2021/0254308 | A1 | 8/2021 | Thibblin et al. | |
| 2021/0286924 | A1 | 9/2021 | Wyrwas et al. | |
| 2021/0317633 | A1 | 10/2021 | Sherlock | |
| 2022/0024485 | A1 | 1/2022 | Theverapperuma et al. | |
| 2022/0026921 | A1 | 1/2022 | Halder | |
| 2022/0042286 | A1 | 2/2022 | Tsuji et al. | |
| 2022/0057513 | A1 | 2/2022 | Pihl | |
| 2022/0074165 | A1 * | 3/2022 | Iwasaki | E02F 9/265 |
| 2022/0106764 | A1 * | 4/2022 | Iwasaki | E02F 9/2221 |
| 2022/0127825 | A1 * | 4/2022 | Iwasaki | E02F 9/22 |
| 2022/0145592 | A1 * | 5/2022 | Zimmerman | E02F 3/283 |
| 2022/0154431 | A1 | 5/2022 | Kurosawa | |
| 2022/0340171 | A1 | 10/2022 | Halder | |
| 2022/0403617 | A1 * | 12/2022 | Matsuyama | E02F 3/3677 |
| 2023/0071015 | A1 | 3/2023 | Wu | |
| 2023/0134855 | A1 | 5/2023 | Hodel et al. | |
| 2023/0203791 | A1 * | 6/2023 | Saito | E02F 3/435 701/50 |
| 2023/0250617 | A1 * | 8/2023 | Konda | E02F 9/264 702/97 |
| 2023/0314577 | A1 * | 10/2023 | Harms | E02F 9/264 342/174 |
| 2023/0329218 | A1 * | 10/2023 | Zink | B05B 12/124 |
| 2024/0068202 | A1 | 2/2024 | Gagic et al. | |
| 2025/0297464 | A1 * | 9/2025 | Bakken | E02F 9/267 |
| 2025/0347090 | A1 * | 11/2025 | Hodel | E02F 3/32 |

FOREIGN PATENT DOCUMENTS

| | | | |
|---|---|---|---|
| EP | 3852018 | A1 | 7/2021 |
| EP | 4083335 | A2 | 8/2022 |
| KR | 10-2022-0014477 | | 12/2022 |
| WO | 2018099755 | A1 | 6/2018 |
| WO | 2021/101241 | A1 | 5/2021 |
| WO | 2021/183260 | A1 | 9/2021 |
| WO | 2021/241716 | A1 | 12/2021 |
| WO | 2022198331 | A1 | 9/2022 |

OTHER PUBLICATIONS

Elaine Ball, "Top Benefits Of Using LiDAR For Construction Projects", Oct. 1, 2020, retrieved from https://csengineermag.com/top-benefits-of-using-lidar-for-construction-projects/ on Nov. 4, 2022, 4 pages.

* cited by examiner

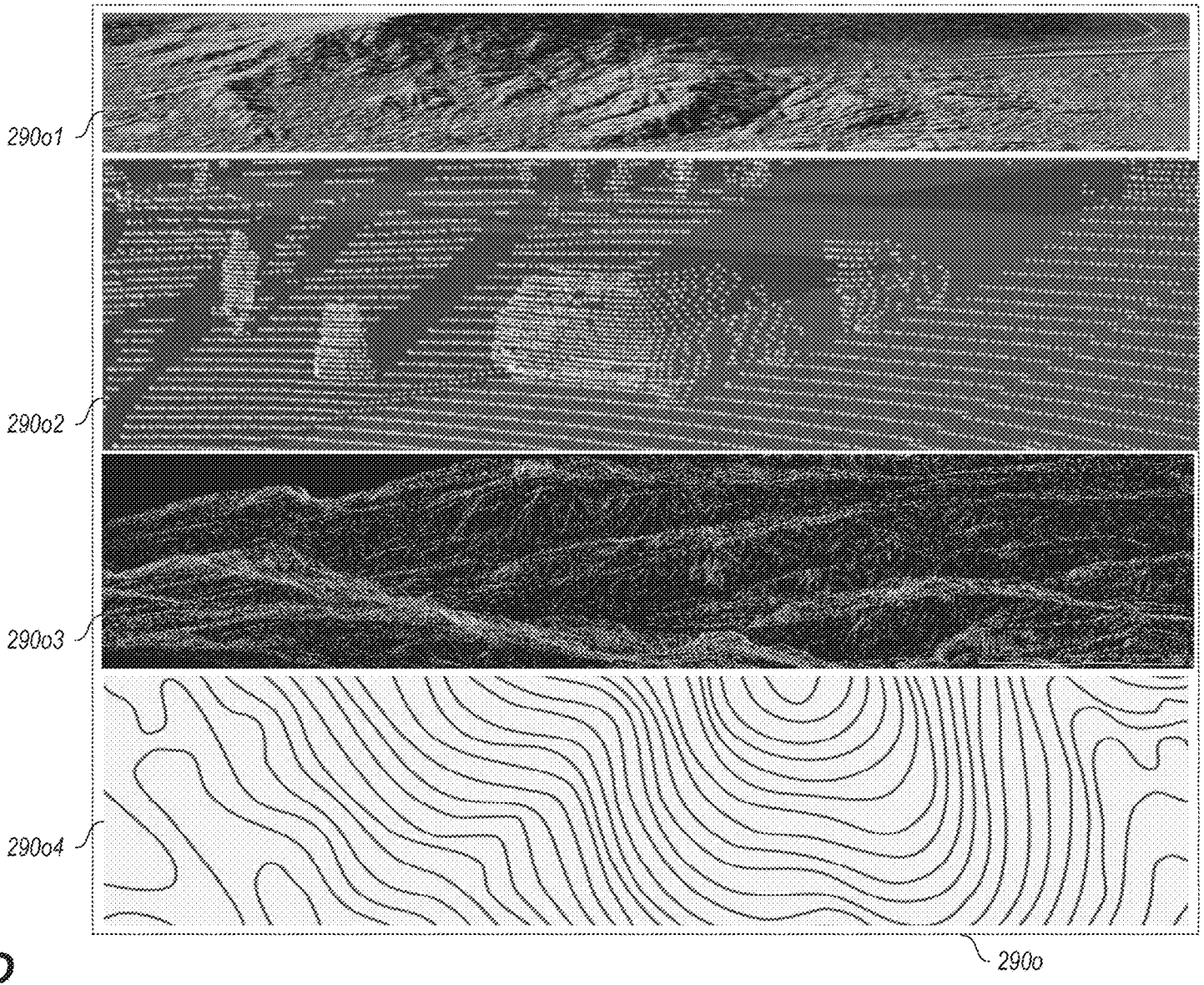
FIG. 2-O

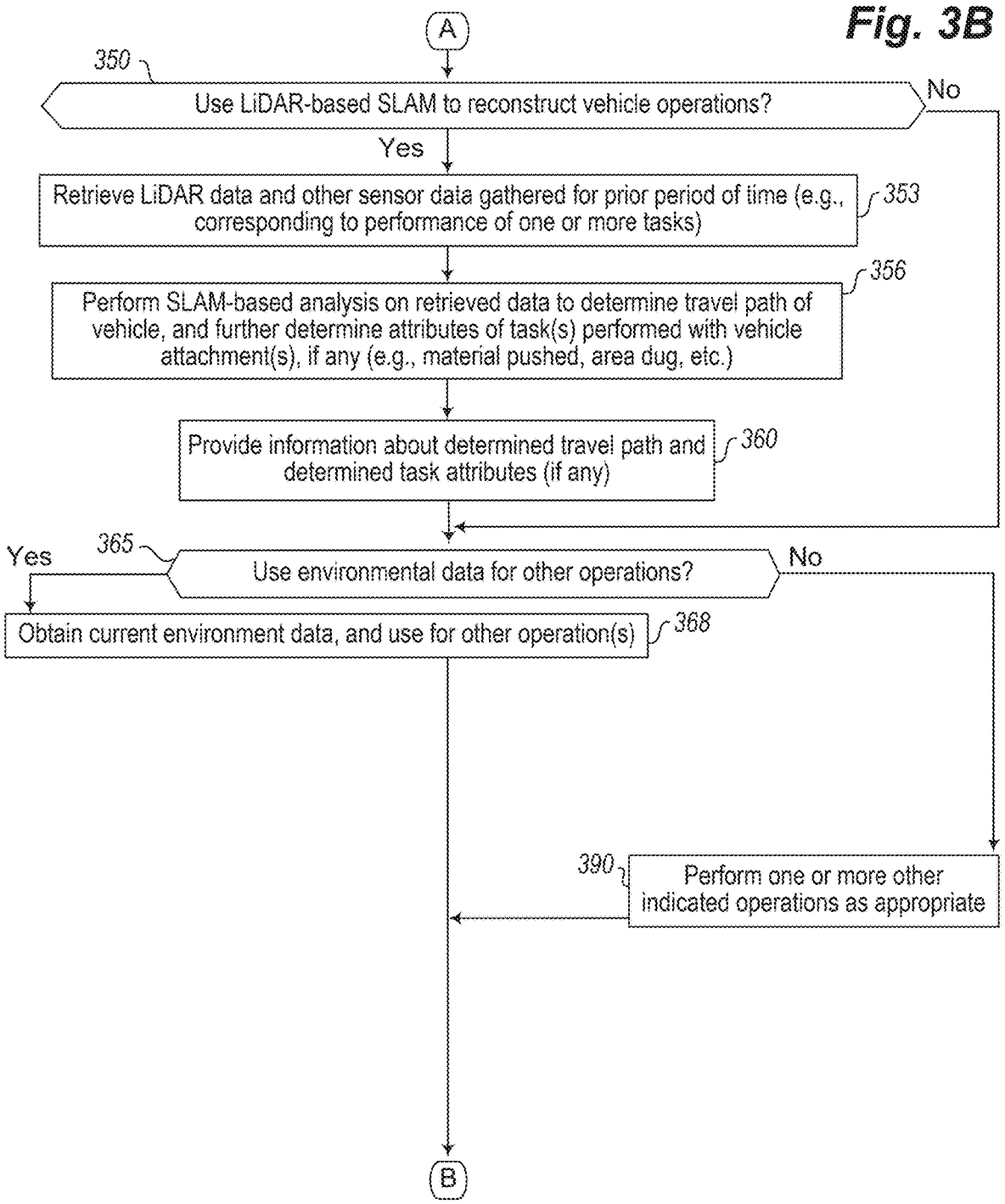
Fig. 3B
A
350
Use LiDAR-based SLAM to reconstruct vehicle operations?
No
Yes
Retrieve LiDAR data and other sensor data gathered for prior period of time (e.g., corresponding to performance of one or more tasks)
353
356
Perform SLAM-based analysis on retrieved data to determine travel path of vehicle, and further determine attributes of task(s) performed with vehicle attachment(s), if any (e.g., material pushed, area dug, etc.)
Provide information about determined travel path and determined task attributes (if any)
360
Yes
365
Use environmental data for other operations?
No
Obtain current environment data, and use for other operation(s)
368
390
Perform one or more other indicated operations as appropriate
B

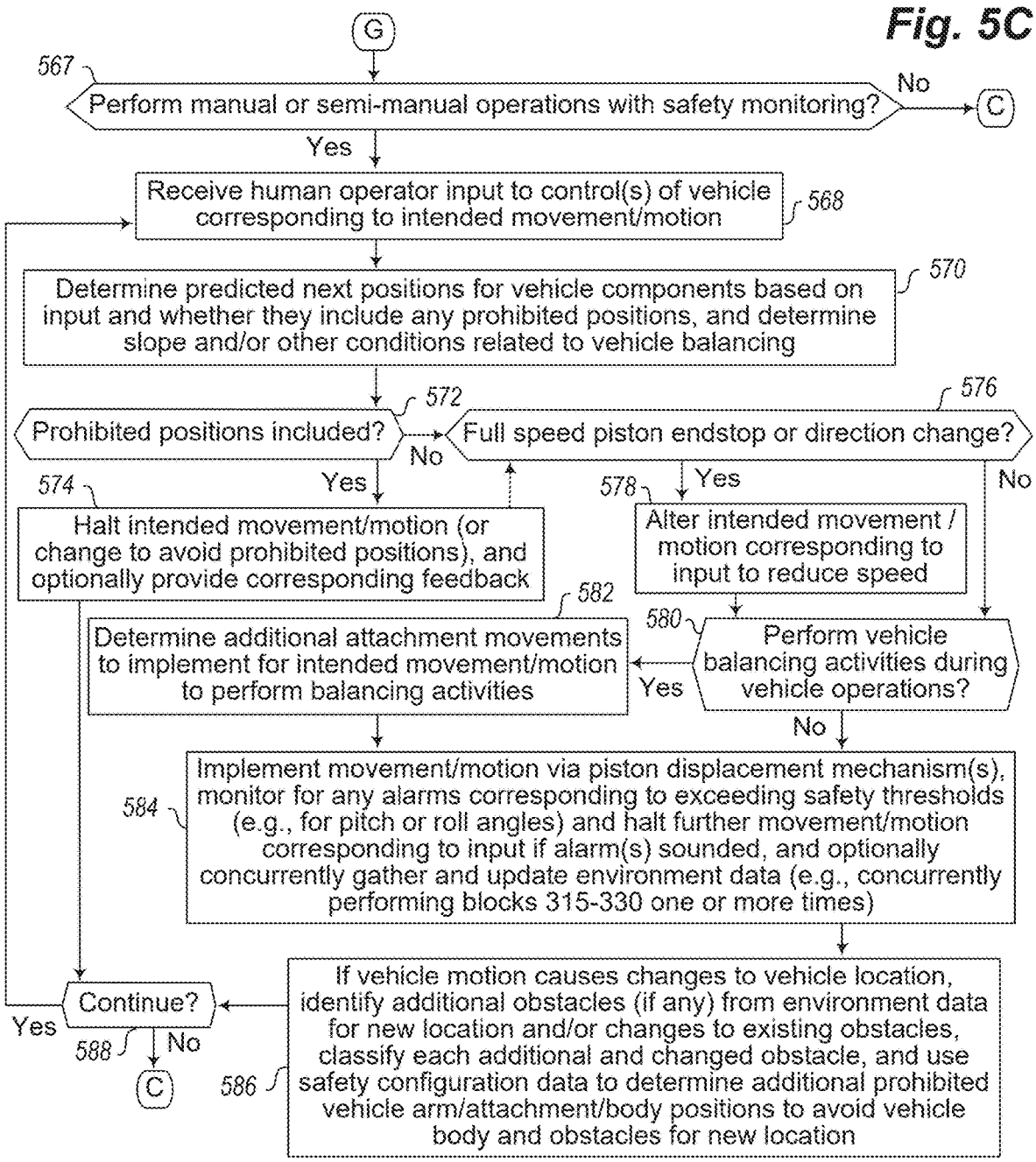
Fig. 5C
G
567
Perform manual or semi-manual operations with safety monitoring?
No
C
Yes
Receive human operator input to control(s) of vehicle corresponding to intended movement/motion
568
Determine predicted next positions for vehicle components based on input and whether they include any prohibited positions, and determine slope and/or other conditions related to vehicle balancing
570
572
Prohibited positions included?
No
576
Full speed piston endstop or direction change?
Yes
574
Halt intended movement/motion (or change to avoid prohibited positions), and optionally provide corresponding feedback
578
Yes
Alter intended movement / motion corresponding to input to reduce speed
No
582
Determine additional attachment movements to implement for intended movement/motion to perform balancing activities
580
Perform vehicle balancing activities during vehicle operations?
Yes
No
584
Implement movement/motion via piston displacement mechanism(s), monitor for any alarms corresponding to exceeding safety thresholds (e.g., for pitch or roll angles) and halt further movement/motion corresponding to input if alarm(s) sounded, and optionally concurrently gather and update environment data (e.g., concurrently performing blocks 315-330 one or more times)
Continue?
Yes
588
No
C
586
If vehicle motion causes changes to vehicle location, identify additional obstacles (if any) from environment data for new location and/or changes to existing obstacles, classify each additional and changed obstacle, and use safety configuration data to determine additional prohibited vehicle arm/attachment/body positions to avoid vehicle body and obstacles for new location

AUTONOMOUS POWERED EARTH-MOVING VEHICLE CONTROL USING LiDAR DATA FROM ON-VEHICLE SENSORS

CROSS REFERENCE TO RELATED APPLICATIONS

This application claims the benefit of U.S. Provisional Patent Application No. 63/650,760, filed May 22, 2024 and entitled "Autonomous Powered Earth-Moving Vehicle Control Using LiDAR Data From On-Vehicle Sensors," which is hereby incorporated by reference in its entirety.

TECHNICAL FIELD

The following disclosure relates generally to systems and techniques for autonomous control of powered earth-moving vehicles, such as to implement automated vehicle position determination and other autonomous operations of one or more powered earth-moving mining and/or construction vehicles on a site using LiDAR data from one or more on-vehicle LiDAR sensors in combination with other on-vehicle sensors after automated LiDAR sensor calibration is performed.

BACKGROUND

Earth-moving construction vehicles (e.g., loaders, excavators, bulldozers, deep sea machinery, extra-terrestrial machinery, etc.) may be used on a job site to move soil and other materials (e.g., gravel, rocks, asphalt, etc.) and to perform other operations, and are each typically operated by a human operator (e.g., a human user present inside a cabin of the construction vehicle, a human user at a location separate from the construction vehicle but performing interactive remote control of the construction vehicle, etc.). Similarly, earth-moving mining vehicles may be used to extract or otherwise move soil and other materials (e.g., gravel, rocks, asphalt, etc.) and to perform other operations, and are each typically operated by a human operator (e.g., a human user present inside a cabin of the mining vehicle, a human user at a location separate from the mining vehicle but performing interactive remote control of the mining vehicle, etc.).

Limited fully autonomous operations (e.g., performed under automated programmatic control without human user interaction or intervention) of some construction and mining vehicles have occasionally been used, but existing techniques suffer from a number of problems, including the use of limited types of sensed data, an inability to perform fully autonomous operations when faced with on-site obstacles, an inability to coordinate autonomous operations between multiple on-site construction and/or mining vehicles, requirements for bulky and expensive hardware systems to support the limited autonomous operations, etc.

BRIEF DESCRIPTION OF THE DRAWINGS

FIGS. 2M-2S illustrate examples of autonomous operations and associated data used to determine and implement autonomous operations of one or more powered earth-moving vehicles on a site using data gathered by on-vehicle LiDAR sensors and other on-vehicle sensors, including to perform automated LiDAR sensor calibration and automated LiDAR-based SLAM positioning operations.

FIGS. 3A-3B are an example flow diagram of an illustrated embodiment of an Earth-Moving Vehicle Autonomous Operations Control (EMVAOC) System routine.

FIGS. 5A-5C are an example flow diagram of an illustrated embodiment of an EMVAOC Operations Planner And Implementation module routine.

DETAILED DESCRIPTION

Figure 1A:
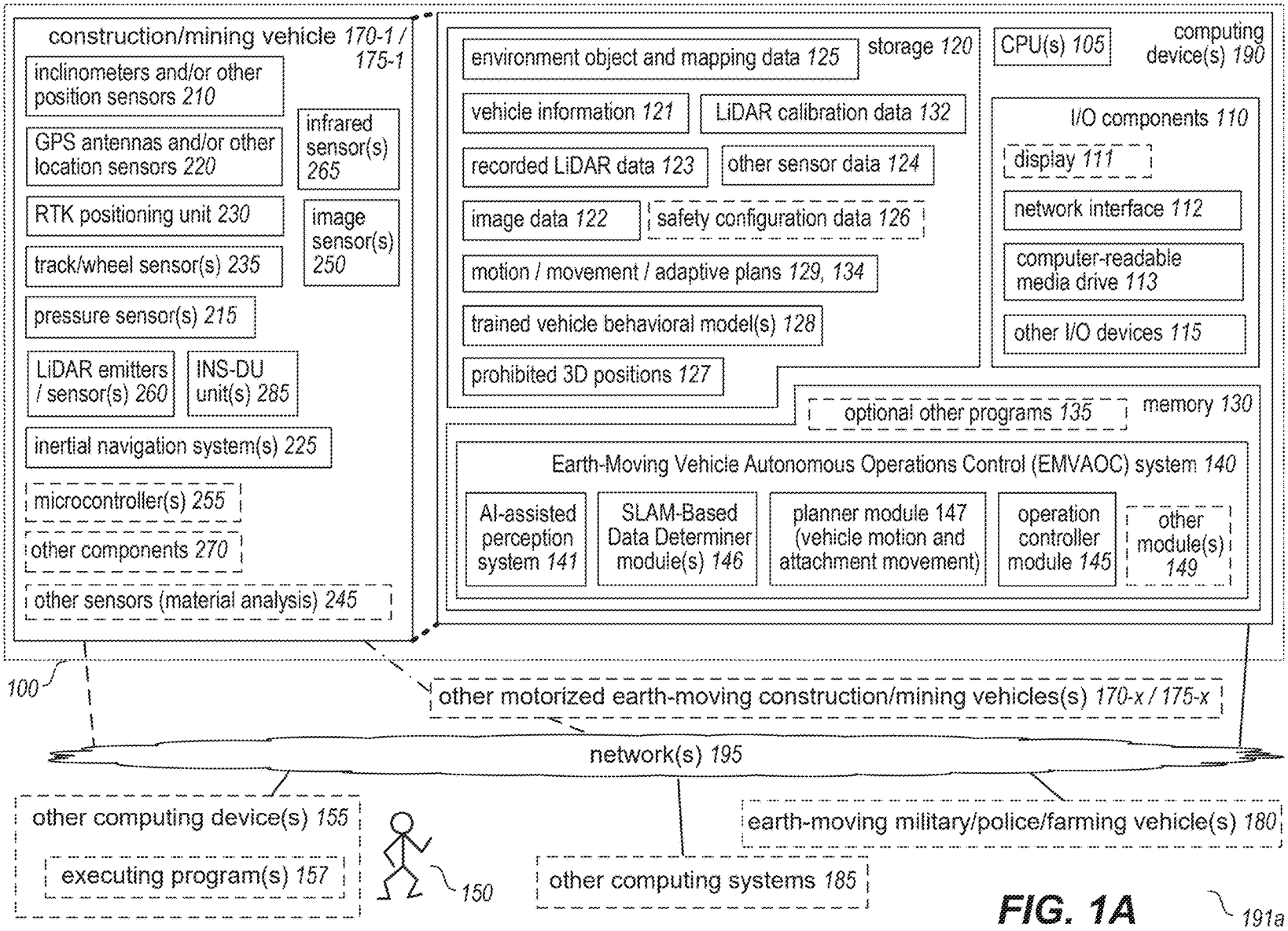
FIG. 1A is a network diagram illustrating an example embodiment of using described systems and techniques to determine and implement autonomous operations of one or more powered earth-moving vehicles on a site using data gathered by on-vehicle LiDAR sensors and other on-vehicle sensors, including to perform automated LiDAR sensor calibration and automated LiDAR-based SLAM (Simultaneous Localization And Mapping) positioning operations.

Systems and techniques are described for implementing autonomous control of operations of powered earth-moving vehicles (e.g., construction and/or mining vehicles) on a site by using data gathered by on-vehicle LiDAR sensors and other on-vehicle sensors, including to automatically calibrate one or more LiDAR sensors on a powered earth-moving vehicle, and to perform further automated vehicle positioning determination using the calibrated LiDAR data. In at least some embodiments, one or more on-vehicle LiDAR sensors are mounted or otherwise positioned on movable component parts of a particular powered earth-moving vehicle (e.g., hydraulic arms, tool attachments, etc.) or other vehicle locations (e.g., a vehicle body), and the autonomous control of operations of the vehicle may include gathering and using LiDAR data in particular manners to calibrate the LiDAR sensor(s), such as precisely determine the mount position (location and orientation) of each such LiDAR sensor relative to one or more other reference positions (e.g., on a body of the vehicle, such as to correspond to a machine center at a lowest point on the body, to one or more positions on the vehicle body at which one or more GPS sensors or other location sensors are mounted, etc.), such as to a reference position from which a vehicle-centric coordinate system is determined for vehicle component parts and vehicle surroundings. The calibration may include determining, given a position of a movable component part(s) or other vehicle part on which the LiDAR sensor(s) are positioned, at least one transformation for each LiDAR sensor between its mount location and a known reference position in a global common coordinate system (e.g., based on GPS-based vehicle location, optionally refined using RTK correction data as discussed further below)—once the transformation(s) for a LIDAR sensor are determined, the determined transformation(s) may be used to convert further LiDAR data gathered by that LiDAR sensor in a coordinate system relative to that LiDAR sensor into the common coordinate system. In addition, once the LiDAR sensor(s) on the powered earth-moving vehicle are calibrated, LiDAR data from the LiDAR sensor(s) may be used with LiDAR-based Simultaneous Localization And Mapping (SLAM) processing techniques to determine vehicle position (location and orientation) on a site on which the vehicle is located, optionally in combination with other data from other on-vehicle sensors. Additional details related to implementing autonomous control of powered earth-moving vehicles in particular manners are described below, and some or all of the described techniques are performed in at least some embodiments by automated operations of an Earth-Moving Vehicle Autonomous Operations Control ("EMVAOC") system to control one or more powered earth-moving vehicles (e.g., an EMVAOC system operating on at least one powered earth-moving vehicle being controlled).

In some embodiments and situations, the autonomous control of operations of a powered earth-moving vehicle is performed as part of fully autonomous operations of the powered earth-moving vehicle without any human input during those fully autonomous operations (e.g., to receive human input only to provide information about task goals and/or other configuration settings before the fully autonomous operations commence), including planning motion of the powered earth-moving vehicle between on-site locations and/or movement of component parts of the vehicle (e.g., hydraulic arms, tool attachments, a rotatable cabin, etc.) to accomplish one or more indicated tasks without violating specified safety configuration data, and implementing the planned motion/movement via automated manipulation of controls of the vehicle. In some embodiments and situations, the autonomous control of the operations of a powered earth-moving vehicle is performed as part of semi-autonomous operations of the powered earth-moving vehicle, including monitoring manipulation of some or all controls of the vehicle by one or more human operators (whether located in or on the vehicle, or instead remote from the vehicle) during the vehicle operations, and preventing or otherwise inhibiting motion/movements of the powered earth-moving vehicle that would violate the specified safety configuration data (e.g., to, even if not manually specified, automatically perform one or more of balancing-related operations, slippage-related operations, controlled stoppage operations, gradual turning operations, etc.) or that otherwise satisfy specified movement inhibition criteria, or to otherwise provide automated assistance to the actions of the human operator(s). Controlled operations of the powered earth-moving vehicle may in some embodiments and situations be performed while the vehicle remains at a fixed location (e.g., for a tracked excavator vehicle, to include movements such as rotation of the cabin and associated tools (referred to at times as the 'house' or 'rotating platform') and/or hydraulic arm movements and/or tool attachment movements, but not to include movement of the tracks), and may in some embodiments and situations be performed as the vehicle is in motion from an initial location to a destination location (e.g., with the tracks and/or wheels rotating or otherwise in motion).

As noted above, the automated operations of the EMVAOC system may include gathering and using LiDAR data to calibrate a LiDAR sensor mounted on a powered earth-moving vehicle. In particular, in order to use different data sets gathered at different times from such a sensor, such as to combine or compare the data in different data sets, and/or to combine data in one or more such data sets with other data in other data sets gathered from other sensors at other positions (e.g., other sensors of other types, one or more other sensors of the same type, etc.), a global common coordinate system or other global common frame of reference is first determined for the data sets. In order to determine such a global common coordinate system or other global common frame of reference for a data set from an on-vehicle sensor, the position of that sensor in 3D (three dimensional) space is determined at a time of gathering that data set, such as based on a relative position of that sensor to one or more other reference points with known locations in the global common coordinate system or other global common frame of reference—at least one such other reference point may be another point on the vehicle (e.g., a point on the vehicle that is not independently movable from the vehicle body, such as a point on the vehicle body, including in some embodiments and situations to be a point where a GPS sensor is attached, and in other embodiments and situations to be a different point, such as a lowest center point on a front of the vehicle body), and the global common coordinate system or other global common frame of reference may in some embodiments be defined relative to that reference point, while in other embodiments the global common coordinate system or other global common frame of reference may be an absolute system (e.g., GPS coordinates) in which the coordinates for that reference point within the absolute system are known or determinable. In order to place the data sets for each such on-vehicle sensor in the global common coordinate system or other global common frame of reference, one or more transformations are determined between a local coordinate system or other local frame of reference relative to the position of that sensor and the global common coordinate system or other global common frame of reference, optionally with a first intermediate transformation from the sensor's local coordinate system or other local frame of reference to a local coordinate system or other local frame of reference for the other reference point on the vehicle (e.g., that reflects an orientation of the vehicle that may differ from that of the global common coordinate system or other global common frame of reference), and a second intermediate transformation from the reference point's local coordinate system or other local frame of reference to the global common coordinate system or other global common frame of reference (e.g., with an orientation corresponding to the vehicle being level in X and Y coordinates, with Z corresponding to height).

In at least some embodiments, as part of determining a transformation to use for a LiDAR sensor mounted on a movable component part of a powered earth-moving vehicle, the automated operations include capturing LiDAR data as the vehicle moves (e.g., along a predefined trajectory) to generate a 3D point cloud at each of multiple vehicle positions along the movement path (e.g., every foot, every 5 or 10 or 15 feet, substantially continuously, etc.), while simultaneously capturing other sensor data from on-vehicle sensors for at least the same vehicle positions—such other sensor data may include, for example, IMU (inertial measurement unit) data for at least inclinometers positioned on the vehicle (e.g., in the cabin or otherwise on the body, on movable component part(s) on which the LiDAR sensor(s) are mounted, etc.), GPS location data, RTK (real-time kinematic) correction data for the GPS data, etc. A trajectory followed by the LiDAR sensor may then be determined by analyzing the LiDAR data, such as using CT-ICP (continuous-time iterative closest point) processing—one example of a corresponding algorithm is described in "CT-ICP: Real-Time Elastic LiDAR Odometry With Loop Closure", arXiv: 2019.12979v2, accessible at https://arxiv.org/pdf/2109.12979, which is incorporated herein by reference in its entirety. A best fitting transformation is then determined between the mount location of the LiDAR sensor on the vehicle and an additional reference point on the vehicle having a known GPS location (e.g., a vehicle point at which a GPS sensor is located), in light of the associated position of the vehicle part on which the LiDAR sensor is mounted (e.g., as determined using IMU data for that vehicle part) and associated RTK-corrected GPS data, by analyzing the LiDAR-based 3D point clouds for the multiple vehicle positions. In at least some embodiments, a further optimization phase may be performed to refine the determined transformation, such as by having the vehicle travel a longer distance (e.g., 50 feet, 100 feet, 500 feet, etc.) while similarly capturing LiDAR data and other sensor data for at least the beginning and end of the longer distance and optionally at points along the longer distance, and performing similar analyses, as well as applying transformations to reflect the rotational differences between the LiDAR sensor mount location and a different reference point on the vehicle. Additional details are included below related to implementing automated operations for calibrating on-vehicle LiDAR sensors.

As is also noted above, the automated operations of the EMVAOC system may include, once the LiDAR sensor(s) on a powered earth-moving vehicle are calibrated, using LiDAR-based SLAM processing to analyze LiDAR data from the LiDAR sensor(s) to determine vehicle position (location and orientation) on the vehicle's site, and in at least some embodiments in combination with other data from other on-vehicle sensors. For example, in some embodiments and situations, the LiDAR data may be used alone to determine on-site vehicle positioning data, while in other embodiments the LiDAR data may be used together with GPS data (e.g., RTK-corrected GPS data) for such on-site vehicle positioning determination (e.g., with one of the LiDAR and RTK-corrected GPS data used as a primary basis for the vehicle position determination and the other used as a backup to validate that vehicle position determination; with the LiDAR and RTK-corrected GPS data combined and used together for vehicle position determination, such as to perform a weighted average or other combination; etc.). In addition, LiDAR data may be used in combination with other sensor data in various other manners in various embodiments, with non-exclusive examples including the following: during ICP computation using Kalman filters, using other sensor data to reduce the search space for the computation, such as by eliminating some possibilities; using IMU data to assist with a determination of vehicle velocity, such as in combination with RTK-corrected GPS data; using other data to filter raw LiDAR point cloud data to remove unwanted regions (e.g., corresponding to components of the vehicle, other on-site moving obstacles, etc.); etc. In addition, further techniques may be used in at least some embodiments to improve the vehicle position determination based at least in part on LiDAR-based SLAM analysis, such as using loop closure to avoid ICP drifting over time (e.g., using a travel path that returns to an earlier starting point), sampling LiDAR point cloud data to provide efficiency by analyzing less data, using GPUs (graphic processing units) to improve processing speed, etc. Additional details are included below related to implementing automated operations for using LiDAR data as part of vehicle position determination.

The automated operations of the EMVAOC system may further include using LiDAR sensor data and optionally other sensor data (e.g., image data, RTK-corrected GPS data or other GPS data, inclinometer data or other IMU data, etc.) as part of reconstructing vehicle operations over a prior period of time (e.g., while performing one or more tasks), such as vehicle motion on the site and/or vehicle tool attachment movements—non-exclusive examples of such vehicle operations include a bulldozer vehicle moving dirt or other materials along one or more pushing lanes, an excavator vehicle digging a trench or other hole, etc. The reconstruction may include performing LiDAR-based SLAM processing to determine the vehicle motion and tool attachment movements, as well as changes to the surroundings from the vehicle operations (e.g., movement of dirt and other materials), and optionally using other data (e.g., image data) to supplement or verify the LiDAR-based data. The reconstructed vehicle operation data may then be further used in additional manners in at least some embodiments and situations, such as to confirm performance of planned tasks, plan further vehicle operations, etc.

The described techniques provide various benefits in various embodiments, including to improve efficiency and speed and accuracy and safety in sensor data and resulting operations based on calibrating on-vehicle LiDAR sensors that are mounted on movable vehicle components or elsewhere on the vehicle, including to ensure accuracy of the sensor data that is used for subsequent operations, and to improve efficiency and speed and accuracy and safety in sensor data and resulting operations based on using LiDAR data from calibrated on-vehicle LiDAR sensors for vehicle position determination. In addition, in some embodiments the described techniques may be used to provide an improved GUI in which one or more users (e.g., on-site and/or remote users) may obtain and view information about operations of one or more powered earth-moving vehicles on a site, and in which an operator user may more accurately control operations of one or more such powered earth-moving vehicles. Various other benefits are also provided by the described techniques, some of which are further described elsewhere herein.

For illustrative purposes, some embodiments are described below in which specific types of data are acquired and used for specific types of automated operations performed for specific types of powered earth-moving vehicles, and in which specific types of autonomous operation activities are performed in particular manners. However, it will be understood that such described systems and techniques may be used with other types of data and powered earth-moving vehicles and associated autonomous operation activities in other manners in other embodiments, and that the invention is thus not limited to the exemplary details provided. In addition, the terms "acquire" or "capture" or "record" as used herein with reference to sensor data may refer to any recording, storage, or logging of media, sensor data, and/or other information related to a powered earth-moving vehicle or job site or other location or subsets thereof (unless context clearly indicates otherwise), such as by a recording device or by another device that receives information from the recording device. In addition, various details are provided in the drawings and text for exemplary purposes, but are not intended to limit the scope of the invention. For example, sizes and relative positions of elements in the drawings are not necessarily drawn to scale, with some details omitted and/or provided with greater prominence (e.g., via size and positioning) to enhance legibility and/or clarity. Furthermore, identical reference numbers may be used in the drawings to identify similar elements or acts.

FIG. 1A is a network diagram illustrating information 191*a* including an example embodiment of an EMVAOC ("Earth-Moving Vehicle Autonomous Operations Control") system 140 that may be used to implement at least some of the described systems and techniques for implementing autonomous control of powered earth-moving vehicles, such as to automatically control motion of one or more powered earth-moving vehicles between locations on a job site and movement of parts of the vehicle(s) (e.g., to conform with specified safety rules or other specified safety configuration data), including to perform automated LiDAR-based SLAM vehicle positioning operations, as well as to perform automated operations related to balancing, slippage, gradual turning, and controlled shutdown procedures. The EMVAOC system 140 may be implemented using one or more hardware processors 105, such as part of one or more network-accessible configured computing devices 190—such a computing device may in some embodiments and situations be part of a self-contained control unit located on a powered earth-moving vehicle (e.g., without a separate cooling unit, and operable without receiving external instructions), such as when the EMVAOC system 140 is part of otherwise integrated 100 with a particular powered earth-moving construction vehicle (e.g., located on that powered earth-moving vehicle), such as construction vehicle 170-1 and/or mining vehicle 175-1 and/or other powered earth-moving vehicle(s) 180 (e.g., one or more military vehicles and/or police vehicles and/or farming vehicles). In other embodiments and situations, the EMVAOC system 140 may support multiple powered earth-moving vehicles 170 and/or 175 and/or 180 (e.g., operating in a distributed manner on the multiple vehicles, such as one computing device 190 on each of the multiple vehicles that are interacting in a peer-to-peer manner), or instead operate remotely from one or more such powered earth-moving vehicles 170 and/or 175 and/or 180 (e.g., at a location on site and in communication with one or more such powered earth-moving vehicles over one or more networks 195). In some embodiments, one or more other computing devices or systems may further interact with the EMVAOC system 140 (e.g., to obtain and/or provide information), such as one or more other computing devices 155 each having one or more associated users and optionally executing one or more software programs 157, and/or one or more other computing systems 185 (e.g., to store and provide data, to provide supplemental computing capabilities, etc.). The one or more computing devices 190 may include any computing device or system that may receive data and/or requests, and take corresponding actions (e.g., store the data, respond to the request, etc.) as discussed herein. The earth-moving vehicle(s) 170 and/or 175 and/or 180 may correspond to various types of vehicles and have various forms, with non-exclusive examples illustrated in FIGS. 2A-2L.

In this example, the powered earth-moving vehicle 170-1 or 175-1 includes a variety of sensors to obtain and determine information about the powered earth-moving vehicle and its surrounding environment (e.g., a job site on which the powered earth-moving vehicle is located), including one or more GPS antennas and/or other location sensors 220, one or more inclinometers and/or other position sensors 210, one or more image sensors 250 (e.g., visible light sensors that are part of one or more cameras or other image capture devices), one or more LiDAR components 260 (e.g., with LiDAR emitters and sensors), one or more infrared sensors 265, one or more pressure sensors 215, optionally an RTK-enabled GPS positioning unit 230 that receives GPS signals from the GPS antenna(s) and RTK-based correction data from a remote base station (not shown) and optionally other data from one or more other sensors and/or devices, optionally one or more INS-DU or other IMU units 285 (e.g., each using 3-axis precision magnetometers, accelerometers and gyroscopes along with GPS data, such as RTK-corrected GPS data, for high-precision position determination) or other inertial navigation systems 225, optionally one or more track or wheel alignment sensors 235, optionally one or more other sensors 245 (e.g., material analysis sensors, sensors associated with radar and/or ground-penetrating radar and/or sonar, etc.), etc. The powered earth-moving vehicle 170-1 or 175-1 may further optionally include one or more microcontrollers or other hardware CPUs 255 and/or other hardware components 270 (e.g., corresponding to some or all of the components 110, 120 and 130), such as part of a self-contained control unit that operates on the vehicle without a cooling unit to implement some or all of the EMVAOC system 140 (e.g., to execute some or all of the AI-assisted perception system 141, planner module 147, module 146, and/or optional other modules such as modules 145 and 149).

The EMVAOC system 140 obtains some or all of the data from the sensors on the powered earth-moving vehicle 170-1 or 175-1, stores the data in corresponding databases or other data storage formats on storage 120 (e.g., vehicle information 121, image data 122, LiDAR data 123, other sensor data 124, environment object (e.g., obstacle) and other mapping (e.g., terrain) data 125, etc.), and uses the data to perform automated operations involving controlling autonomous operations of the powered earth-moving vehicle 170-1 or 175-1 in accordance with safety configuration data 126 if specified, including related to performing automated balancing-related operations. In this example embodiment, the EMVAOC system 140 has modules that include an AI-assisted perception system 141 (e.g., to analyze LiDAR and/or visual data of the environment to identify objects and/or determine mapping data 125 for an environment around the vehicle 170-1 and/or 175-1, such as a 3D point cloud, a terrain contour map or other visual map, etc.), a LiDAR-based SLAM-based Data Determiner module 146 to determine calibration information for one or more on-vehicle LiDAR sensors and to use LiDAR data to determine vehicle positioning (e.g., using LiDAR-based SLAM); a vehicle motion and part movement planner module 147 (e.g., to determine how to accomplish a goal that includes movement of one or more parts of a vehicle, such as to perform operations related to balancing, slippage, gradual turning, and controlled shutdown procedures, optionally while avoiding prohibited 3D positions and/or performing one or more tasks, as well as optionally moving the powered earth-moving vehicle from its current location to a determined target destination location and determining how to handle any possible obstacles between the current and destination locations), a system operation manager module 145 (e.g., to control overall operation of the EMVAOC system and/or the vehicle 170-1 and/or 175-1), and optionally other modules (e.g., an obstacle determiner module to analyze information about potential obstacles in an environment of powered earth-moving vehicle 170-1 or 175-1 and determine corresponding information, such as a classification of the type of the obstacle, for use in generating prohibited 3D position data 127 corresponding to the obstacles and optionally parts of the vehicle; a blade load determiner module; a blade-based turn determiner module; a ripper lane coverage determiner module; a slope-based stop determiner module; a LiDAR calibration module using techniques other than SLAM; etc.). Such modules may generate and use additional data as part of their operations, including to generate LiDAR calibration data 132 (e.g., one or more determined transformations for each LiDAR sensor), for the planner module to use one or more trained vehicle behavioral models 128 as part of implementing planned vehicle motion and vehicle part movements and generating one or more corresponding vehicle motion plans and/or vehicle part movement plans 129 (e.g., to perform one or more tasks, optionally performing planned balancing while the vehicle is on a non-level surface that meets defined criteria, optionally performing gradual turning, optionally performing controlled shutdown procedures, etc.), and later determining and implementing one or more adaptive vehicle motion/movement plans 134 for use in addressing changing conditions while performing other operations (e.g., to adapt an original motion/movement plan 129 in use when the changing conditions occur), such as adaptive plans related to slippage and/or unplanned controlled shutdown procedures—balancing-related criteria may include, for example, having a slope greater than a defined threshold slope amount, being on an incline or decline with a height greater than one or more defined threshold height amounts, being on an incline or decline with a length greater or lesser than one or more defined threshold length amounts, being on a surface with a material of a defined type, being on a surface having a coefficient of friction below a defined threshold friction amount, having a weight of the vehicle and/or its load being above a defined weight threshold amount, etc., and similar conditions may cause or contribute to slippage in some situations. In addition, such modules may generate and use additional data as part of training the behavioral model(s) (e.g., using actual operational data from one or more powered earth-moving vehicles 170/175/180 and or simulated data from one or more simulator modules, not shown), etc. The modules of the EMVAOC system 140 may further optionally include one or more other modules 149 to perform additional automated operations and provide additional capabilities (e.g., analyzing and describing a job site or other surrounding environment, such as quantities and/or types and/or locations and/or activities of vehicles and/or people; an obstacle determiner module to detect and classify objects and other obstacles in an environment around the vehicle; a slope-based stop determiner module to determine whether to implement a controlled stop based at least in part on the slope of the surface that the vehicle is approaching; one or more GUI modules, including to optionally support one or more VR (virtual reality) headsets/glasses and/or one or more AR (augmented reality) headsets/glasses and/or mixed reality headsets/glasses optionally having corresponding input controllers; etc.). In at least some embodiments, some of the EMVAOC system 140 may execute on a powered earth-moving vehicle, while other parts of the EMVAOC system 140 (e.g., the planner module 147) may execute remotely from the powered earth-moving vehicle and exchange information with the portions of the EMVAOC system 140 executing on the powered earth-moving vehicle. Additional details related to the operation of the EMVAOC system 140 are included elsewhere herein.

In this example embodiment, the one or more computing devices 190 include a copy of the EMVAOC system 140 stored in memory 130 and being executed by one or more hardware CPUs 105—software instructions of the EMVAOC system 140 may further be stored on storage 120 (e.g., for loading into memory 130 at a time of execution), but are not separately illustrated in this example. The computing device(s) 190 and EMVAOC system 140 may be implemented using a plurality of hardware components that form electronic circuits suitable for and configured to, when in combined operation, perform at least some of the techniques described herein. In the illustrated embodiment, each computing device 190 includes the one or more hardware CPUs (e.g., microprocessors), storage 120, memory 130, and various input/output ("I/O") components 110, with the illustrated I/O components including a network connection interface 112, a computer-readable media drive 113, optionally a display 111, and other I/O devices 115 (e.g., keyboards, mice or other pointing devices, microphones, speakers, one or more VR headsets and/or glasses with corresponding input controllers, one or more AR headsets and/or glasses with corresponding input controllers, one or more mixed reality headsets and/or glasses with corresponding input controllers, etc.), although in other embodiments at least some such I/O components may not be provided (e.g., if the CPU(s) include one or more microcontrollers). The memory may further include one or more optional other executing software programs 135 (e.g., an engine to provide output to one or more VR and/or AR and/or mixed reality devices and optionally receive corresponding input). The other computing devices 155 and computing systems 185 may include hardware components similar to those of a computing device 190, but with those details being omitted for the sake of brevity.

One or more other powered earth-moving construction vehicles 170-*x* and/or powered earth-moving mining vehicles 175-*x* and/or other earth-moving 180 (e.g., military vehicles, police vehicles, farming vehicles, etc.) may similarly be present (e.g., on the same job site as powered earth-moving vehicle 170-1 or 175-1) and include some or all such components 210-285 and/or 105-149 (although not illustrated here for the sake of brevity) and have corresponding autonomous operations controlled by the EMVAOC system 140 (e.g., with the EMVAOC system operating on a single powered earth-moving vehicle and communicating with the other powered earth-moving vehicles via wireless communications, with the EMVAOC system executing in a distributed manner on some or all of the powered earth-moving vehicles, etc.) or by another embodiment of the EMVAOC system (e.g., with each powered earth-moving vehicle having a separate copy of the EMVAOC system executing on that powered earth-moving vehicle and optionally operating in coordination with each other, etc.). The network 195 may be of one or more types (e.g., the Internet, one or more cellular telephone networks, etc.) and in some cases may be implemented or replaced by direct wireless communications between two or more devices (e.g., via Bluetooth; LoRa, or Long Range Radio; etc.). In addition, while the example of FIG. 1A includes various types of data gathered for a powered earth-moving vehicle and its surrounding environment, other embodiments may similarly gather and use other types of data, whether instead of or in addition to the illustrated types of data, including non-exclusive examples of image data in one or more non-visible light spectrums (e.g., infrared, ultraviolet, radiation, etc.), other energy data (e.g., sound, radiation, etc.), location data of types other than from satellite-based navigation systems, depth or distance data to an object, color data, etc. In addition, in some embodiments and situations, different devices and/or sensors may be used to acquire the same or overlapping types of data (e.g., simultaneously), and the EMVAOC system may combine or otherwise use such different types of data, including to determine differential information for a type of data.

Figure 1B:
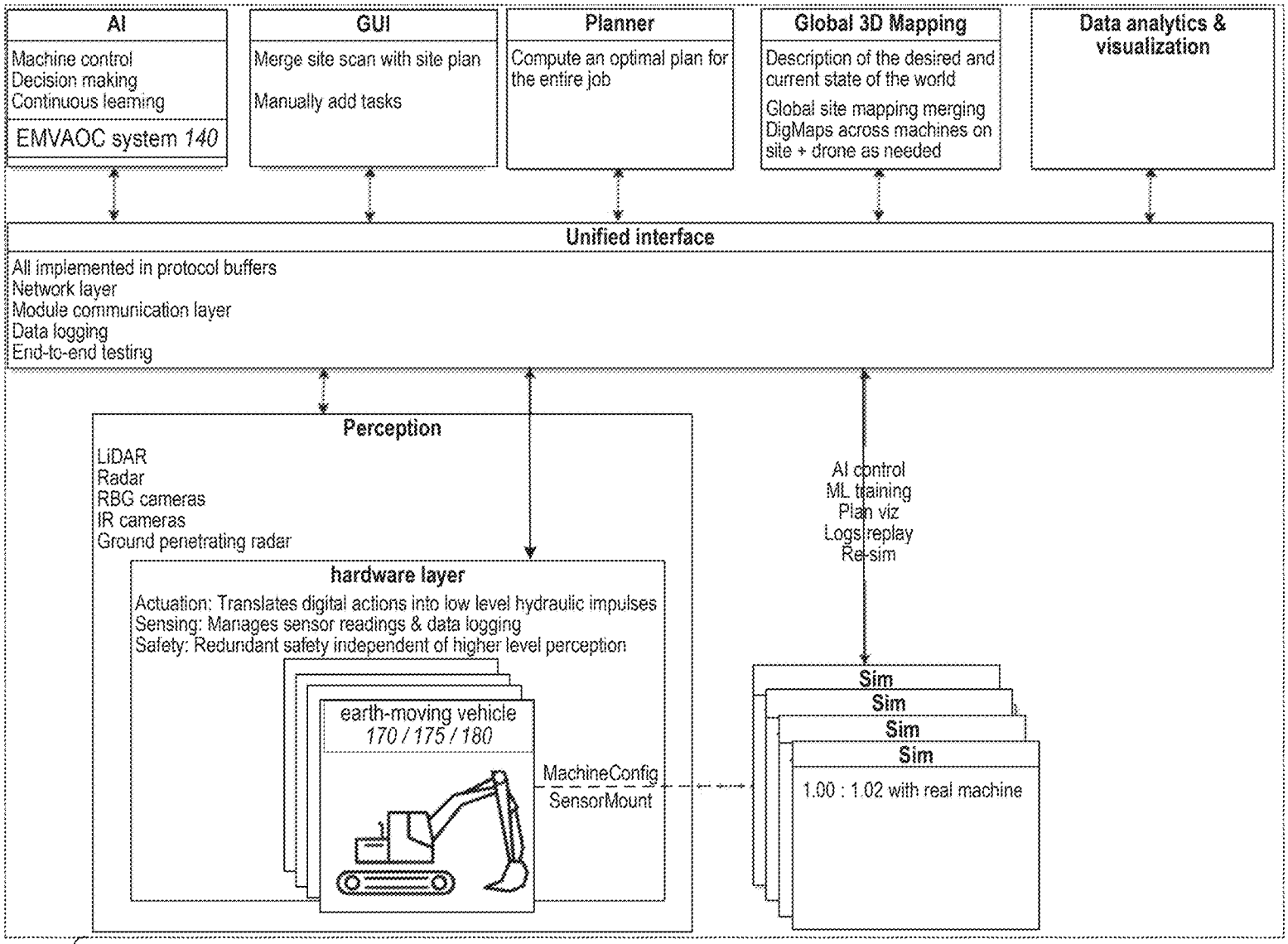
FIG. 1B is a diagram illustrating example components and interactions used to implement autonomous operations of one or more powered earth-moving vehicles on a site.

FIG. 1B illustrates example modules and interactions used to implement autonomous operations of one or more powered earth-moving vehicles on a site, such as to provide an overview of a software and/or hardware architecture used for performing at least some of the described techniques in at least some embodiments. In particular, FIG. 1B illustrates information 191*b* that includes a hardware layer associated with one or more types of powered earth-moving vehicles 170 and/or powered earth-moving mining vehicles 175 and/or powered earth-moving vehicles 180 (e.g., corresponding to components 210-285 of FIG. 1A), such as to receive instructions about controlling autonomous operation of the earth-moving vehicle(s) 170/175/180, and to perform actions that include actuation (e.g., translating digital actions into low-level hydraulic impulses, including in some embodiments to use one or more piston displacement mechanisms located on a powered earth-moving vehicle 170/175/180 and positioned to manipulate one or more controls of the powered earth-moving vehicle when actuated, such as one or more joystick controls, pedal controls, button controls, etc.), sensing (e.g., to manage sensor readings and data logging), safety (e.g., to perform redundant safety independent of higher-level perception operations), etc. In the illustrated example, the hardware layer interacts with or is part of a perception module, such as to use one or more sensor types to obtain data about the earth-moving vehicle(s) and/or their environment (e.g., LiDAR data, radar data, visual data from one or more RGB camera devices, infrared data from one or more IR sensors, ground-penetrating radar data, sound data, etc.). The perception module and/or hardware layer may further interact with a unified interface that connects various modules, such as to operate a network layer and to be implemented in protocol buffers as part of providing a module communication layer, as well as to perform data logging, end-to-end testing, etc. In the illustrated example, the unified interface further interacts with an AI (artificial intelligence) module (e.g., that includes the EMVAOC system 140), a GUI module, a Planner module, a Global 3D Mapping module, one or more Sim simulation modules (e.g., operational data simulator modules that are part of the EMVAOC system 140), and one or more other modules to perform data analytics and visualization. In this example, the AI module provides functionality corresponding to machine control, decision-making, continuous learning, etc. The GUI module perform activities that include providing information of various types to users (e.g., from the EMVAOC system) and manually receiving information (e.g., to be provided to the EMVAOC system, to add tasks to be performed, to merge a site scan with a site plan, etc.). The Planner module performs operations that may include computing an optimal plan for an entire job (e.g., with various tasks to be performed in sequence and/or serially), and the Global 3D Mapping module performs activities that may include providing a description of a current state and/or desired state of an environment around the earth-moving vehicle(s), performing global site mapping merging (e.g., using DigMaps across earth-moving vehicles on the site and optionally drones, such as terrain height and shape), etc. The one or more Sim modules perform simulations to provide data from simulated operation of the one or more earth-moving vehicles, such as for use in AI control, machine learning neural network training (e.g., for one or more behavioral models), replaying logs, planning visualizations, etc. It will be appreciated that the EMVAOC system may be implemented in other architectures and environments in other embodiments, and that the details of FIG. 1B are provided for illustrative purposes. In addition, while not illustrated in FIG. 1B, in some embodiments one or more specialized versions of the EMVAOC system may be used for particular types of powered earth-moving vehicles, with non-exclusive examples including the following: an Excavator Motion/Movement Control (EMC) system to control motion/movement of one or more excavator vehicles; an Excavator X Motion/Movement Control (EMC-X) system to similarly control a particular construction and/or mining excavator X vehicle; a Dump Truck Motion/Movement Control (DTMC) system to control motion/movement of one or more types of construction and/or mining dump truck vehicles; a Dump Truck X Motion/Movement Control (DTMC-X) system to similarly control a particular construction and/or mining dump truck X vehicle; a Wheel Loader Motion/Movement Control (WLMC) system to control motion/movement of one or more types of construction and/or mining wheel loader vehicles; a Wheel Loader X Motion/Movement Control (WLMC-X) system to similarly control a particular construction and/or mining wheel loader X vehicle; one or more other motion/movement control systems specific to particular types of construction and/or mining vehicles other than excavators and dump trucks and wheel loaders; a Construction Vehicle Motion/Movement Control (CVMC) system to control some or all types of powered earth-moving construction vehicles; a Mining Vehicle Motion/Movement Control (MVMC) system to control some or all types of powered earth-moving mining vehicles; etc.

It will be appreciated that computing devices, computing systems and other equipment (e.g., powered earth-moving vehicle(s) included within FIGS. 1A-1B are merely illustrative and are not intended to limit the scope of the present invention. The systems and/or devices may instead each include multiple interacting computing systems or devices, and may be connected to other devices that are not specifically illustrated, including via Bluetooth communication or other direct communication, a mesh network, through one or more networks such as the Internet, via the Web, or via one or more private networks (e.g., mobile communication networks, etc.). More generally, a device or other system may comprise any combination of hardware that may interact and perform the described types of functionality, optionally when programmed or otherwise configured with particular software instructions and/or data structures, including without limitation desktop or other computers (e.g., tablets, slates, etc.), database servers, network storage devices and other network devices, smart phones and other cell phones, consumer electronics, wearable devices, digital music player devices, handheld gaming devices, PDAs, wireless phones, Internet appliances, camera devices and accessories, and various other consumer products that include appropriate communication capabilities. In addition, the functionality provided by the illustrated EMVAOC system 140 may in some embodiments be distributed in various modules, some of the described functionality of the EMVAOC system 140 may not be provided, and/or other additional functionality may be provided.

It will also be appreciated that, while various items are illustrated as being stored in memory or on storage while being used, these items or portions of them may be transferred between memory and other storage devices for purposes of memory management and data integrity. Alternatively, in other embodiments some or all of the software modules and/or systems may execute in memory on another device and communicate with the illustrated computing systems via inter-computer communication. Thus, in some embodiments, some or all of the described techniques may be performed by hardware means that include one or more processors and/or memory and/or storage when configured by one or more software programs (e.g., by the EMVAOC system 140 executing on computing device(s) 190) and/or data structures (e.g., in databases 121-129, 132 and 134), such as by execution of software instructions of the one or more software programs and/or by storage of such software instructions and/or data structures, and such as to perform algorithms as described in the flow charts and other disclosure herein. Furthermore, in some embodiments, some or all of the systems and/or modules may be implemented or provided in other manners, such as by consisting of one or more means that are implemented partially or fully in firmware and/or hardware (e.g., rather than as a means implemented in whole or in part by software instructions that configure a particular CPU or other processor), including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the modules, systems and data structures may also be stored (e.g., as software instructions or structured data) on a non-transitory computer-readable storage mediums, such as a hard disk or flash drive or other non-volatile storage device, volatile or non-volatile memory (e.g., RAM or flash RAM), a network storage device, or a portable media article (e.g., a DVD disk, a CD disk, an optical disk, a flash memory device, etc.) to be read by an appropriate drive or via an appropriate connection. The systems, modules and data structures may also in some embodiments be transmitted via generated data signals (e.g., as part of a carrier wave or other analog or digital propagated signal) on a variety of computer-readable transmission mediums, including wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of the present disclosure may be practiced with other computer system configurations.

As noted above, in at least some embodiments, data may be obtained and used by the EMVAOC system from sensors of multiple types that are positioned on or near one or more powered earth-moving vehicles, such as one or more of the following: GPS data or other location data; inclinometer data or other position data for particular movable parts of an earth-moving vehicle (e.g., a digging arm/tool attachment of an earth-moving vehicle); real-time kinematic (RTK) positioning information based on GPS data and/or other positioning data that is corrected using RTK-based GPS correction data transmitted via signals from a base station (e.g., at a location remote from the site at which the vehicle is located); track and cabin heading data; visual data of captured image(s) using visible light; depth data from depth-sensing and proximity devices such as LiDAR (e.g., depth and position data for points visible from the LiDAR sensors, such as three-dimensional, or "3D", points corresponding to surfaces of terrain and objects) and/or other than LiDAR (e.g., ground-penetrating radar, above-ground radar, other laser rangefinding techniques, synthetic aperture radar or other types of radar, sonar, structured light, etc.); infrared data from infrared sensors; material type data for loads and/or a surrounding environment from material analysis sensors; load weight data from pressure sensors; etc. As one non-exclusive example, the described systems and techniques may in some embodiments include obtaining and integrating data from sensors of multiple types positioned on a powered earth-moving vehicle at a site, and using the data to determine and control operations of the vehicle to accomplish one or more defined tasks at the site (e.g., dig a hole of a specified size and/or shape and/or at a specified location, move one or more rocks from a specified area, extract a specified amount of one or more materials, remove hazardous or toxic material from above ground and/or underground, perform trenching, perform demining, perform breaching, etc.), including determining current location and positioning of the vehicle on the site, determining and implementing movement around the site, determining and implementing operations involving use of the vehicle's tool attachment(s) and/or arms (e.g., hydraulic arms), etc. Such powered earth-moving construction vehicles (e.g., one or more tracked or wheeled excavators, bulldozers, tracked or wheeled skid loaders or other loaders such as front loaders and backhoe loaders, graders, cranes, compactors, conveyors, dump trucks or other trucks, deep sea construction machinery, extra-terrestrial construction machinery, etc.) and powered earth-moving mining vehicles (e.g., one or more tracked or wheeled excavators, bulldozers, tracked or wheeled skid loaders and other loaders such as front loaders and backhoe loaders, scrapers, graders, cranes, trenchers, dump trucks or other trucks, deep sea mining machinery, extra-terrestrial mining machinery, etc.) are referred to generally as 'earth-moving vehicles' herein, and while some illustrative examples are discussed below with respect to controlling one or more particular types of vehicles (e.g., excavator vehicles, wheel loaders or other loader vehicles, dump truck or other truck vehicles, etc.), it will be appreciated that the same or similar techniques may be used to control one or more other types of powered earth-moving vehicles (e.g., vehicles used by military and/or police for operations such as breaching, demining, etc., including demining plows, breaching vehicles, etc.). With respect to sensor types, one or more types of GPS antennas and associated components may be used to determine and provide GPS data in at least some embodiments, with one non-exclusive example being a Taoglas MagmaX2 AA.175 GPS antenna. In addition, one or more types of LiDAR devices may be used in at least some embodiments to determine and provide depth data about an environment around an earth-moving vehicle (e.g., to determine a 3D, or three-dimensional, model of some or all of a job site on which the vehicle is situated), with non-exclusive examples including LiDAR sensors of one or more types from Livox Tech. (e.g., Mid-70, Avia, Horizon, Tele-15, Mid-40, Mid-100, HAP, etc.) and with corresponding data optionally stored using Livox's LVX point cloud file format v1.1, LiDAR sensors of one or more types from Ouster Inc. (e.g., OS0 and/or OS1 and/or OS2 sensors), etc.—in some embodiments, other types of depth-sensing and/or 3D modeling techniques may be used, whether in addition to or instead of LiDAR, such as using other laser rangefinding techniques, synthetic aperture radar or other types of radar, sonar, image-based analyses (e.g., SLAM, SfM, etc.), structured light, etc. Furthermore, one or more proximity sensor devices may be used to determine and provide short-distance proximity data in at least some embodiments, with one non-exclusive example being an LJ12A3-4-Z/BX inductive proximity sensor from ETT Co., Ltd. Moreover, real-time kinematic positioning information may be determined from a combination of GPS data and other positioning data, with one non-exclusive example including use of a u-blox ZED-F9P multi-band GNSS (global navigation satellite system) RTK positioning component that receives and uses GPS, GLONASS, Galileo and BeiDou data, such as in combination with an inertial navigation system (with one non-exclusive example including use of MINS300 by BW Sensing) and/or a radio that receives RTK correction data (e.g., a Digi XBee SX 868 RF module, Digi XBee SX 900 RF module, etc.). Other hardware components that may be positioned on or near an earth-moving vehicle and used to provide data and/or functionality used by the EMVAOC system include the following: one or more inclinometers (e.g., single axis and/or double axis) or other accelerometers (with one non-exclusive example including use of an inclination sensor by DIS sensors, such as the QG76 series); a CAN bus message transceiver (e.g., a TCAN 334 transceiver with CAN flexible data rate); one or more low-power microcontrollers (e.g., an i.MX RT1060 Arm-based Crossover MCU microprocessor from NXP Semiconductors; an ARM Cortex-M7 at 600 MHz, whether operating on its own or present on a PJRC Teensy 4.1 Development Board; a Grove 12-bit Magnetic Rotary Position Sensor AS5600, etc.) or other hardware processors, such as to execute and use executable software instructions and associated data of the EMVAOC system; one or more voltage converters and/or regulators (e.g., an ST LT1576 or LD1117 or LM217 or LM317 adjustable voltage regulator, etc.); a voltage level shifter (e.g., using a field effect transistor, such as a Fairchild Semiconductor BSS138 N-Channel Logic Level Enhancement Mode Field Effect Transistor); etc. In addition, in at least some embodiments and situations, one or more types of data from one or more sensors positioned on an earth-moving vehicle may be combined with one or more types of data (whether the same types of data and/or other types of data) acquired from one or more positions remote from the earth-moving vehicle (e.g., from an overhead location, such as from a drone aircraft, an airplane, a satellite, etc.; elsewhere on a site on which the earth-moving vehicle is located, such as at a fixed location and/or on another earth-moving vehicle of the same or different type; etc.), with the combination of data used in one or more types of autonomous operations as discussed herein. Additional details are included below regarding positioning of data sensors and use of corresponding data, including with respect to the examples of FIGS. 2A-2S.

As part of performing the described techniques, the EMVAOC system may in some embodiments obtain and integrate data from sensors of multiple types positioned on a powered earth-moving vehicle at a site, and use the data to determine and control motion of the powered earth-moving vehicle on the site, such as by determining current location and positioning of the powered earth-moving vehicle and its moveable component parts on the site, determining a target destination location and/or route (or 'path') of the powered earth-moving vehicle on the site, identifying and classifying objects and other obstacles (e.g., man-made structures, rocks and other naturally occurring impediments, other equipment, people or animals, non-level terrain, etc.) along one or more possible paths (e.g., multiple alternative paths between current and destination locations), implementing actions to address any such obstacles (e.g., move, avoid, pass over, etc.), and performing balancing-related and slippage-related operations as needed during vehicle motion on non-level surfaces. In addition, in at least some embodiments, the described systems and techniques are further used to implement coordinated actions of multiple powered earth-moving vehicles of one or more types (e.g., one or more excavator vehicles, bulldozer vehicles, front loader vehicles, grader vehicles, plowing vehicles (e.g., snow plows, dirt plows, tractors with plow attachments, etc.), loader vehicles, crane vehicles, backhoe vehicles, compactor vehicles, conveyor vehicles, dump trucks or other truck vehicles, etc.).

The described techniques may further include using the data from one or more types of sensors on a powered earth-moving vehicle to map at least some of an environment around the vehicle, including to determine slopes and other non-level surfaces and more generally surface heights and shapes (e.g., to create a grid of cells covering the surface(s) to be mapped, such as with each cell being sized 20 cm by 20 cm or another defined size, and to determine surface height, shape, slope, etc. for each such cell), as well as to detect other obstacles in an area around the vehicle (e.g., in at least an area reachable by a tool attachment and/or other parts of the vehicle), and to optionally further classify the obstacles with respect to multiple defined obstacle types (e.g., having different specified safety configurations). Such data may include, for example, LiDAR data from one or more LiDAR sensors of one or more LiDAR components positioned on the vehicle, and/or image data from one or more camera devices with image sensors positioned on the vehicle, and/or infrared data from one or more infrared sensors positioned on the vehicle, and/or material type data from one or more material type sensors positioned on the vehicle, etc., and with some or all of the sensors optionally mounted on moveable portions of the vehicle (e.g., a hydraulic arm, a tool attachment, etc.) to enable movement of those sensors (e.g., separate from motion of the vehicle) to different positions to obtain additional data readings. The data related to such obstacles may be used to determine positions in 3D space around the vehicle that are prohibited in accordance with the specified safety configuration data or that otherwise trigger safety-related actions, including slopes or other non-level surfaces that exceed defined thresholds, although at least some obstacles may not be included in the prohibited 3D positions (e.g., obstacles that are to be moved as part of one or more tasks, such as rocks or other material that are within the movement capacity of the vehicle's tool attachment; non-level portions of the terrain that are not flat but do not exceed safety parameters for the vehicle to drive over; other obstacles that the vehicle or its parts may move over or through, such as sparse vegetation or water; etc.)—in at least some embodiments, each cell of a grid covering an area around some or all of a vehicle will have one or more 3D data points (e.g., of a generated 3D point cloud) that are used to determine the data for that cell.

The vehicle may further use additional sensors on some or all moveable parts of the vehicle to determine positions of those parts, including relative to other parts of the vehicle. As one non-exclusive example, a first hydraulic arm attached to a body of the vehicle (e.g., a hydraulic 'boom' arm of an excavator vehicle) may include at least one inclinometer sensor that measures an angle of that first hydraulic arm relative to the body, a second hydraulic arm (if any) attached to the first hydraulic arm (e.g., a hydraulic 'stick' arm of an excavator vehicle attached to a hydraulic boom arm) may include at least one additional inclinometer sensor that measures an angle of that second hydraulic arm relative to the first hydraulic arm, a tool attachment connected to one of the hydraulic arms (e.g., a bucket tool of an excavator vehicle connected to the hydraulic stick arm) may include at least one additional inclinometer sensor that measures an angle of that tool attachment relative to that hydraulic arm to which it is connected, etc.—a combination of the angles for such hydraulic arm(s) and tool attachment may then be used to determine positions in 3D space of those components relative to a connection point to the vehicle body. In addition, a cabin or other portion of the body may include one or more sensors to provide relative or absolute location and/or direction information (e.g., one or more GPS receivers, such as multiple GPS receivers at known locations on the body to in combination provide directional information for the body; one or more INS-DU (inertial navigation system-dual antenna) sensors that combine GPS data with compass data and other IMU data such as acceleration and angular velocity; etc.), and tracks or wheels of the vehicle may include one or more directional sensors to determine a direction of the tracks/wheels (whether an absolute direction and/or a direction relative to the body if the body is rotatable), with the relative directions of the tracks/wheels able to be used to determine positions in 3D space of those components relative to the vehicle body—if the sensors on the vehicle are able to determine an absolute position of the vehicle body, the positions of the vehicle parts may further be determined in absolute coordinates, such as by using GPS coordinates from one or more GPS antennas mounted on the body, optionally after being corrected using real-time kinematic (RTK)-based GPS correction data transmitted via signals from a base station (e.g., at a location remote from the site at which the vehicle is located), and/or by using LiDAR and/or visual data to determine a position of the vehicle within a job site with known locations. The positions of the vehicle parts may be represented in various manners in various embodiments (e.g., in XYZ coordinates, whether absolute or relative to a position of the vehicle body; in angle-based coordinates, such as to represent the position of an excavator vehicle's tool attachment using the first angle for the hydraulic boom arm and the second angle for the hydraulic stick arm and the third angle for the tool attachment; etc.)—the positions of the obstacles around the vehicle and/or the prohibited 3D positions may similarly be represented in the same format as used for the vehicle parts (e.g., in angle-based coordinates relative to the same point on the vehicle's body as for moveable parts of the vehicle whose positions use such angle-based coordinates), or instead different position formats may be used for vehicle parts and prohibited 3D positions/obstacle locations, with a conversion determined between formats during use of the vehicle part position information and the information about the prohibited 3D positions/obstacle locations.

As noted above, the automated operations of the EMVAOC system may include automatically planning vehicle motion between two or more locations (e.g., between starting and ending locations on a site) and/or vehicle attachment movements while the vehicle is stationary and/or in motion. In some embodiments, the EMVAOC system may include one or more planner modules, and at least one such planner module may perform such planning operations for one or more vehicle parts, such as to determine a 3D movement/motion plan that includes a sequence of 3D positions for a vehicle's tool attachment to perform one or more tasks while avoiding prohibited 3D positions and otherwise preventing violations of safety configuration data, optionally while the vehicle moves on a path between multiple locations (e.g., in accordance with other goals or planning operations being performed by the EMVAOC system, such as based on an overall analysis of a site and/or as part of accomplishing a group of multiple activities at the site). In particular, the EMVAOC system may implement autonomous control of motion of the vehicle and movements of its parts to prevent intersection with prohibited 3D positions corresponding to the obstacles and optionally additionally corresponding to positions of parts of the vehicle that can be reached by other moveable parts of the vehicle (e.g., for an excavator vehicle's tracks and/or body that can be reached by the vehicle's tool attachment), whether during planning and implementing fully autonomous operations for the vehicle, and/or for motion/movements initiated in part or in whole by a human operator of the vehicle. These techniques may be further extended for motion of the vehicle between different locations on a job site, such as when moving to a destination location at which one or more tasks will be performed, while moving between locations as part of implementing one or more tasks (e.g., carrying or otherwise moving material between two locations), etc.—as part of doing so, the locations of obstacles along the vehicle motion path(s) may be similarly determined and used to identify prohibited 3D positions along the path(s) that are reachable by the vehicle parts, and movement of the vehicle parts may be similarly monitored and controlled to avoid those prohibited 3D positions not only at the initial and destination locations but also along the path(s), as well as to implement other vehicle part positioning in accordance with specified safety configuration data (e.g., to maintain balance of the vehicle, to prevent positions of vehicle parts that cause damage to the vehicle, etc.). Additional details are included below related to automatically controlling motion of a powered earth-moving vehicle on a job site and movement of vehicle parts to conform with specified safety rules or other specified safety configuration data.

As is also noted above, automated operations of an EMVAOC system may include determining current location and other positioning of a powered earth-moving vehicle on a site in at least some embodiments. As one non-exclusive example, such position determination may include using one or more track sensors to monitor whether or not a vehicle's tracks are aligned in the same direction as the vehicle's cabin or other parts of the body, and using GPS data (e.g., from 3 GPS antennas located on the vehicle's cabin or other parts of the body, such as in a manner similar to that described with respect to FIGS. 2A-2L) optionally in conjunction with an inertial navigation system to determine the rotation of the cabin or other parts of the body (e.g., relative to true north). When using data from multiple GPS antennas, the data may be integrated in various manners, such as by using a microcontroller located on the powered earth-moving vehicle, and with additional RTK (real-time kinetic) positioning data optionally used to reinforce and provide further precision with respect to the GPS-based location (e.g., to achieve 1-inch precision or better). In addition, in some embodiments and situations, LiDAR data is used to assist in position determination operations, such as by surveying the surrounding environment around the powered earth-moving vehicle (e.g., some or all of a job site on which the powered earth-moving vehicle is located, such as terrain of the job site and objects on the job site) and confirming a current location of the powered earth-moving vehicle in two-dimensional ("2D") and/or three-dimensional ("3D") space, whether an absolute location (e.g., using GPS locations) and/or a relative location (e.g., using the vehicle or other element as a center point relative to which other points are mapped), and in some cases relative to a 2D and/or 3D map of the job site generated from the LiDAR data and/or from analysis of visual data of images (e.g., a 3D point cloud having a plurality of data points each with an associated position in 3D space and representing a point on a surface, such as the ground or other terrain, an obstacle or other object above the ground, etc.; other types of 3D representations, such as meshes, planar surfaces or other types of surfaces, parametric models, depth-maps, RGB-D, voxels, etc.; 2D point clouds and/or other 2D representations; etc.). Additional details are included below regarding such automated operations to determine current location and other positioning of a powered earth-moving vehicle on a site.

In addition, automated operations of an EMVAOC system may further include determining a target destination location and/or path of a powered earth-moving vehicle on a job site or other geographical area. For example, one or more planner modules of the EMVAOC system determines a current target destination location and/or path of a powered earth-moving vehicle (e.g., in accordance with other goals or planning operations being performed by the EMVAOC system, such as based on an overall analysis of a site and/or as part of accomplishing a group of multiple activities at the site). In addition, the motion of the powered earth-moving vehicle from a current location to a target destination location or otherwise along a determined path may be initiated in various manners, such as by an operator module of the EMVAOC system that acts in coordination with the one or more planner modules (e.g., based on a planner module providing instructions to the operator module about current work to be performed, such as work for a current day that involves the powered earth-moving vehicle leaving a current work area and moving to a new area to work), or directly by a planner module (e.g., to move to a new location along a track to perform terrain leveling and/or to prepare for digging). In other embodiments, determination of a target destination location and/or path and initiation of powered earth-moving vehicle motion may be performed in other manners, such as in part or in whole based on input received from one or more human users or other sources. Additional details are included below regarding such automated operations to determine a target destination location and/or path of a powered earth-moving vehicle on a site.

Automated operations of an EMVAOC system may further in at least some embodiments include identifying and classifying obstacles (if any) along one or more paths between current and destination locations, and implementing actions to address any such obstacles. For example, LiDAR data (or other depth-sensing data) and/or visual data may be analyzed to identify objects that are possible obstacles and as part of classifying a type of each obstacle, and other types of data (e.g., infrared, material type, sound, etc.) may be further used as part of classifying an obstacle type (e.g., to determine whether an obstacle is a human or animal, such as based at least in part by having a temperature above at least one first temperature threshold, whether an absolute temperature threshold or a temperature threshold relative to a temperature of a surrounding environment; whether an obstacle is a running vehicle, such as based at least in part by having a temperature above at least one second temperature threshold, whether an absolute temperature threshold or a temperature threshold relative to a temperature of a surrounding environment, and/or based on sounds being emitted; to estimate weight and/or other properties based at least in part on one or more types of material of the obstacle; etc.), and in some embodiments and situations by using one or more trained machine learning models (e.g., using a point cloud analysis routine for object classification) or via other types of analysis (e.g., image analysis techniques). As one non-exclusive example, each obstacle may be classified on a scale from 1 (easy to remove) to 10 (not passable), including to consider factors such as whether an obstacle is a human or other animal, is another vehicle that can be moved (e.g., using coordinated autonomous operation of the other vehicle), is infrastructure (e.g., cables, plumbing, etc.), based on obstacle size (e.g., using one or more size thresholds) and/or obstacle material (e.g., is water, oil, soil, rock, etc.) and/or other obstacle attribute, etc., as discussed further below. In particular, one non-exclusive example of classifying objects includes an example classification system as follows: class 1, a small object that a powered earth-moving vehicle can move over without taking any avoidance action; class 2, a small object that is removeable (e.g., within the moving capabilities of a particular type of powered earth-moving vehicle and/or of any of the possible powered earth-moving vehicles, optionally within a defined amount of time and/or other defined limits such as weight and/or size and/or material type, such as to have a size that fits within a bucket attachment of the vehicle or is graspable by a grappling attachment of the vehicle, and/or to be of a weight and/or material type and/or density and/or moisture content within the operational limits of the vehicle) moving a large pile of dirt (requiring numerous scoops/pushes) and/or creating a path (e.g., digging a path through a hill, filling a ravine, etc.) and/or for which the vehicle can move over without taking any avoidance action; class 3, a small object that is removeable but for which the vehicle cannot safely move over within defined limits without taking any avoidance action; class 4, a small-to-medium object that is removeable but may not be possible to do so within defined time limits and/or other limits and for which avoidance actions are available; class 5, a medium object that is not removeable within defined time limits and/or other limits and for which avoidance actions are available; class 6, a large object that is not removeable within defined time limits and/or other limits and for which avoidance actions are available; class 7, an object that is sufficiently large and/or structurally in place to not be removeable within defined time limits and/or other limits and for which avoidance actions are not available within defined time limits and/or other limits; classes 8-10 being small animals, humans, and large animals, respectively, which cause movement of the vehicle to be inhibited (e.g., to shut the vehicle down) to prevent damage (e.g., even if within the capabilities of the vehicles to remove and/or avoid the obstacle); etc. A similar system of classifying non-object obstacles (e.g., non-level terrain surfaces) may be used, such as to correspond to possible activities of a powered earth-moving vehicle in moving and/or avoiding the obstacle (e.g., leveling a pile or other projection of material, filling a cavity, reducing the slope e.g., incline or decline, etc.) including in some embodiments and situations to consider factors such as steepness of non-level surfaces, traction, types of surfaces to avoid (e.g., any water, any ice, water and/or ice for a cavity having a depth above a defined depth threshold, empty ditches or ravines or other cavities above a defined cavity size threshold; etc.).

Such classifying of obstacles may further be used as part of determining a path between a current location and a target destination location, such as to select or otherwise determine one or more of multiple alternative paths to use if one or more obstacles are of a sufficiently high classified type (e.g., not capable of being moved by the earth-moving vehicle, such as at all or within a defined amount of time and/or other defined limits, as such as being of class 7 of 10 or higher) are present along what would otherwise be at least one possible path (e.g., a direct path between the current location and the target destination location). For example, depending on information about an obstacle (e.g., a type, distance, shape, depth, material type, etc.), the automated operations of the EMVAOC system may determine to, as part of the autonomous operations of the powered earth-moving vehicle, perform at least one of (1) removing the obstacle from a path and moving along that path to the target destination location, or (2) moving in an optimized path around the obstacle to the target destination location, or (3) inhibiting motion of the powered earth-moving vehicle, and in some cases, to instead initiate autonomous operations of a separate second powered earth-moving vehicle to move to the target destination location as a replacement vehicle and/or to initiate a request for human intervention. Additional details are included below regarding such automated operations to classify obstacles and to use such information as part of path determination and corresponding powered earth-moving vehicle actions.

In addition, while the autonomous operations of a powered earth-moving vehicle controlled by the EMVAOC system may in some embodiments be fully autonomous and performed without any input or intervention of any human users (e.g., fully implemented by an embodiment of the EMVAOC system executing on that powered earth-moving vehicle without receiving human input and without receiving external signals other than possibly one or more of GPS signals and RTK correction signals), in other embodiments the autonomous operations of a powered earth-moving vehicle controlled by the EMVAOC system may include providing information to one or more human users about the operations of the EMVAOC system and optionally receiving information from one or more such human users (whether on-site or remote from the site) that are used as part of the automated operations of the EMVAOC system (e.g., a target destination location, a high-level work plan, etc.), such as via one or more GUIs ("graphical user interfaces") displayed on one or more computing device that provide user-selectable controls and other options to allow a user to interactively request or specify types of information to display and/or to interactively provide information for use by the EMVAOC system.

FIGS. 2A-2L illustrate examples of earth-moving vehicles and types of on-vehicle data sensors positioned to support autonomous operations on a site.

Figure 2A:
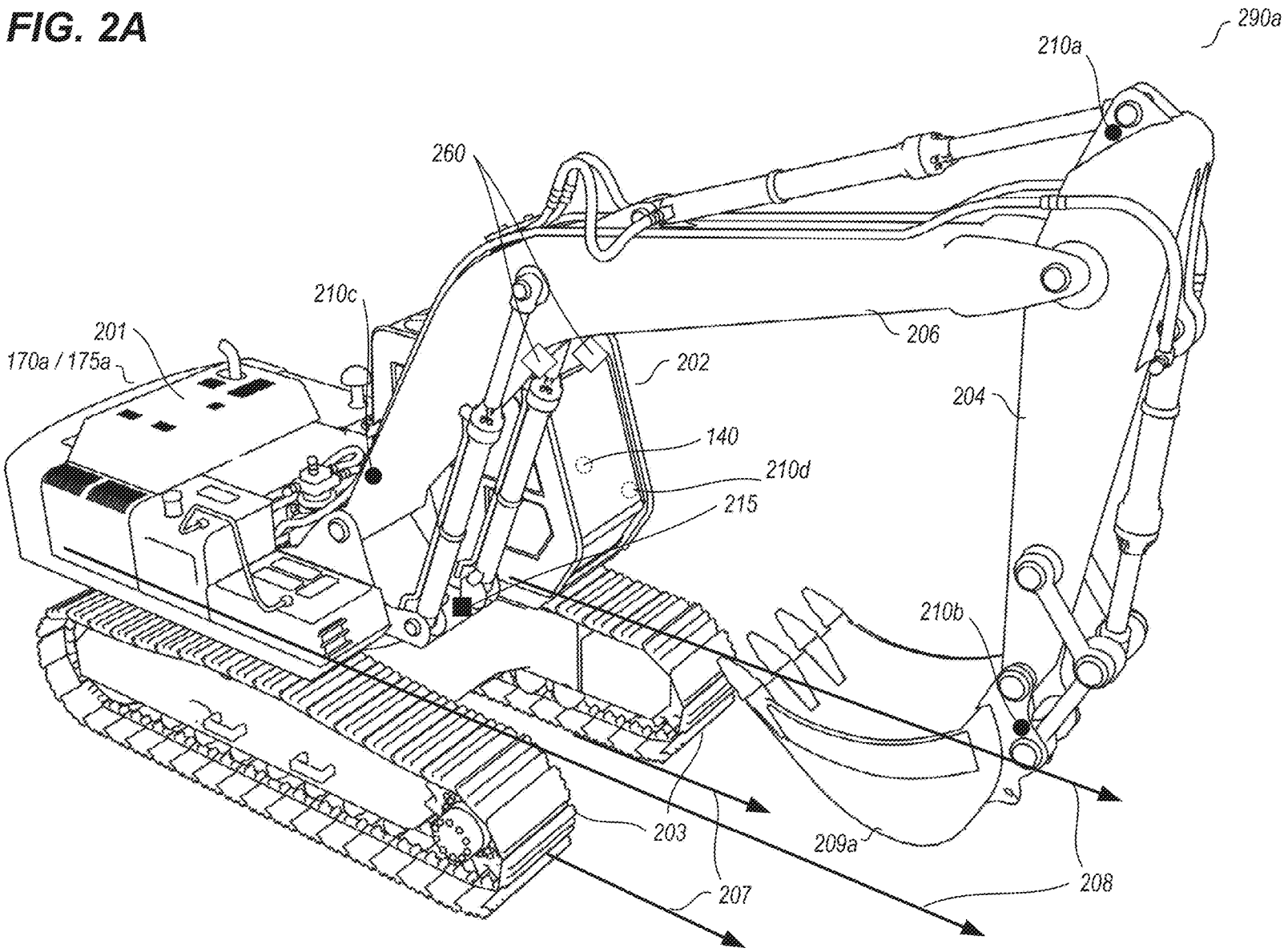
FIGS. 2A-2L illustrate examples of powered earth-moving construction and/or mining vehicles having an on-vehicle autonomous operations control system and multiple types of on-vehicle data sensors positioned to support autonomous operations on a site.

In particular, with respect to FIG. 2A, information 290*a* about an example powered earth-moving construction vehicle 170*a* and/or mining vehicle 175*a* is illustrated, which in this example is a tracked excavator vehicle, using an upper-side-frontal view from the side of the digging boom arm (or 'boom') 206 and stick arm (or 'stick') 204 and opposite the side of the cabin 202, with the earth-moving vehicle 170*a*/175*a* further having a main body 201 (e.g., enclosing an counterweight 221 and engine, and including the cabin 202) over an underlying chassis, tracks 203 and bucket (or 'scoop' or 'claw') tool attachment 209*a*—in other embodiments, other types of digging arm tool attachments may be used such as, for example, a hydraulic thumb, coupler, breaker, compactor, digging bucket, grading bucket, hammer, demolition grapple, tiltrotator, etc. Four example inclinometers 210 are further illustrated at positions that beneficially provide inclinometer data to compute the position of the bucket and other parts of the digging arms relative to the position of the cabin of the earth-moving vehicle. In this example, three inclinometers 210*a*-210*c* are mounted at respective positions on the digging arms of the earth-moving vehicle (position 210*c* near the intersection of the digging boom arm and the body of the earth-moving vehicle, position 210*b* near the intersection of the digging stick arm and the bucket attachment, and position 210*a* near the intersection of the digging boom and stick arms), such as to use single-axis inclinometers in this example, and with a fourth inclinometer 210*d* mounted within the cabin of the earth-moving vehicle and illustrated at an approximate position using a dashed line, such as to use a dual-axis inclinometer that measures pitch and roll angles-data from the inclinometers may be used, for example, to track the position of the earth-moving vehicle arms/attachment, including when a track heading direction 207 is determined to be different (not shown in this example) from a cabin/body heading direction 208. This example illustrates a position of one or more pressure sensors 215, which in this example are positioned along one or more pressure pipes (not shown) connected to the bottom of one or more pistons (or 'cylinders') configured to raise and lower the digging boom arm 206. This example further illustrates a position of each of one or more LiDAR components 260, which in this example includes a LiDAR component positioned on the underside of the digging boom arm 206 near its bend in the middle (and as such is movable along with the movements of the digging boon arm 206) and/or a LiDAR component positioned on a front upper portion of the vehicle cabin, including in some embodiments to be independently movable (e.g., to rotate, tilt, swivel, etc.) on the portion of the vehicle on which it is mounted or otherwise located—in other embodiments, one or more LiDAR components 260 may be located on other positions on the vehicle 170*a*/175*a*, including to be one of multiple LiDAR components positioned at different locations on the vehicle. The vehicle may further have one or more INS-DU or other IMU units, which are not shown in this example. It will be appreciated that other quantities, positionings and types of illustrated sensors/components may be used in other embodiments.

Figure 2B:
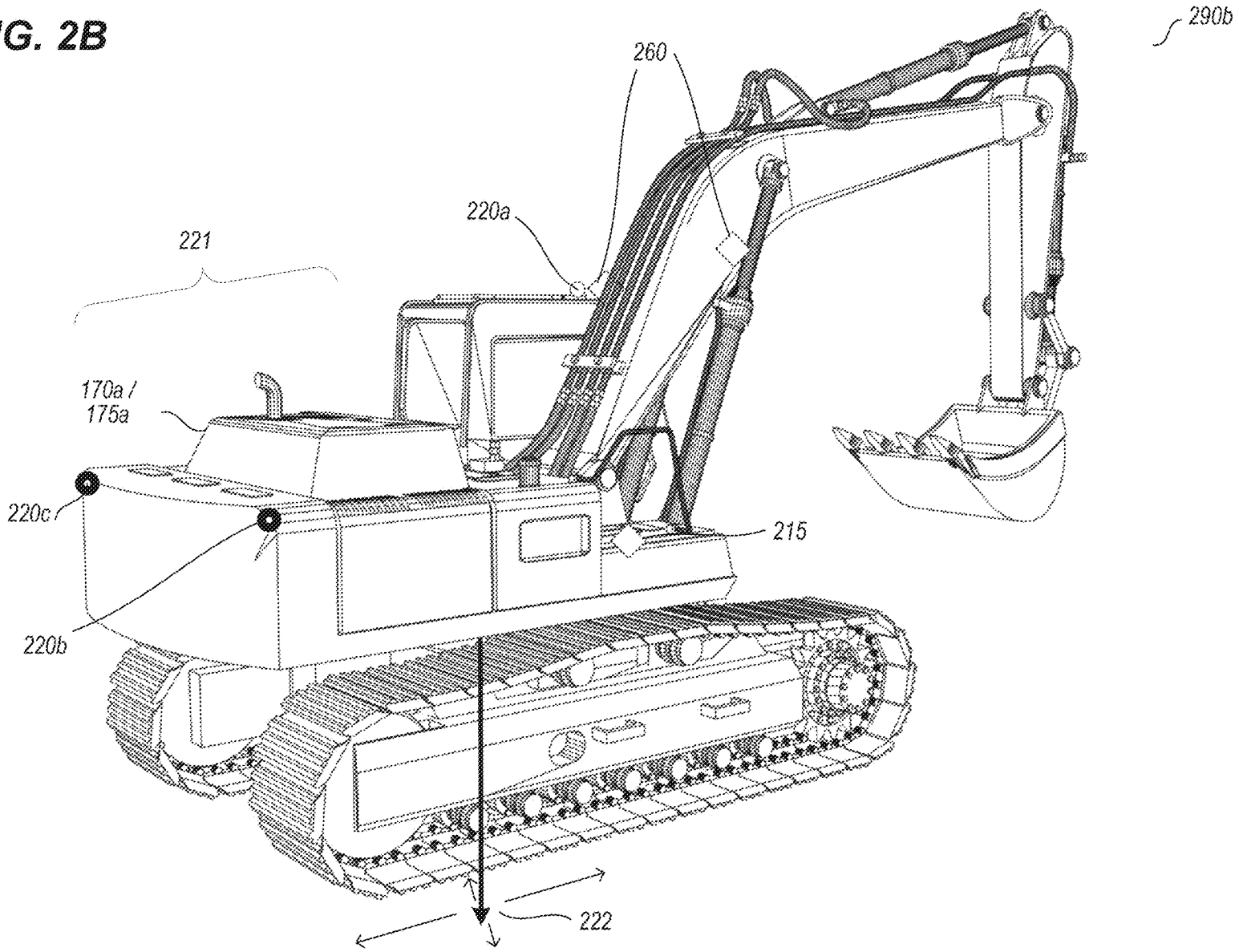
Figure 2C:
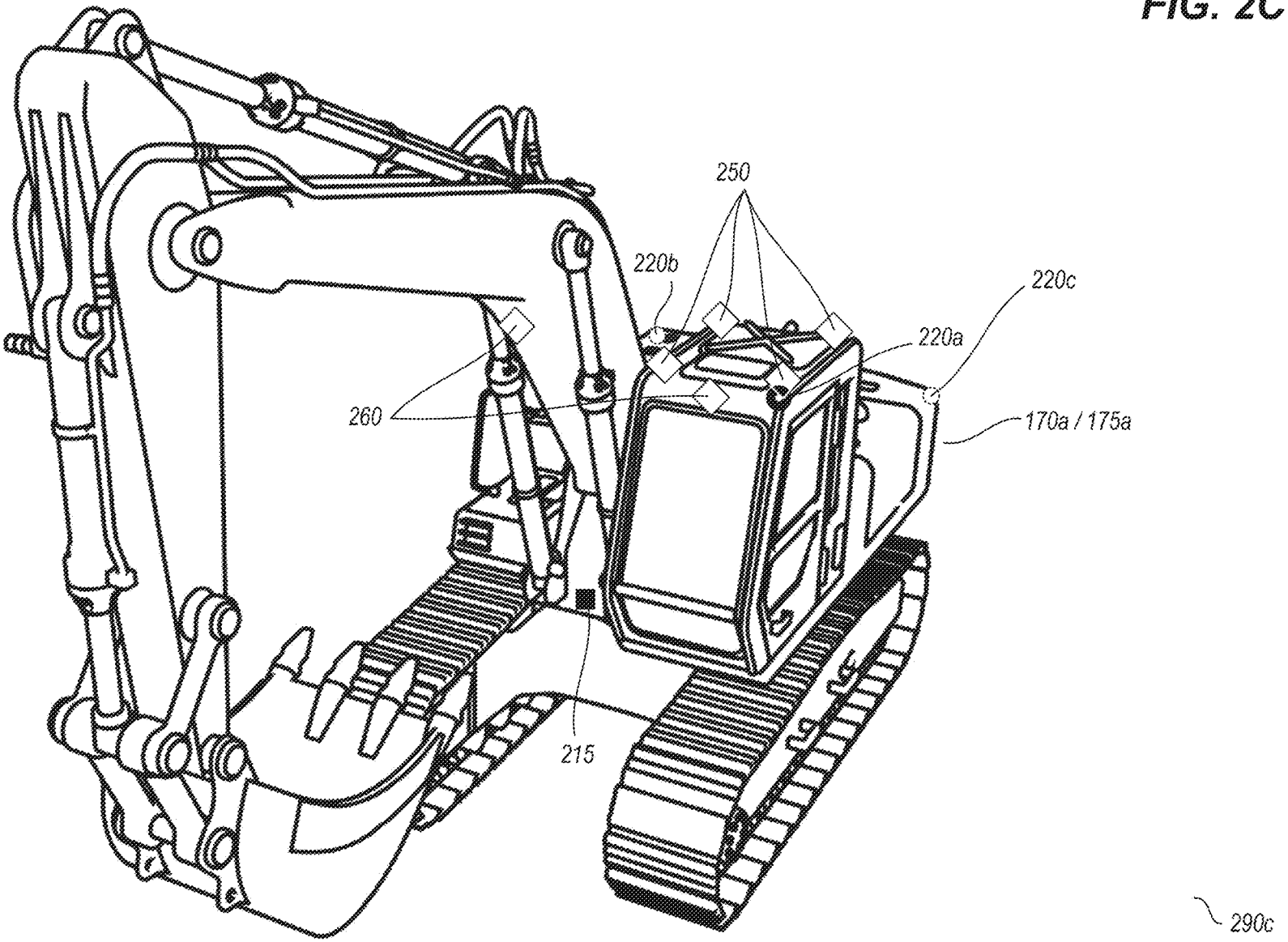

FIGS. 2B and 2C continue the example of FIG. 2A, and illustrate information 290*b* and 290*c*, respectively, about three example GPS antennas 220 at positions that beneficially provide GPS data to assist in determining the positioning and direction of the cabin/body of the earth-moving vehicle 170*a*/175*a*, including to use data from the three GPS antennas to provide greater precision than is available from a single GPS antenna. In this example, the three GPS antennas 220*a*-220*c* are positioned on the earth-moving vehicle body and proximate to three corners of the body (e.g., as far apart from each other as possible), such that differential information between GPS antennas 220*a* and 220*c* may provide cabin heading direction information, and differential information between GPS antennas 220*b* and 220*c* may provide lateral direction information at approximately 90° from that cabin heading direction information. In particular, in FIG. 2B, the example earth-moving vehicle is shown using a side-rear view from the side of the arms, with GPS antennas 220*b* and 220*c* illustrated on the back of the body at or below the top of that portion of the body, and with an approximate position of GPS antenna 220*a* on the cabin top near the front illustrated with dashed lines (e.g., as illustrated further in FIG. 2C). FIG. 2B further illustrates the counterweight 221 at the back of the body, and illustrates a center of gravity 222 of the vehicle that moves forward and backward as the arms and attachment are moved while the cabin/chassis is aligned with the tracks, and may move in other directions as the cabin/chassis rotates and/or as the arms and attachment are moved while the cabin/chassis is not aligned with the tracks (not shown). In FIG. 2C, the example earth-moving vehicle is shown using an upper-side-frontal view from the side of the cabin, with GPS antenna 220*a* shown on the cabin top near the front on the same side as GPS antenna 220*c*, and with the positions of GPS antennas 220*b* and 220*c* illustrated through the body with dashed lines (e.g., just below the top of the back of the body, as illustrated in FIG. 2B). While not illustrated in FIGS. 2B-2C, some or all of the GPS antennas may be enabled to receive and use RTK data to further improve the accuracy of the GPS signals that are produced, such as by each being part of or otherwise associated with a GPS receiver including an RTK radio that receives and uses RTK-based GPS correction data transmitted from a base station (e.g., at a location remote from the site at which the earth-moving vehicle is located) to improve accuracy of the GPS signals from the GPS antennas, so as to be part of one or more RTK-enabled GPS positioning units. The LiDAR component(s) 260 and pressure sensor 215 are also illustrated, using dashed lines in FIG. 2B to indicate the location on the underside of the digging boom arm and/or upper front of the cabin (for the one or more LiDAR components) and bottom of the piston(s) (for the one or more pressure sensors) due to the boom arm blocking a direct view of the component 260, and being directly visible in FIG. 2C. FIG. 2C also illustrates possible locations of one or more RGB cameras 250 with image sensors (not shown separately) that gather additional visual data about an environment of the vehicle 170*a*/175*a* from visible light—in this example, four cameras are used on top of the cabin (e.g., to in the aggregate provide visual coverage of some or all of 360° horizontally), with two on each side, and optionally with the two front camera facing partially or fully forwards and the two back cameras facing partially or fully backwards, although in other embodiments other camera configurations and/or types may be used (e.g., one or more cameras with panoramic view angles, such as to each cover some or all of 360° horizontally). In at least some embodiments and situations, some or all such cameras may be independently movable (e.g., to rotate, tilt, swivel, etc.) at their positions, and may further in at least some such embodiments be positioned on one or more moveable parts of the vehicle (e.g., a hydraulic arm, attachment, etc.). In addition, in some embodiments and situations, the camera positioning may include having one or two forward-facing cameras (e.g., cameras that each produces perspective rectilinear images and/or video with a standard field of view and that in aggregate cover all or substantially all of the front area around the vehicle, such as all but a small area blocked by a front attachment of the vehicle), and one or two backward-facing camera (e.g., cameras that each produces panoramic images and/or video with a wide-angle field of view of 120° or 150° or 180° or more that covers the back and optionally some or all of the sides of vehicle). It will be appreciated that other quantities, positionings and types of GPS antennas (and/or antennas for other types of satellite-based navigation systems) and/or other sensors/components may be used in other embodiments.

Figure 2D:
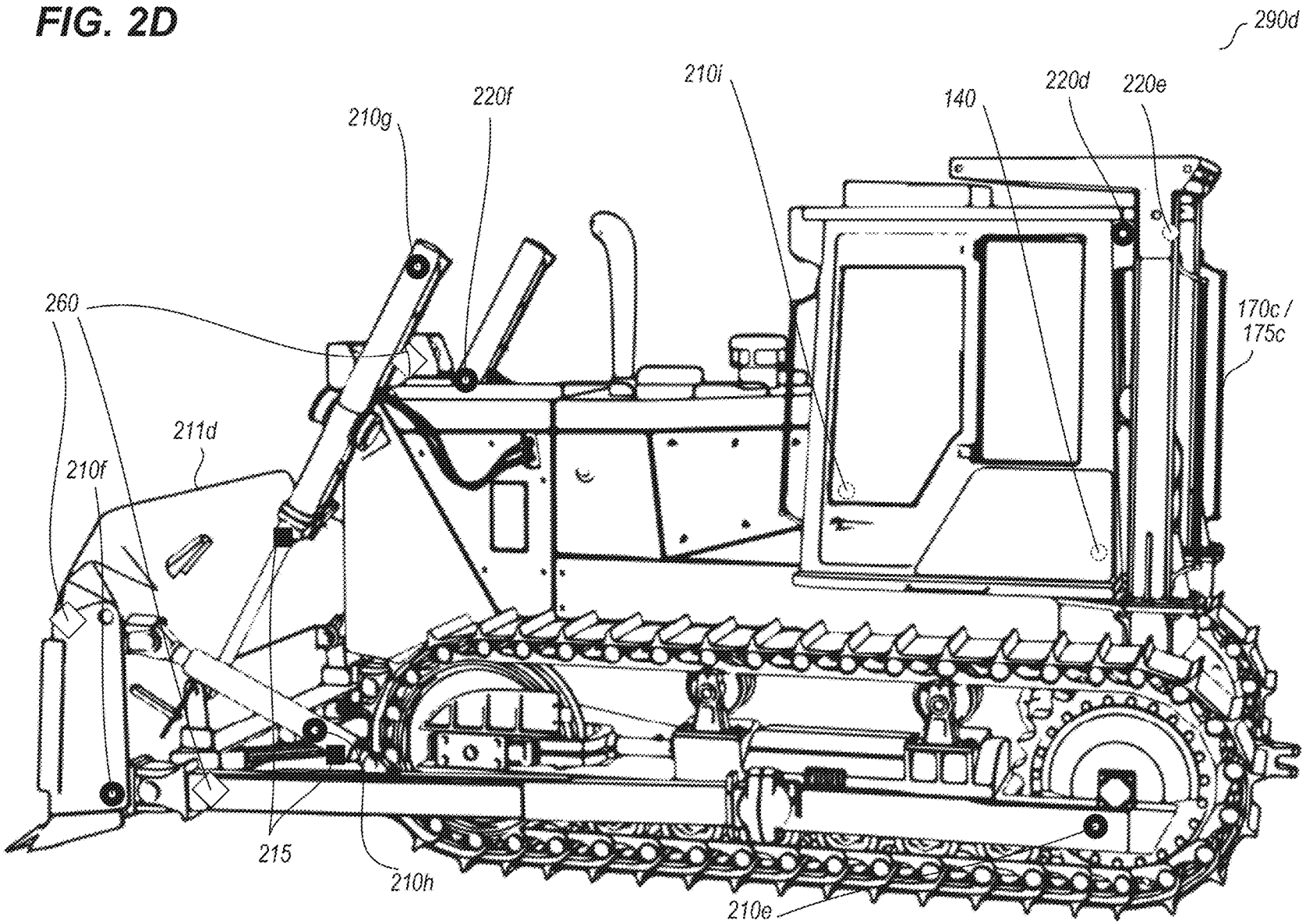
Figure 2E:
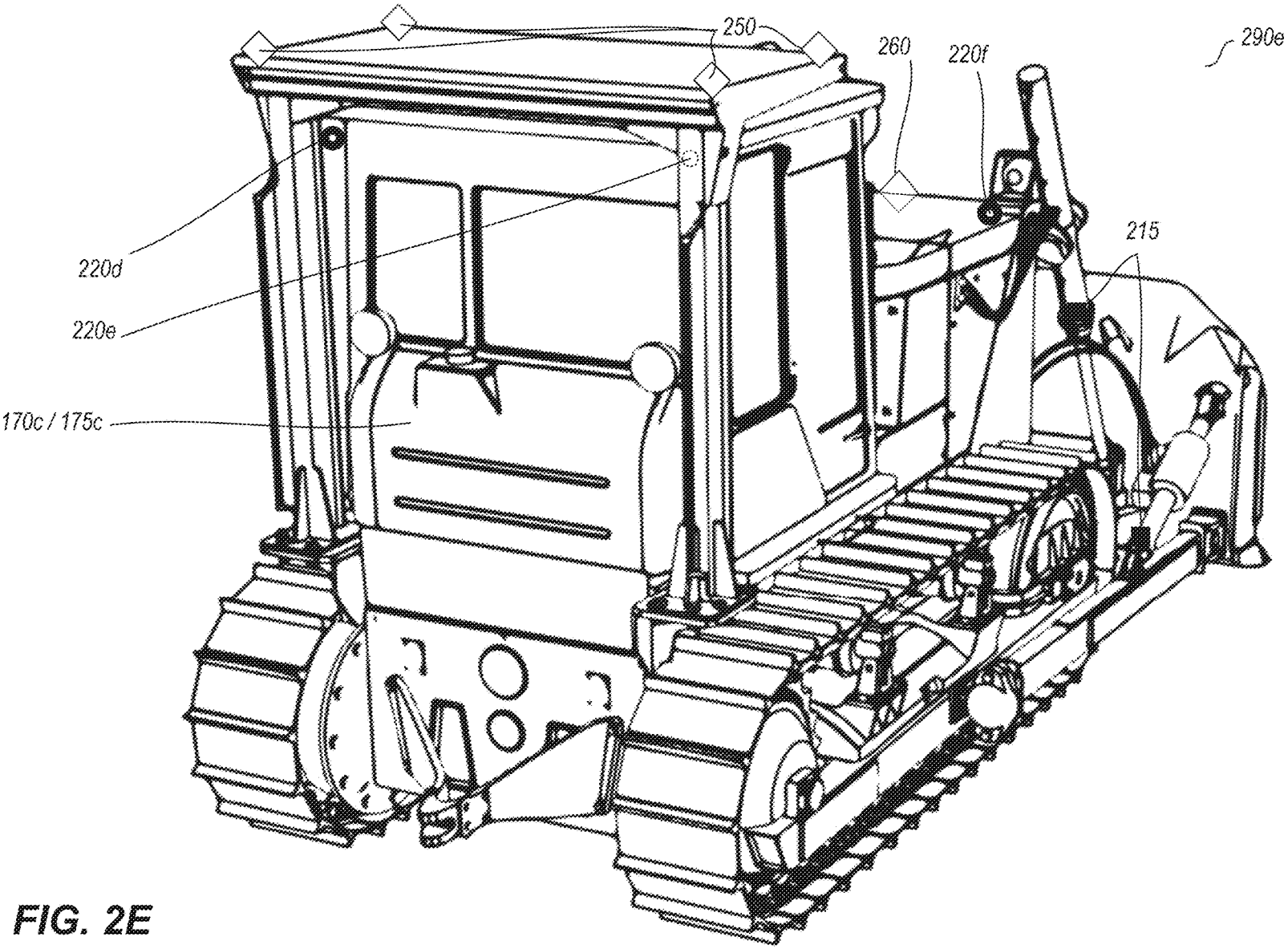

FIGS. 2D-2L continue the examples of FIGS. 2A-2C, with FIGS. 2D and 2E illustrating further example details about another earth-moving construction vehicle 170*c* and/or mining vehicle 175*c*, which in this example is a bulldozer vehicle having a blade attachment 211*d* (although other tool attachments may be used in other embodiments), such as to illustrate example positions for GPS receivers 220 and/or inclinometers 210 and/or one or more LiDAR components 260 and/or one or more cameras 250 and/or one or more pressure sensors 215. In particular, FIG. 2D illustrates example information 290*d* that includes various example inclinometers 210*e*-210*i*, example GPS antennas/receivers 220*d*-220*f*, and possible locations for one or more LiDAR components 260 and one or more pressure sensors 215. The example inclinometers 210*e*-210*i* are illustrated at positions that beneficially provide inclinometer data to compute the location of the blade or other front attachment (and optionally other parts of the bulldozer, such as the hydraulic arms) relative to the cabin of the bulldozer vehicle (e.g., at position 210*e* near the intersection of the track spring lifting arm and the body of the vehicle, position 210*f* near the intersection of the track spring lifting arm and the blade or other attachment, position 210*g* at one end of a hydraulic arm, position 210*h* at one end of the tilt cylinder, etc.), such as to use single-axis inclinometers in this example, and with another inclinometer 210*i* mounted within the cabin of the vehicle and illustrated at an approximate position using a dashed line, such as to use a dual-axis inclinometer that measures pitch and roll—data from the inclinometers may be used, for example, to track the position of the track spring lifting arm and attachment relative to the cabin/body of the vehicle. The example GPS antennas/receivers 220 are illustrated at positions that beneficially provide GPS data to assist in determining the positioning and direction of the cabin/body, including to use data from the three GPS antennas to provide greater precision than is available from a single GPS antenna. In this example, the three GPS antennas 220*d*-220*f* are positioned on the body and proximate to three corners of the body (e.g., as far apart from each other as possible), such that differential information between GPS antennas 220*f* and 220*e* may provide cabin heading direction information, and differential information between GPS antennas 220*d* and 220*e* may provide lateral direction information at approximately 90° from that cabin heading direction information. The example one or more LiDAR components 260 are illustrated at one or more possible positions that beneficially provide LiDAR data about some or all of an environment around the vehicle 170*c*/175*c*, such as to be positioned on one or more sides of the blade/scoop attachment (e.g., to have a view to the side(s) of the vehicle) and/or a top or bottom (not shown) of the blade/scoop attachment (e.g., to have a view forwards), and/or on sides of one or more of the hydraulic arms (e.g., to have a view to the side(s) of the vehicle), and/or on a front of the body (e.g., near the top to have a view forwards over the blade/scoop attachment), etc. The example one or more pressure sensors 215 are illustrated at one or more possible positions to connect to pressure pipes (not shown) at the bottom of one or more pistons controlling movement of the attachment. FIG. 2E also illustrates possible locations of one or more RGB cameras 250 that gather additional visual data about an environment of the vehicle 170*c*/175*c*—in this example, four cameras are used on top of the cabin (e.g., to in the aggregate provide visual coverage of some or all of 360° horizontally), with two on each side, and optionally with the two front camera facing partially or fully forwards and the two back cameras facing partially or fully backwards, although in other embodiments other camera configurations and/or types may be used (e.g., one or more cameras with panoramic view angles, such as to each cover some or all of 360° horizontally). In particular, in FIG. 2D, the example earth-moving vehicle is shown using a side view, with GPS antennas 220*d* and 220*e* illustrated on the back of the body at or below the top of that portion of the body (using dashed lines to illustrate position 220*e*), and with an approximate position of GPS antenna 220*f* on the body top near the front—the positions 220*d*-220*f* are further illustrated in information 290*e* of FIG. 2E, in which the example earth-moving vehicle is shown using an upper-side-back view, with GPS antenna 220*f* shown on the body top near the front on the same side as GPS antenna 220*e*. While not illustrated in FIGS. 2D-2E, some or all of the GPS antennas may be enabled to receive and use RTK data to further improve the accuracy of the GPS signals that are produced, such as by each being part of or otherwise associated with a GPS receiver including an RTK radio that receives and uses RTK-based GPS correction data transmitted from a base station (e.g., at a location remote from the site at which the vehicle is located) to improve accuracy of the GPS signals from the GPS antennas, so as to be part of one or more RTK-enabled GPS positioning units. The vehicle may further have one or more INS-DU or other IMU units, which are not shown in this example. It will be appreciated that other quantities, positionings and types of GPS antennas (and/or antennas for other types of satellite-based navigation systems) and/or inclinometers and/or other sensors/components may be used in other embodiments.

Figure 2F:
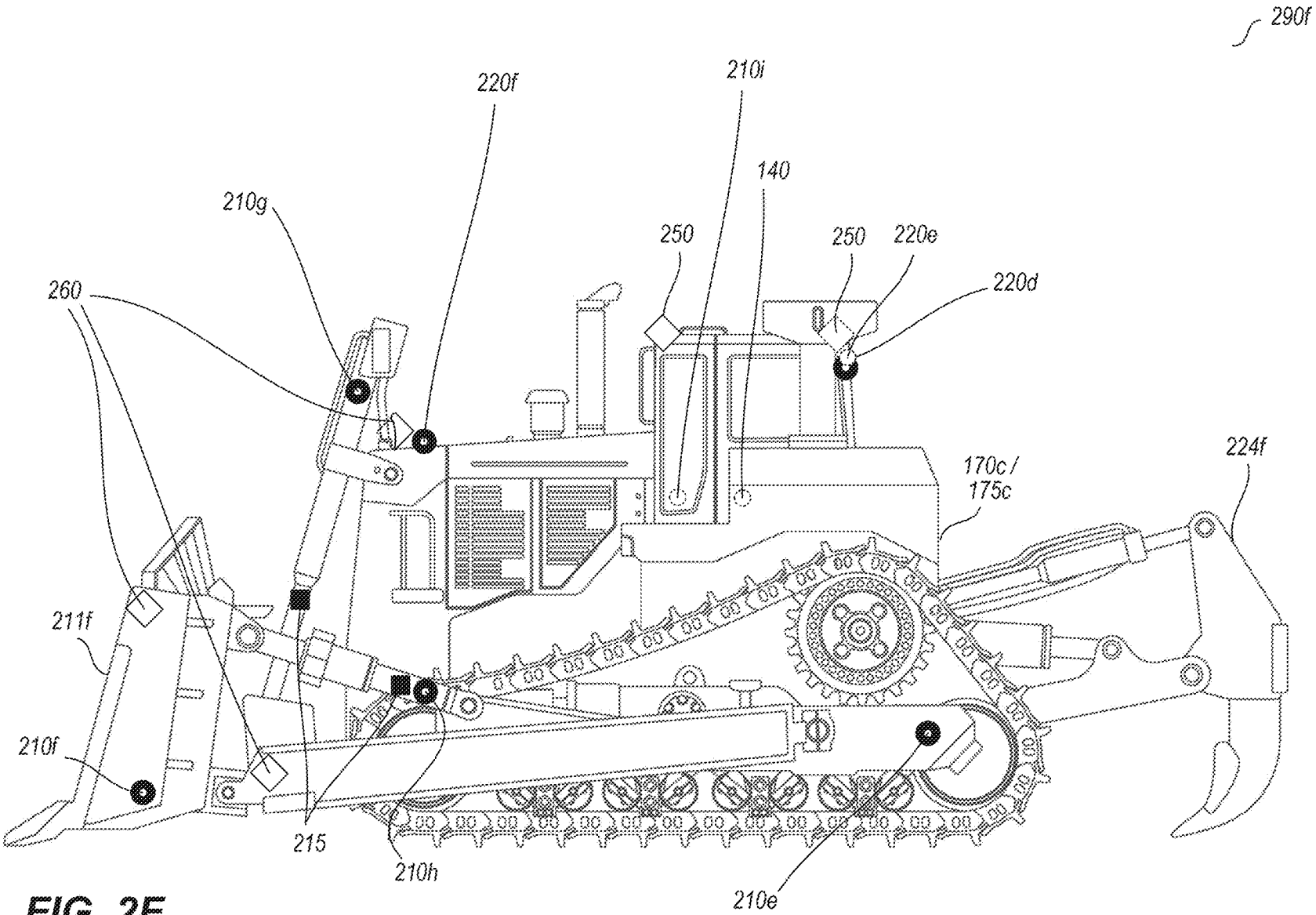

FIG. 2F continues the examples of FIGS. 2D-2E, and illustrates information 290*f* to show an example of an alternative configuration of a bulldozer vehicle 170*c*/175*c* in which the vehicle is equipped with both a front tool attachment and a rear tool attachment. In the example embodiment of FIG. 2F, the front tool attachment is a blade 211*f*, and the rear tool attachment is a ripper 224*f* with one or more teeth. Various sensors and components may be positioned on the vehicle in a manner similar to that of FIGS. 2D-2E, including illustrated elements 140, 210*e*-210*i*, 215, 220*d*-220*f*, 250 and 260.

Figure 2G:
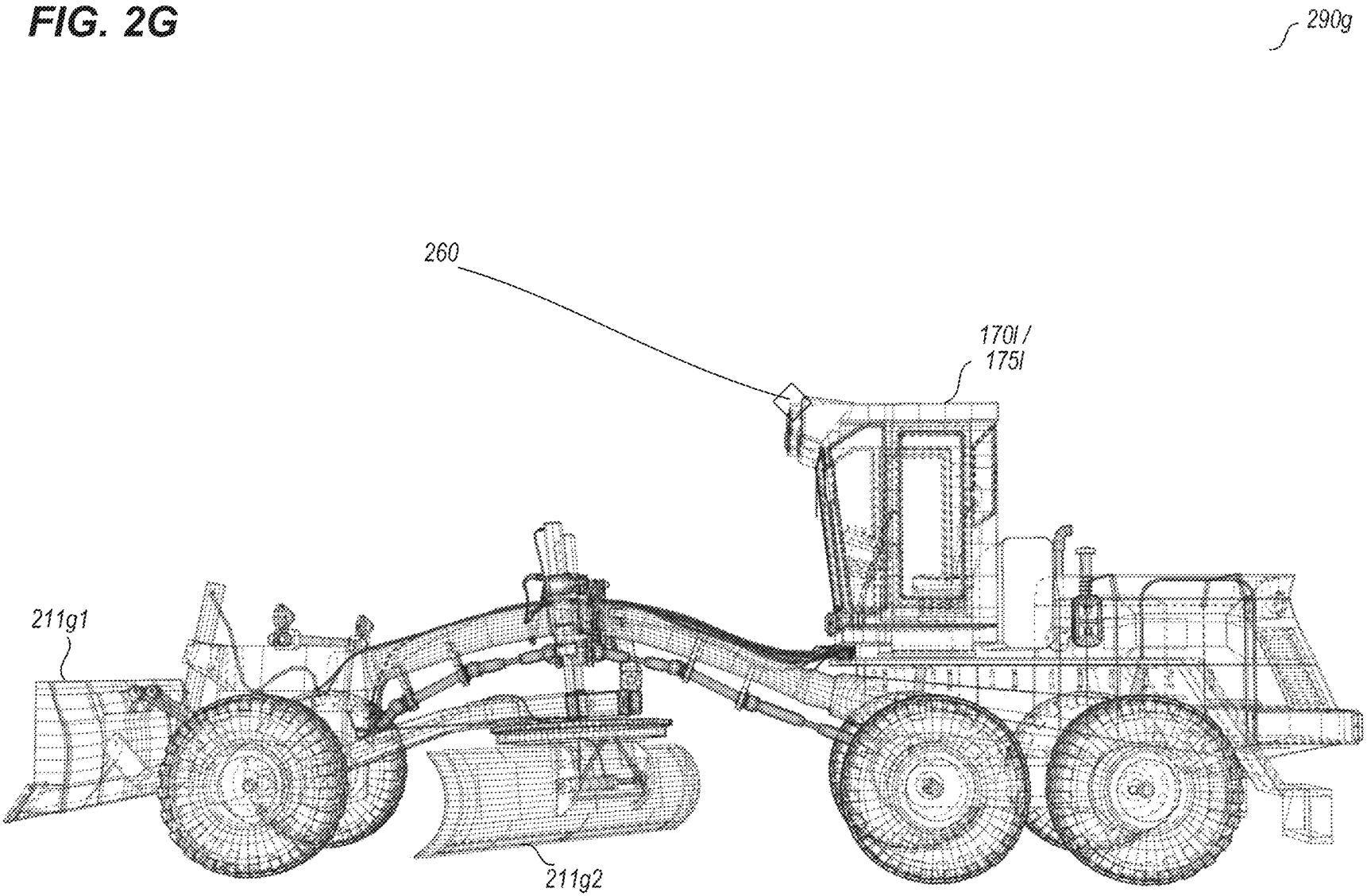

FIG. 2G illustrates information 290*g* to show further example details about another earth-moving construction vehicle 170*l* and/or mining vehicle 175*l*, which in this example is a motorized grader vehicle having a front blade attachment 211*g*1 and middle blade attachment 211*g*2 and optionally a rear ripper attachment or other tool attachment (not shown in this example). The vehicle may have one or more mounted LiDAR components 260 (e.g., a single LiDAR component on the upper front of the vehicle cabin), as well as various other mounted sensors and components in a manner similar to the vehicles of FIGS. 2A-2F (e.g., GPS receivers 220, inclinometers 210, cameras 250, one or more pressure sensors 215, one or more INS-DU or other IMU units, one or more control systems 140, etc.) that are not illustrated in the example of FIG. 2G. While also not illustrated, it will be appreciated that other additional sensors (e.g., infrared sensors, material type sensors, etc.) may be mounted on the respective powered earth moving vehicles 170*l* and/or 175*l* at various positions, such as at the same or similar positions as the LiDAR sensors and/or cameras/image sensors, or instead in other positions.

Figure 2H:
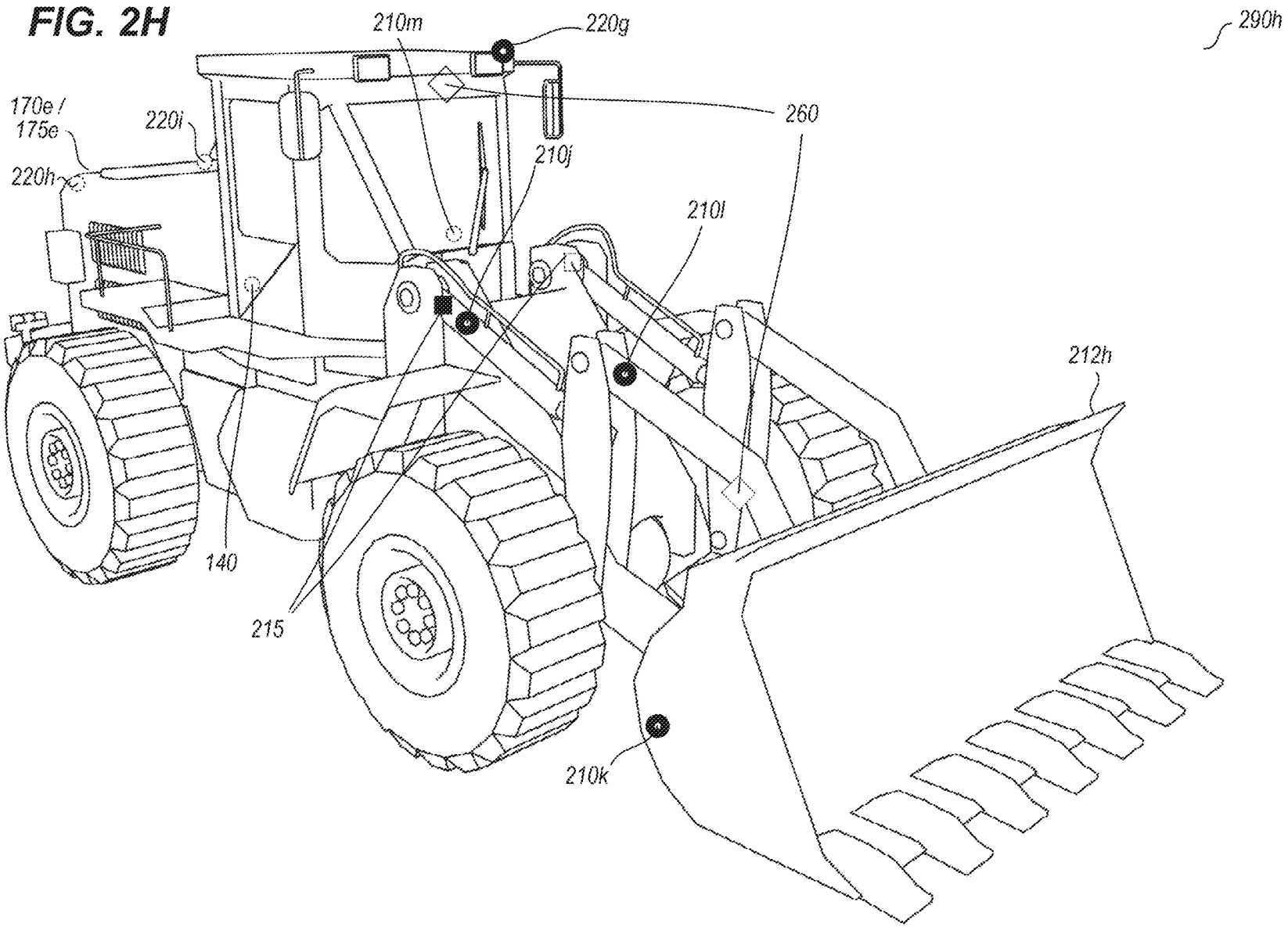
Figure 2I:
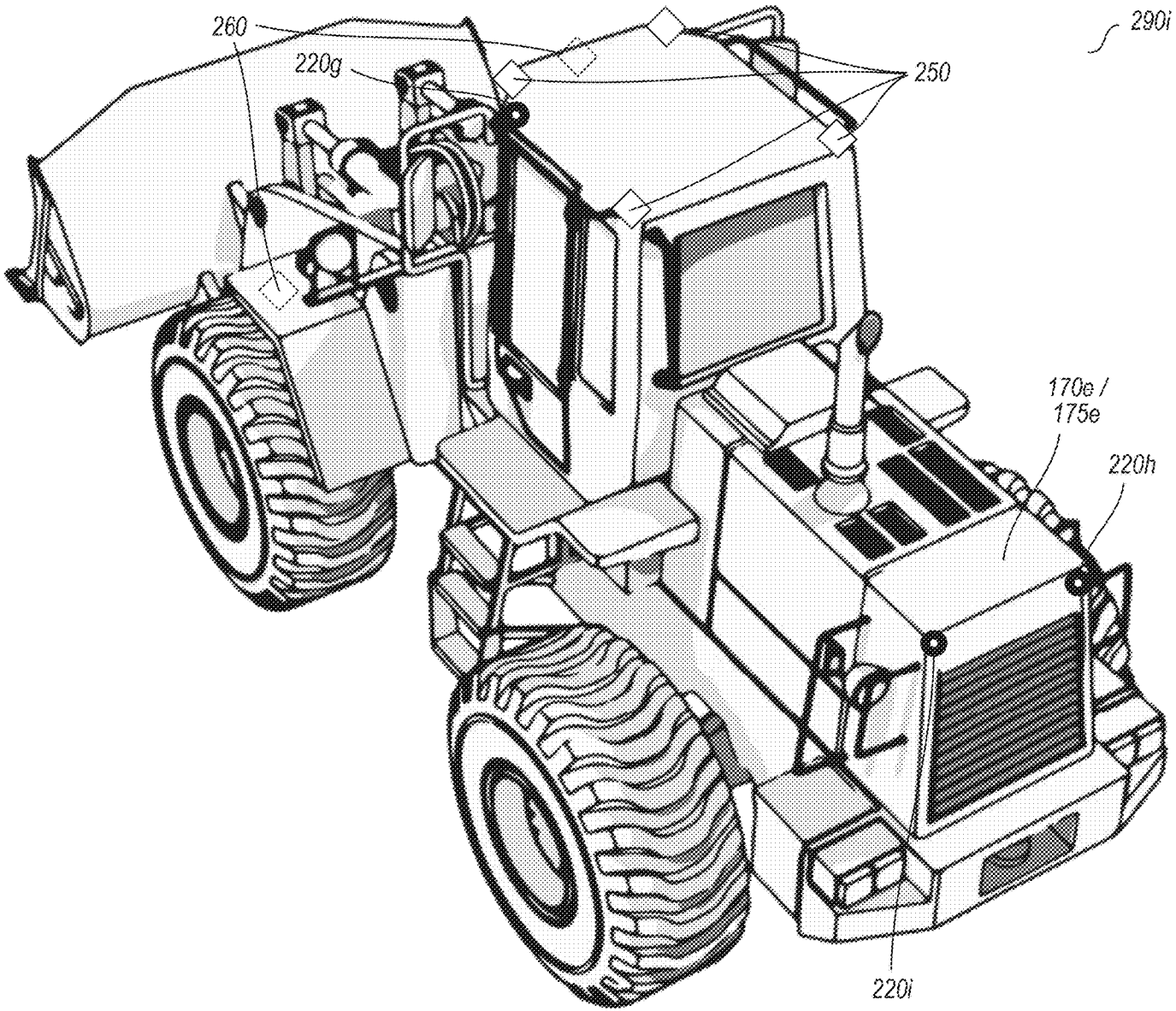
Figure 2J:
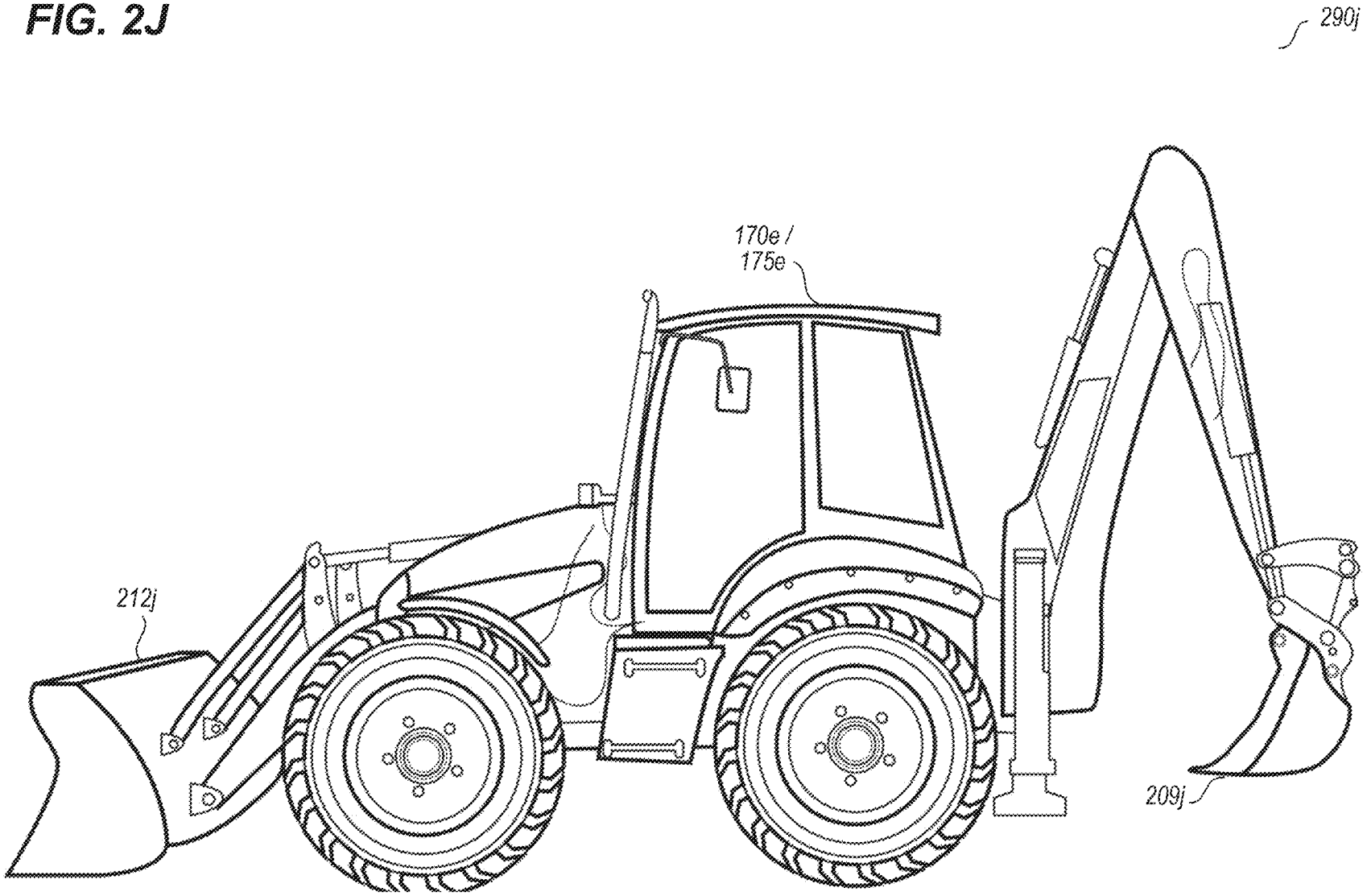

FIGS. 2H and 2I and 2J illustrate further example details about another earth-moving construction vehicle 170*e* and/or mining vehicle 175*e*, which in this example is a wheel loader vehicle having a bucket attachment 212*h* (although other tool attachments may be used in other embodiments), such as to illustrate example positions for GPS receivers 220 and/or inclinometers 210 and/or one or more LiDAR components 260 and/or one or more cameras 250 and/or one or more pressure sensors 215. In particular, FIG. 2H illustrates example information 290*h* that includes various example inclinometers 210*j*-210*m*, and example GPS antennas/receivers 220*g*-220*i*. The example inclinometers 210*j*-210*m* are further illustrated at positions that beneficially provide inclinometer data to compute the location of the bucket or other front attachment (and optionally other parts of the wheel loader, such as the hydraulic arms) relative to the cabin of the loader vehicle (e.g., at position 210*j* near the intersection of the boom lifting arm and the body of the vehicle, position 210*k* near the intersection of the boom lifting arm and the bucket or other attachment, position 210*l* at one end of a hydraulic arm, etc.), such as to use single-axis inclinometers in this example, and with another inclinometer 210*m* mounted within the cabin of the vehicle and illustrated at an approximate position using a dashed line, such as to use a dual-axis inclinometer that measures pitch and roll—data from the inclinometers may be used, for example, to track the position of the boom lifting arm and attachment relative to the cabin/body of the vehicle. The example GPS antennas/receivers 220 are further illustrated at positions that beneficially provide GPS data to assist in determining the positioning and direction of the cabin/body, including to use data from the three GPS antennas to provide greater precision than is available from a single GPS antenna. In this example, the three GPS antennas 220*g*-220*i* are positioned on the body and proximate to three corners of the body (e.g., as far apart from each other as possible), such that differential information between GPS antennas 220*g* and 220*i* may provide cabin heading direction information, and differential information between GPS antennas 220*h* and 220*i* may provide lateral direction information at approximately 90° from that cabin heading direction information. The example one or more LiDAR components 260 are illustrated at one or more possible positions that beneficially provide LiDAR data about some or all of an environment around the vehicle 170*e*/175*e*, such as to be positioned in this example on the underside of one or more of the hydraulic arms in a manner similar to that of excavator vehicle 170*a*/175*a* (e.g., to have a view to the side(s) and/or front of the vehicle 170*e*/175*e*) and/or on an upper front of the cabin, and using dashed lines in FIGS. 2H and 2I for locations blocked by other parts of the vehicle 170*e*/175*e*. The example one or more pressure sensors 215 are illustrated at one or more possible positions to connect to pressure pipes (not shown) at the bottom of one or more pistons controlling movement of the attachment. FIG. 2I also illustrates possible locations of one or more RGB cameras 250 that gather additional visual data about an environment of the vehicles 170*e*/175*e*—in this example, four cameras are used on top of the cabin (e.g., to in the aggregate provide visual coverage of some or all of 360° horizontally), with two on each side, and optionally with the two front camera facing partially or fully forwards and the two back cameras facing partially or fully backwards, although in other embodiments other camera configurations and/or types may be used (e.g., one or more cameras with panoramic view angles, such as to each cover some or all of 360° horizontally). In particular, in FIG. 2H, the example earth-moving vehicle is shown using a side-frontal view, with GPS antennas 220*h* and 220*i* illustrated on the back of the body at or below the top of that portion of the body (using dashed lines to illustrate their positions), and with an approximate position of GPS antenna 220*g* on the body top near the front—the positions 220*g*-220*i* are further illustrated in information 290*i* of FIG. 2I, which is shown using an upper-side-back view, with GPS antenna 220*g* shown on the body top near the front on the same side as GPS antenna 220*i*. While not illustrated in FIGS. 2H and 2I, some or all of the GPS antennas may be enabled to receive and use RTK data to further improve the accuracy of the GPS signals that are produced, such as by each being part of or otherwise associated with a GPS receiver including an RTK radio that receives and uses RTK-based GPS correction data transmitted from a base station (e.g., at a location remote from the site at which the vehicle is located) to improve accuracy of the GPS signals from the GPS antennas, so as to be part of one or more RTK-enabled GPS positioning units. The vehicle may further have one or more INS-DU or other IMU units, which are not shown in this example. It will be appreciated that other quantities, positionings and types of GPS antennas (and/or antennas for other types of satellite-based navigation systems) and/or inclinometers and/or other sensors/components may be used in other embodiments. FIG. 2J continues the examples of FIGS. 2H-2I, and illustrates information 290*j* to show an example of an alternative configuration of a wheel loader vehicle 170*e*/175*e* in which the vehicle is equipped with both a front tool attachment and a rear tool attachment. In the example embodiment of FIG. 2J, the front tool attachment is a bucket 212*j*, and the rear tool attachment is a bucket or scoop 209*j*. Various sensors and components may be positioned on the vehicle in a manner similar to that of FIGS. 2H-2I, including illustrated elements 140, 210*j*-210*l*, and 215.

Figure 2K:
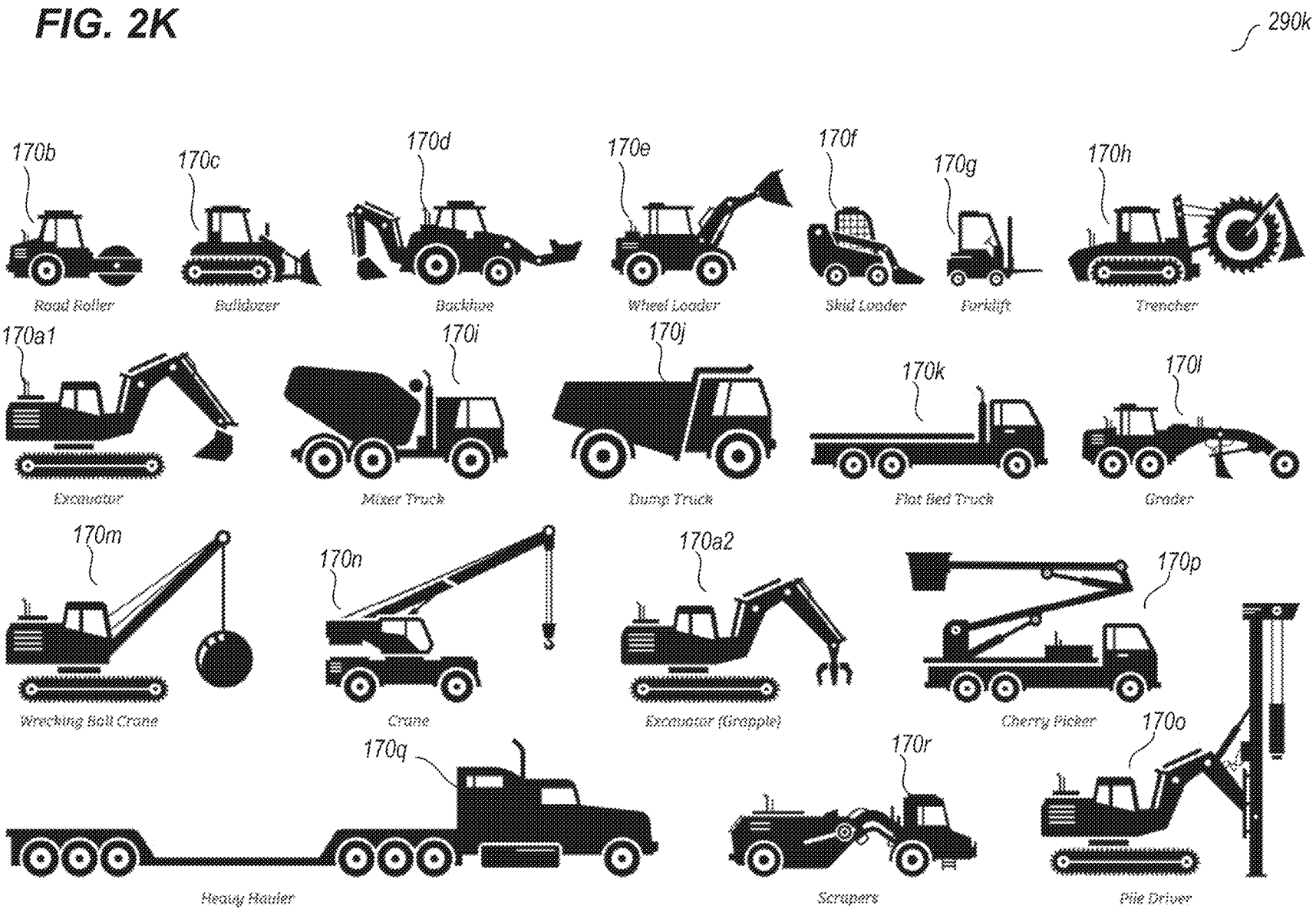
Figure 2L:
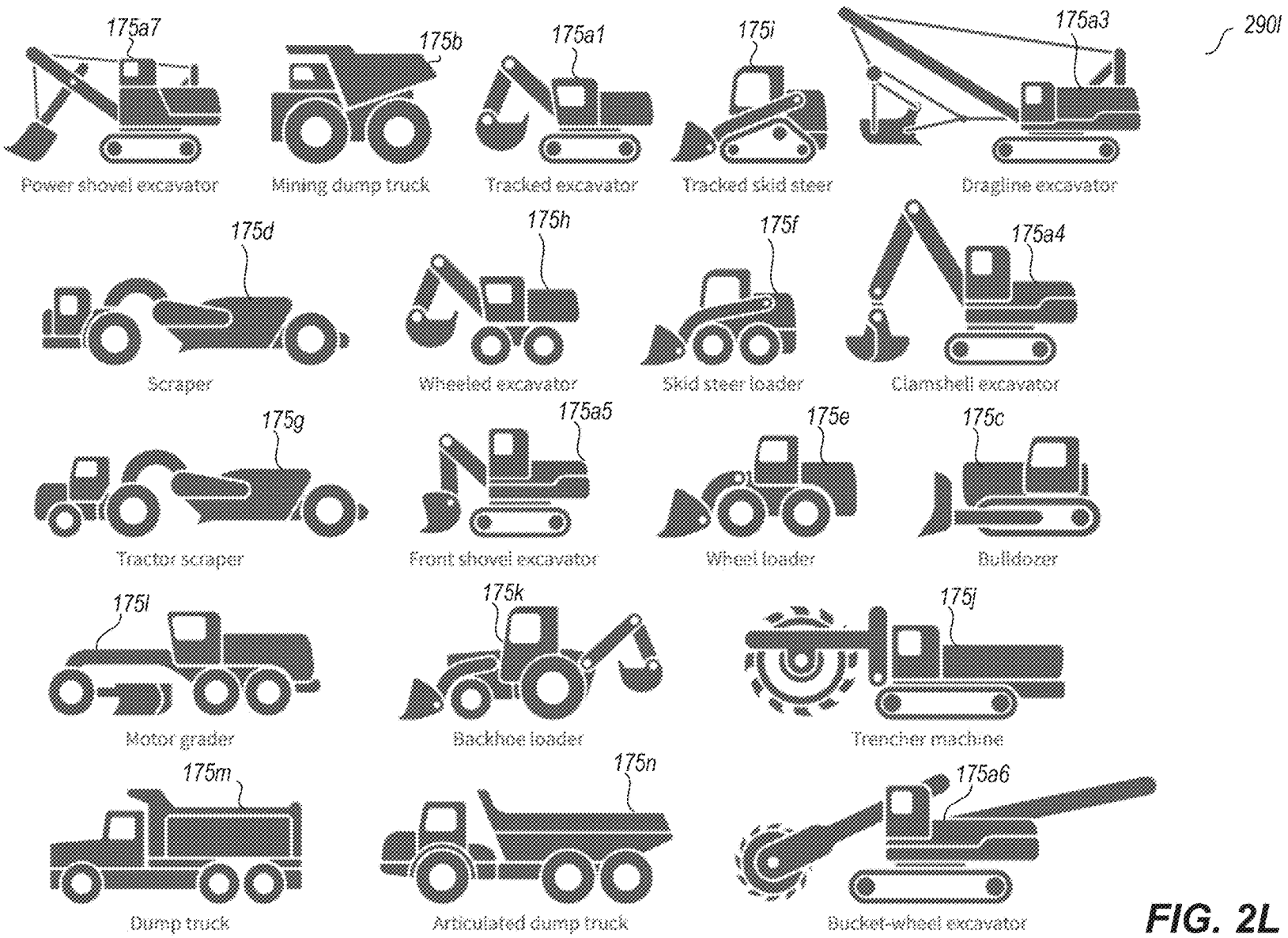

FIGS. 2K and 2L illustrate respective information 290*k* and 290*l* about a variety of non-exclusive example types of powered earth-moving construction vehicles 170 and powered earth-moving construction vehicles 175 that may be controlled by embodiments of the EMVAOC system. FIG. 2K includes two example earth-moving tracked construction excavator vehicles 170*a* shown with different attachments (excavator vehicle 170*a*1 with a bucket attachment, and excavator vehicle 170*a*2 with a grapple attachment) that may be controlled by the EMVAOC system. Other example types of earth-moving construction vehicles 170 that are illustrated in FIG. 2K include a bulldozer 170*c;* a backhoe loader 170*d;* a wheel loader 170*e;* a skid steer loader 170*f;* a dump truck 170*j;* a forklift 170*g;* a trencher 170*h;* a mixer truck 170*i;* a flatbed truck 170*k;* a motorized grader 170*l;* a wrecking ball crane 170*m;* a truck crane 170*n;* a cherry picker 170*p;* a heavy hauler 170*q;* a scraper 170*r;* a pile driver 170*o;* a road roller 170*b;* etc. It will be appreciated that other types of earth-moving construction vehicles may similarly be controlled by the EMVAOC system in other embodiments. In a similar manner, FIG. 2L illustrates several example earth-moving tracked mining excavator vehicles 175*a* shown with different attachments (excavator vehicle 175*a*1 with a bucket attachment, excavator vehicle 175*a*3 with a dragline attachment, excavator vehicle 175*a*4 with a clamshell extractor attachment, excavator vehicle 175*a*5 with a front shovel attachment, excavator vehicle 175*a*6 with a bucket wheel extractor attachment, excavator vehicle 175*a*7 with a power shovel attachment, etc.) that may be controlled by the EMVAOC system. Other example types of earth-moving mining vehicles 175 that are illustrated in FIG. 2L include a dump truck 175*m;* an articulated dump truck 175*n;* a mining dump truck 175*b;* a bulldozer 175*c;* a scraper 175*d;* a tractor scraper 175*g;* a wheel loader 175*e;* a wheeled skid steer loader 175*f;* a tracked skid steer loader 175*i;* a wheeled excavator 175*h;* a backhoe loader 175*k;* a motor grader 175*j;* a trencher 175*l;* etc. It will be appreciated that other types of earth-moving mining vehicles may similarly be controlled by the EMVAOC system in other embodiments. In addition, while various types of sensors are not illustrated in FIGS. 2K and 2L, it will be appreciated that such sensors (e.g., LiDAR sensors, image sensors of cameras, infrared sensors, material type sensors, etc.) may be mounted on the respective powered earth moving vehicles 170 and/or 175 at various positions, such as at the same or analogous positions as the sensors discussed with respect to FIGS. 2A-2J, or instead in other positions.

Figure 2M:
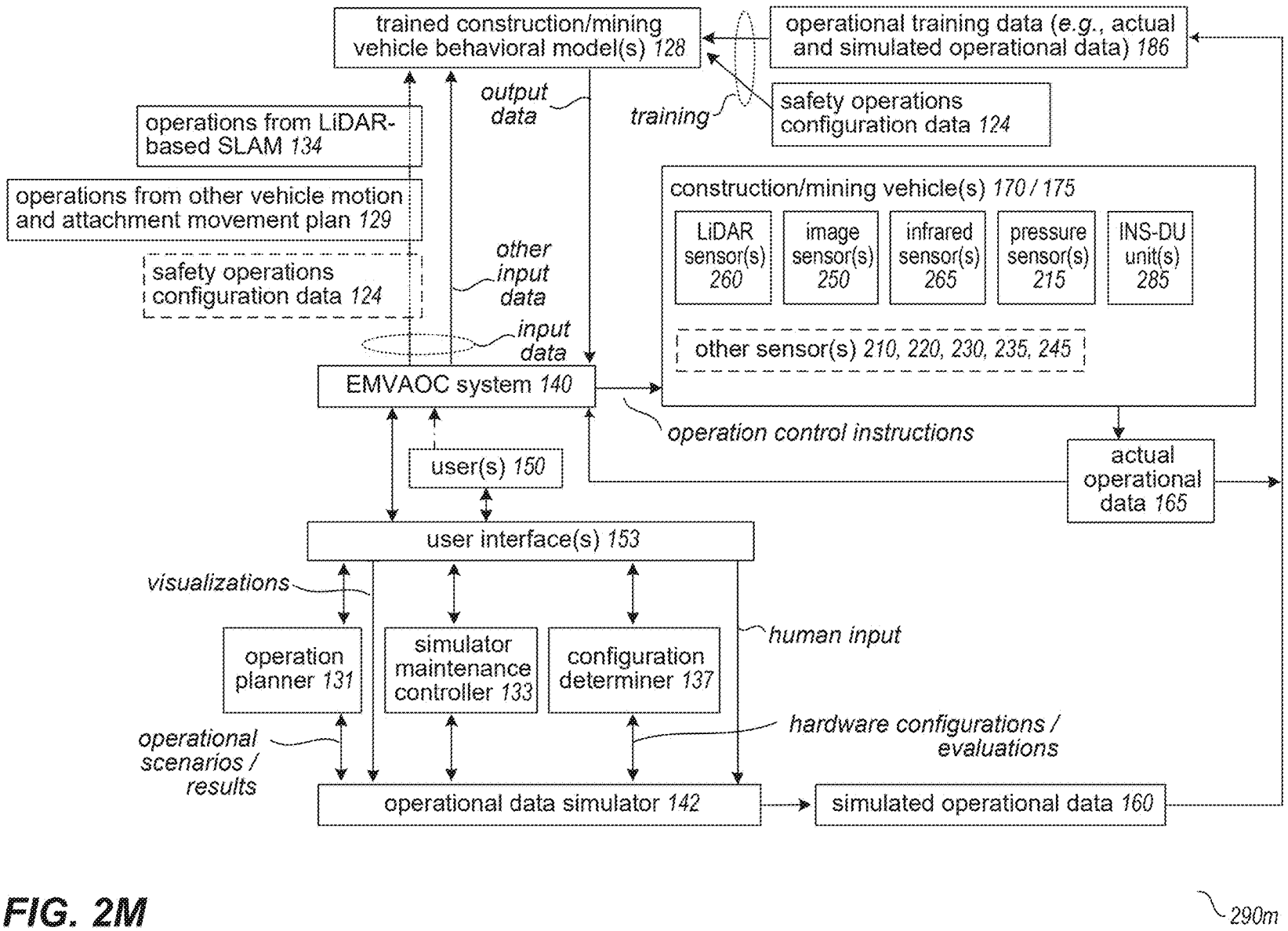
Figure 2N:
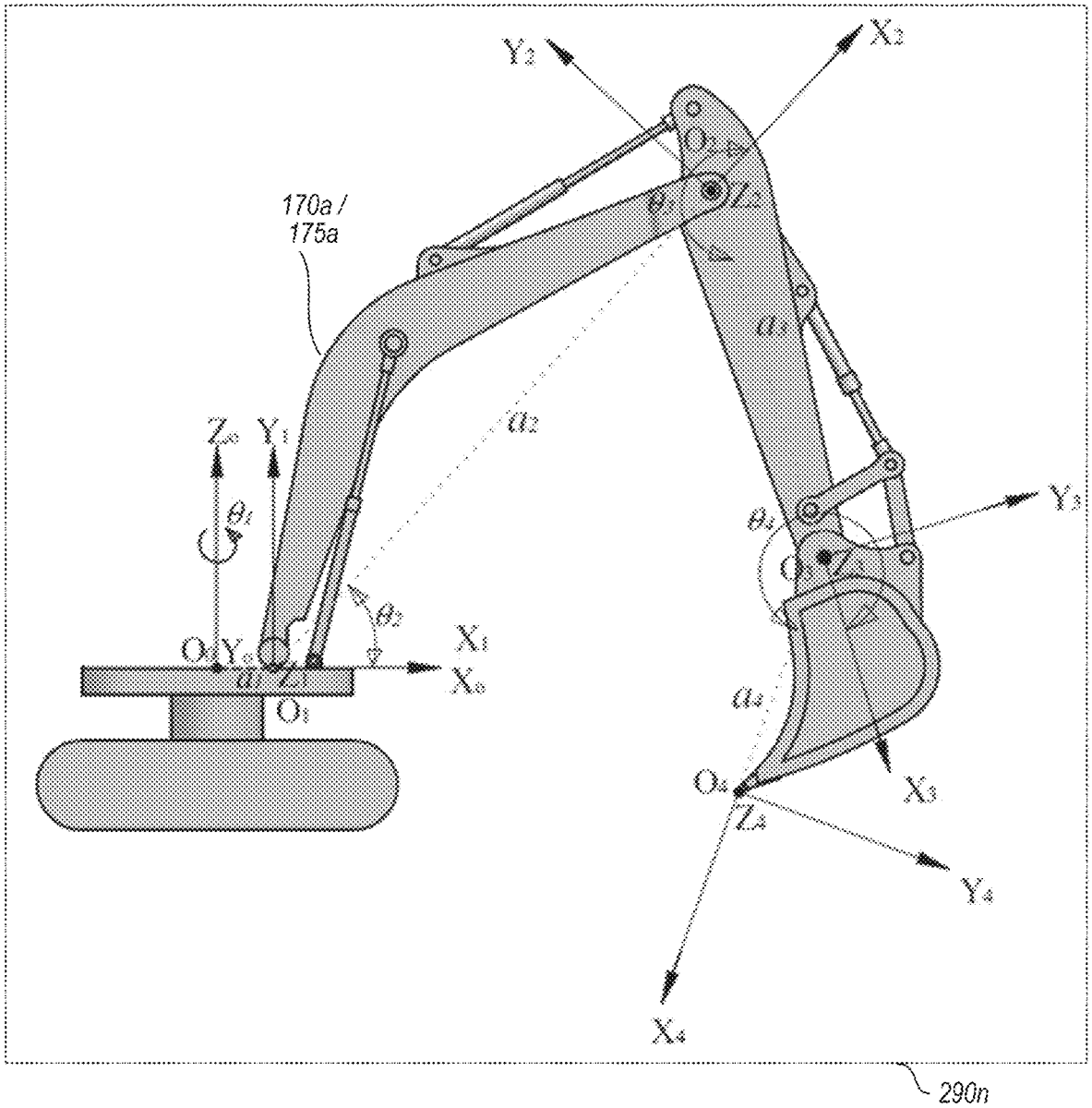

FIGS. 2M and 2N illustrate examples of modules and interactions and information used to implement autonomous operations of one or more powered earth-moving vehicles based at least in part on gathered environment data. In particular, FIG. 2M illustrates information 290*m* about a powered earth-moving vehicle behavioral model 128 that is used by the EMVAOC system 140 to implement determined autonomous operations of one or more earth-moving vehicles 170/175/180, such as to supply input data to the behavioral model 128 corresponding to a current state and environment of the earth-moving vehicle(s) and about vehicle motion and/or attachment movement operations to be performed for one or more tasks (e.g., from a planner module or other source) and optionally safety operations configuration data 124 to use (e.g., related to operations involving balancing, slippage, prohibited 3D positions, etc.), and to receive corresponding output data used to provide operation control instructions to the earth-moving vehicle(s)—in this example, the input data further includes information 134 about a plan to implement automated operations for performing LiDAR-based SLAM operations (e.g., related to calibrating on-vehicle LiDAR sensors, using LiDAR data for vehicle position determination, etc.) based in part on sensor position and orientation, such as from module 146. In this example, the earth-moving vehicle(s) 170/175/180 each has one or more LiDAR sensors 260 that generate data about a surrounding environment of the earth-moving vehicle(s) 170/175/180 (e.g., in the form of one or more 3D point clouds, not shown, and such as after calibration operations are performed that provide LiDAR calibration data to translate the LiDAR data obtained from a current position of each LiDAR sensor to a global coordinate system for the site), one or more image sensors 250 of one or more cameras that generate visual data about a surrounding environment of the earth-moving vehicle(s) 170/175/180 (e.g., video, still images, etc., and such as after calibration operations are performed that provide camera calibration data to translate the visual data obtained from a current position of each camera or other image sensor to a global coordinate system for the site), one or more infrared sensors 265 that generate infrared data about a surrounding environment of the earth-moving vehicle(s) 170/175/180 (e.g., for objects and other obstacles, etc., and such as after calibration operations are performed that provide infrared calibration data to translate the infrared data obtained from a current position of each infrared sensor to a global coordinate system for the site), one or more pressure sensors 215 that provide data about when the attachment(s) are touching the ground or other surface (based on pressure to the piston(s) or other cylinder(s) that lift the attachment, such as to detect with the attachment is on the surface based on the pressure going to zero or otherwise below a defined threshold, such as 20 or 30 PSI), one or more INS-DU or other IMU units to assist in determining vehicle position (e.g., with respect to orientation and in some cases position of the INS-DU or other IMU units), and may optionally further have one or more other sensors 210, 220, 230, 235 or 245, and the actual operational environment data and other actual operational data 165 obtained by the on-vehicle sensors is provided to the EMVAOC system 140. The EMVAOC system 140 may analyze the environment data and other data 165 from the vehicle(s) 170/175/180 to generate additional data (e.g., to classify types of obstacles of detected objects, to generate a terrain contour map or other visual map of some or all of the surrounding environment, to determine prohibited 3D positions, etc.) and to determine operation control instructions to implement on the vehicle(s) 170/175/180, including for vehicle motion between locations on a job site and for attachment movements as part of vehicle operations—for example, the EMVAOC system 140 may produce DIGMAP information or other 2D representations to represent the terrain of some or all of the job site, such as for use by a planner module 131; etc. As one non-exclusive example, the operation control instructions provided from the EMVAOC system 140 may simulate inputs to the control panel on a powered earth-moving vehicle that would be used by a human operator, if one were present, and the behavioral model(s) 128 may translate the operation control instructions to implementation activities for the vehicle(s) 170/175/180 (e.g., hydraulic and/or electrical impulses that are provided to the vehicle(s) 170/175/180)—for example, a command may represent joystick deflection (e.g., for one or both of two joysticks, each with 2 axes), activation of a tool control button on one of the joysticks for controlling the tool attachment (e.g., claw, bucket, hammer, etc.), pedal position (e.g., for one or both of two pedals, analogous to car pedals but with a zero position in the middle and with the pedal able to move forward or backward), etc., such as using a number between −1 and 1, and such as by using one or more piston displacement mechanisms positioned to manipulate one or more controls of the powered earth-moving vehicle when actuated. In one embodiment, the behavioral model achieves at least 17% efficiency improvement and 20× duty cycle improvement over human operators and proportional fuel efficiency can also be achieved. FIG. 2M further illustrates additional modules that may interact with the EMVAOC system 140 and/or each other to provide additional functionality. In particular, one or more users 150 may use one or more user interface(s) 153 (e.g., a GUI displayed on a computing device or provided via a VR and/or AR and/or mixed reality system) to perform one or more interactions, such as one or more of the following: to interact with a planner module 131 that computes an optimal or otherwise preferred plan for an entire job or to otherwise specify operational scenarios and receive simulated results, such as for use in determining optimal or otherwise preferred implementation plans to use for one or more tasks and/or multi-task jobs or to otherwise enable user what-if experimentation activities; to interact with a configuration determiner module 137 that uses the simulator module(s) 142 to determine optimal or otherwise preferred hardware component configurations to use; to interact with a simulator maintenance controller 133 to implement various types of maintenance activities; to directly supply human input for use by the simulator module(s) 142 (e.g., configuration parameters, settings, etc.); to request and receive visualizations of simulated operations and/or simulated operational data; etc. The planner module 131 may, for example, be independently developed through the design of artificial intelligence, and a plurality of plans from the planner module 131 may be input to the same trained model without having to train new models. In some embodiments, the simulator module(s) 142 may further generate rendered visualizations (e.g., by using 'unreal engine' from Epic Games or other rendering engine). Actual operational data 165 from operation of the powered earth-moving vehicle(s) and/or simulated operational data 160 from one or more operational data simulators 142 may further be used as training data 186 used to train the behavioral model(s) 128, such as initial training before the model(s) are used and/or updated training while the model(s) are being used (e.g., to improve their performance over time).

Additional details related to non-exclusive example embodiment(s) of one or more modules and/or systems that may be included as part of the EMVAOC system 140 are included in U.S. Non-Provisional patent application Ser. No. 17/970,427, filed Oct. 20, 2022 and entitled "Autonomous Control Of On-Site Movement Of Powered Earth-Moving Construction Or Mining Vehicles"; in U.S. Non-Provisional patent application Ser. No. 18/233,272, filed Aug. 11, 2023 and entitled "Autonomous Control Of Operations Of Powered Earth-Moving Vehicles Using Data From On-Vehicle Perception Systems"; in U.S. Provisional Patent Application No. 63/452,928, filed Mar. 17, 2023 and entitled "Autonomous Control Of Operations Of Powered Earth-Moving Construction Or Mining Vehicles To Implement Safety Rules"; in U.S. Provisional Patent Application No. 63/539,097, filed Sep. 18, 2023 and entitled "Autonomous Control Of Tool Attachments Of Powered Earth-Moving Construction Or Mining Vehicles To Implement Balancing On Non-Level Surfaces"; in U.S. Provisional Patent Application No. 63/532,031, filed Aug. 10, 2023 and entitled "Autonomous Control Of Powered Earth-Moving Construction Or Mining Vehicles To Inhibit Vehicle Slippage"; in U.S. Provisional Patent Application No. 63/541,421, filed Sep. 29, 2023 and entitled "Autonomous Control Of Powered Earth-Moving Construction Or Mining Vehicles To Rectify Vehicle Slippage"; in U.S. Provisional Patent Application No. 63/541,432, filed Sep. 29, 2023 and entitled "Autonomous Control Of Powered Earth-Moving Construction Or Mining Vehicles To Implement Controlled Vehicle Stoppage"; in U.S. Provisional Patent Application No. 63/538,493, filed Sep. 14, 2023 and entitled "Autonomous Control Of Powered Earth-Moving Construction Or Mining Vehicles To Implement Improved Gradual Turning"; in U.S. Non-Provisional patent application Ser. No. 18/107,892, filed Feb. 9, 2023 and entitled "Autonomous Control Of Operations Of Earth-Moving Vehicles Using Trained Machine Learning Models"; and in U.S. Non-Provisional patent application Ser. No. 18/120,264, filed Mar. 10, 2023 and entitled "Autonomous Control Of Operations Of Earth-Moving Vehicles Using Data From Simulated Vehicle Operation"; each of which is hereby incorporated by reference in its entirety.

FIG. 2N illustrates information 290*n* regarding physical movement dynamics information for an example powered earth-moving vehicle 170*a*/175*a*, which in this example is an excavator vehicle, such as may be used in the training and/or implementation of behavioral models 128, and/or by the operational data simulator module 142 in simulating operations of such an earth-moving vehicle, and/or as part of determining prohibited 3D positions for movement of the vehicle's hydraulic arms and tool attachment corresponding to other parts of the vehicle (e.g., the body, the tracks, etc.) and/or as part of determining positions of vehicle arm(s) and/or attachment(s) to use as part of operations related to balancing, slippage, controlled stoppage, etc. In this example, the information 290*n* illustrates angles and directions that arm(s)/attachment may move, such as for a bucket/scoop attachment in this example. In at least some such embodiments, the operational data simulator module may use various movement-related equations as part of its operations, such as to include the following:

Position

Derivative: $r(t)$

Integral: $r(t) = r_0 + \int_0^t v dt'$

Velocity

Derivative: $v(t) = \frac{dr}{dt}$

Integral: $v(t) = v_0 + \int_0^t a dt'$

Acceleration

Derivative: $a(t) = \frac{dv}{dt} = \frac{d*d*r}{d*t*t}$

Integral: $a(t)$ $$W = \int_a^b F(x) d^x$$

Then composes to the full law of motion:

$$x(t) = x_0 + \int_n^t v(\mathcal{T})d\mathcal{T} = x_0 + \int_n^t v_0 e^{-\frac{k}{m}\mathcal{T}} d\mathcal{T} = x_0 - m * v_0/k * \left(e^{-\frac{k}{m}\mathcal{T}} - 1\right) = x_0 + m * v_0/k * \left(1 - e^{-\frac{k}{m}\mathcal{T}}\right)$$

Forward Kinematics: This process transforms measured joint angles from a given origin to calculate positions of the end effectors (stick end and bucket bottom). It is a chain of transformations from the initial joint (cabin) up to the final effector (bucket).

Inverse kinematics: This process infers a possible set of joint angles to put the end effector (stick end or bucket end) to a specified position in the cylindrical space. It is handled by a custom Decision Tree-based machine learning model. To create training/test data for the model, a grid search of all possible angles for joints (between minimum and maximum limit of the joints) is used, and forward kinematics are computed to create ground truth labels. 20% of the data may be used for testing of the model, and 80% may be used for the training. During the inference, a destination position in cylindrical coordinates is provided to the model, and the model outputs the closest joint angles that will hold the effector in the desired destination position. As a safety mechanism, forward kinematics may be run one more time with the model outputs to verify the results in a real-time manner.

Joint Physics: Simulation of hydraulic physics may be calculated with state-based approximations, such as for the following example states:

1-Idle—no input is applied after SlowDown state is transitioned out completely (model assumes no movement in the joints);

2-WindUp—in seconds, time between start input and start of movement, with delay caused by the pilot hydraulics getting pressurized before opening valves on the main hydraulics;

3-SpeedUp—interpolation until speed reaches MaxAngularSpeed, to ease in to the target angular velocity, using a formula as follows:

```
Alpha =Clamp(timedelta, 0.0, SpeedUpCoefficient)/
    SpeedUpCoefficient InterpolationEaseOut(0.0,
    Desired Angular Velocity, Alpha, 2.0);
```

4-Sustain—when input is stopped, until speed reaches 0, keeping steady at the target angular velocity;

5-SlowDown—ease out of the target angular velocity and ease in to zero, using a formula as follows:

```
Alpha=Clamp(timedelta, DesiredVelocityAtStart,
    SlowDownCoefficient)/SlowDownCoefficient
    InterpolationEaseOut(0.0, Desired Angular
    Velocity, Alpha, 2.0).
```

Different Windup/SpeedUp/Sustain/SlowDown times may be used based on particular machines and conditions, such as for domain randomization. It will be appreciated that the operational data simulator module may use other equations in other embodiments, whether for earth-moving vehicles with the same or different attachments and/or for other types of earth-moving vehicles. In at least some embodiments, the operational data simulator module may, for example, simulate the effect of wet sand on the terrain. More generally, use of the operational data simulator module may perform experimentation with different alternatives (e.g., different sensors or other hardware components, component placement locations, hardware configurations, etc.) without actually placing them on physical earth-moving vehicles and/or for different environmental conditions without actually placing earth-moving vehicles in those environmental conditions, such as to evaluate the effects of the different alternatives and use that information to implement corresponding setups (e.g., to perform automated operations to determine what hardware components to install and/or where to install it, such as to determine optimal or near-optimal hardware components and/or placements; to enable user-driven operations that allow a user to plan out, define, and visualize execution of a job; etc.). Furthermore, such data from simulated operation may be used in at least some embodiments as part of training one or more behavioral machine learning models for one or more earth-moving vehicles (e.g., for one or more types of earth-moving vehicles), such as to enable generation of corresponding trained models and methodologies (e.g., at scale, and while minimizing use of physical resources) that are used for controlling autonomous operations of such earth-moving vehicles.

FIG. 2O (referred to herein as "2-O" to prevent confusion with the number 20) illustrates further example information related to the gathering and generation of environment data, such as by perception system 141, and illustrates information 290*o* to provide non-exclusive examples of environment data that may be gathered and generated by an embodiment of the EMVAOC system 140. In this example, information 290*o*1 illustrates an example of an image of surrounding terrain that may be captured around a powered earth-moving vehicle (not shown), such as by one or more RGB cameras located on the vehicle. Information 290*o*2 illustrates an example of information that may be gathered by one or more LiDAR modules on the vehicle regarding part of a surrounding environment, such as to include 3D data points that illustrate shape and depth information for surrounding terrain, as well as objects in the environment (e.g., one or more vehicles, a person, a rock or other object, etc.). Information 290*o*3 illustrates a further example of a 3D point cloud that may be generated from LiDAR data, and shows depth and shape information for a surrounding environment, such as terrain of the environment. Information 290*o*4 illustrates one example of a visual map of a surrounding environment (e.g., a DigMap) that may be generated from such LiDAR data, which in this example is a terrain contour visual map. In at least some embodiments, such a visual map may include a set of 3D data points, such as to each have a corresponding XYZ coordinate in relation to an origin point (e.g., a location of a LiDAR component that is used to generate the 3D data points).

Figure 2P:
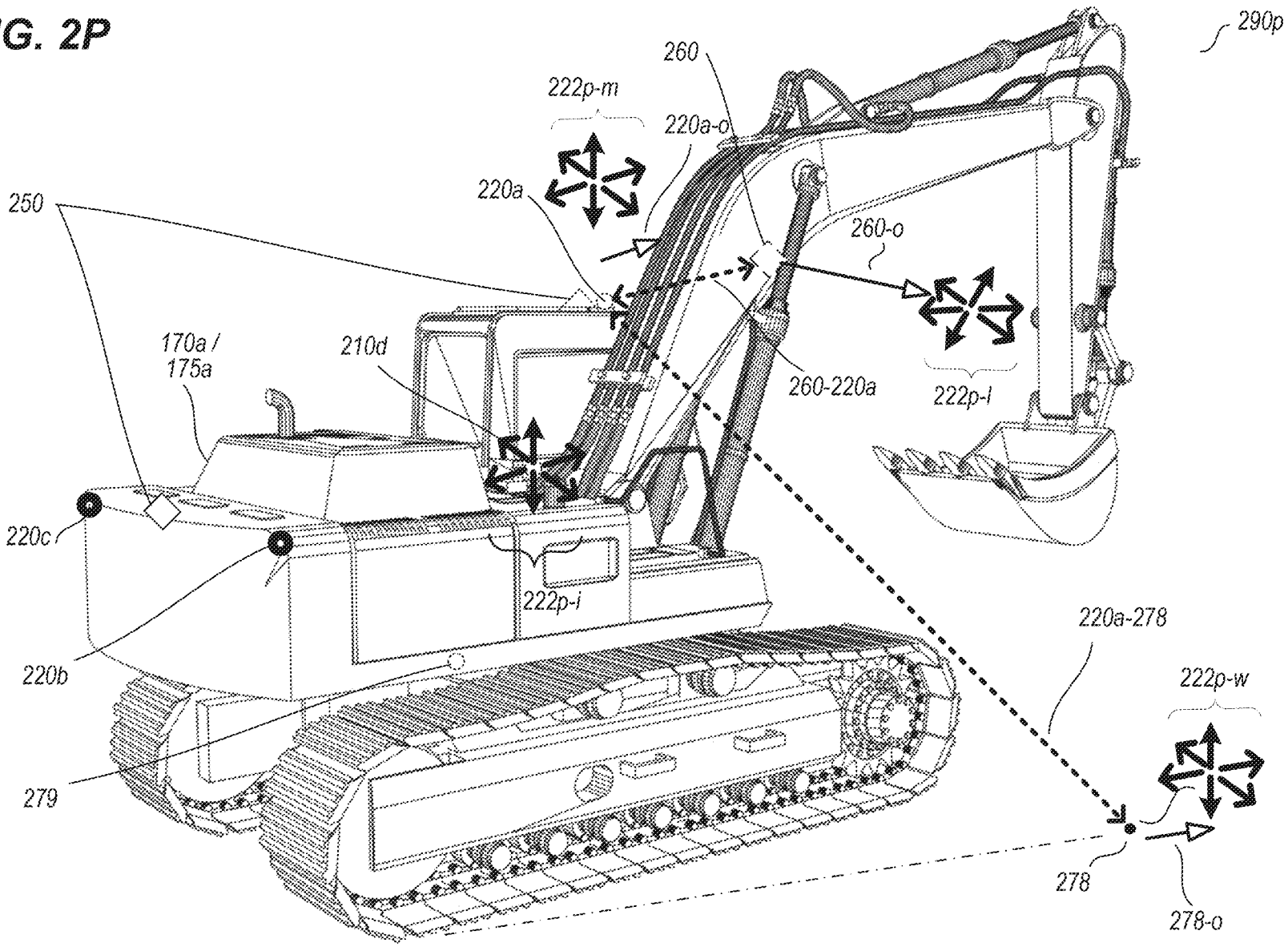

FIG. 2P illustrates an example of planning and/or performing automated operations of an earth-moving vehicle on a site in response to instructions from an EMVAOC system (not shown), including to perform operations related to calibrating on-vehicle sensors based in part on sensor position and orientation (e.g., to determine position and orientation of directional sensors on movable vehicle parts). In this example, an excavator vehicle 170*a*/175*a* is shown in a manner similar to that of FIG. 2B, but with additional information shown about a LiDAR sensor 260 that is located on the hydraulic boom arm of the excavator and obtains data 260-*o* in a local coordinate system 222*p-l* for the LiDAR sensor. A reference point 220*a* on the vehicle body is also shown that corresponds to a GPS sensor, and another sensor (e.g., an image sensor 250, etc.) at or near the same location obtains data 220*a-o* in a local coordinate system 220*p-m* for the other sensor, while another INS-DU or other IMU sensor 210*d* obtains data in a local coordinate system 222*p-i* for that sensor. In order to convert the LiDAR sensor data into a global common coordinate system 222*p-w* that is independent of the vehicle orientation (e.g., corresponds to a vehicle that is level both front-to-back and side-to-side), the EMVAOC system may in this example determine a first transformation 260-220*a* from the LiDAR sensor's local coordinate system to the separate local coordinate system of the other sensor at the 220*a* position, and a second transformation 220*a*-278 from the other sensor's separate local coordinate system to a point 278 having a known location and orientation in the global common coordinate system. If the reference point is elsewhere on the vehicle (e.g., a center point 279 at a lowest point on the body), the second transformation may instead be to it using a level vehicle orientation at that point, or a third transformation (not shown) may be determined from the position 278 to 279. These determined transformations may be used to calibrate the LiDAR sensor so that its data may be used in the global common coordinate system, including to be combined with other data from the other sensor 210*d* and/or the other sensor at position 220*a*, and with the calibration for the LiDAR system optionally repeated after any changes in the position or orientation of the LiDAR sensor (e.g., movement of the hydraulic boom arm, movement of the body with respect to position or orientation, etc.).

As noted above, the automated operations of the EMVAOC system may include calibrating on-vehicle sensors based in part on sensor position and orientation, such as to determine position and orientation of directional sensors on movable vehicle parts. In at least some embodiments and situations, the one or more on-vehicle sensors to be calibrated include one or more LiDAR sensors that are located at one or more positions on the powered earth-moving vehicle, including in some such embodiments on one or more movable component parts of the vehicle (e.g., a hydraulic arm, a tool attachment, etc.), and in some embodiments and situations, the one or more on-vehicle sensors to be calibrated include one or more cameras or other image sensors that are located at one or more positions on the powered earth-moving vehicle, including in some such embodiments on one or more movable component parts of the vehicle. In order to analyze different data sets gathered at different times from such a sensor (e.g., different groups of 3D data points gathered by a LiDAR sensor at different times), such as to combine or compare data of the different data sets, and/or to combine data of one or more such data sets with data of other data sets gathered from other sensors at other positions (e.g., other sensors of other types, one or more other sensors of the same type, etc.), a global common coordinate system or other global common frame of reference is first determined for the data sets. In order to determine such a global common coordinate system or other global common frame of reference for a data set from an on-vehicle sensor, the position of that sensor in 3D (three dimensional) space is determined at a time of gathering that data set, such as based on a relative position of that sensor to one or more other reference points with known locations in the global common coordinate system or other global common frame of reference—at least one such other reference point may be another point on the vehicle (e.g., a point on the vehicle that is not independently movable from the body, such as a point on the body), and the global common coordinate system or other global common frame of reference may in some embodiments be defined relative to that reference point (e.g., with that point given a coordinate of 0,0,0 in an X,Y,Z system, with the X position indicating horizontal distance forward or backward from that point parallel to the axis of the body, with the Y position indicating distance left or right from the point perpendicular to the axis of the body, and with the Z position indicating vertical distance above or below that point parallel to the axis of gravity), while in other embodiments may be an absolute system (e.g., GPS coordinates) in which the coordinates for that reference point within the absolute system are known or determinable. In order to place the data sets for each such on-vehicle sensor in the global common coordinate system or other global common frame of reference, one or more transformations (also referred to herein as "transforms") are determined between a local coordinate system or other local frame of reference relative to the position of that sensor and the global common coordinate system or other global common frame of reference, optionally with a first intermediate transformation from the sensor's local coordinate system or other local frame of reference to a local coordinate system or other local frame of reference for the other reference point on the vehicle (e.g., that reflects an orientation of the vehicle that may differ from that of the global common coordinate system or other global common frame of reference), and a second intermediate transformation from the reference point's local coordinate system or other local frame of reference to the global common coordinate system or other global common frame of reference. As one example using an on-vehicle LiDAR sensor, a data point $P^l$ in a local coordinate system for the LiDAR sensor may be converted to a data point $P^g$ in the global coordinate system using a first transformation $$T_v^g$$

from the sensor's local coordinate system to a local coordinate system for another reference point on the vehicle, and a second transformation $$T_l^v$$

from the reference point's local coordinate system to the global coordinate system. The second transformation may be determined, for example, by using a reference point on the vehicle at which a GPS sensor is located so that the GPS data point for that reference point may be determined, or by using a reference point on the vehicle from which a relative global common coordinate system is based and for which orientation data is known (e.g., from an INS-DU sensor or other IMU sensor) to determine a difference between the vehicle orientation at that reference point and the orientation for the global common coordinate system. The first transformation may be determined in various manners in various embodiments, with one non-exclusive example being to determine a calibration matrix to use for the first transformation for an example LiDAR sensor as follows:

$$\min \sum_{i,j} T_{m_i}^{w} \cdot C \cdot P^{l_i} - T_{m_j}^{w} \cdot C \cdot P^{l_j} \tag{1}$$

where C is the first transformation calibration matrix, w is the global common coordinate system, m is the local coordinate system for the reference point, l is the local coordinate system for the LiDAR sensor, i is a first LiDAR data set, and j is a second LiDAR data set. The following steps provide one non-exclusive example for implementing the formula (1) above.

(1) Obtain initial approximation of calibration matrix by manual measurement (e.g., obtain measurement between position of LiDAR sensor and point of reference point on the vehicle)

(2) Obtain N heavily overlapping 3D point clouds and corresponding readings for other vehicle sensors (e.g., GPS-RTK readings for localization and yaw measurements, and INS-DU readings for roll and pitch measurements), with slight differences in vehicle position and/or orientation ("pose") while keeping the vehicle static (3) Run a grid search varying LiDAR relative location and LiDAR relative orientation parameters, as follows:

(a) For each pair of samples, transform both point clouds using the LiDAR calibration matrix and sampled readings for other vehicle sensors into global common coordinates (b) Save the parameters that maximize the overlap between the two point created point clouds in the global common coordinate frame (4) Run a grid search on a coarser grid with the same parameters, as follows:

(a) For each pair of samples, run an ICP (iterative closest point) algorithm to provide optimal matching between the points (b) Save the parameters that minimize the ICP's predicted refinement with following criteria $$J = \frac{1}{N} \cdot \sum_{i=1}^{N} \delta_{tr}^{i} + \alpha \cdot \delta_{rot}^{i} \tag{2}$$

where J is the optimization function being minimized in (4)(a), $delta_{tr}$ is absolute translation predicted by the ICP algorithm, $delta_{r}$ is absolute rotation predicted by the ICP algorithm, and $\alpha$ is a ratio between errors in translation and rotation to combine $delta_{tr}$ and $delta_{r}$. Additional details are included below related to implementing automated operations for calibrating on-vehicle sensors based in part on sensor position and orientation.

Figure 2Q:
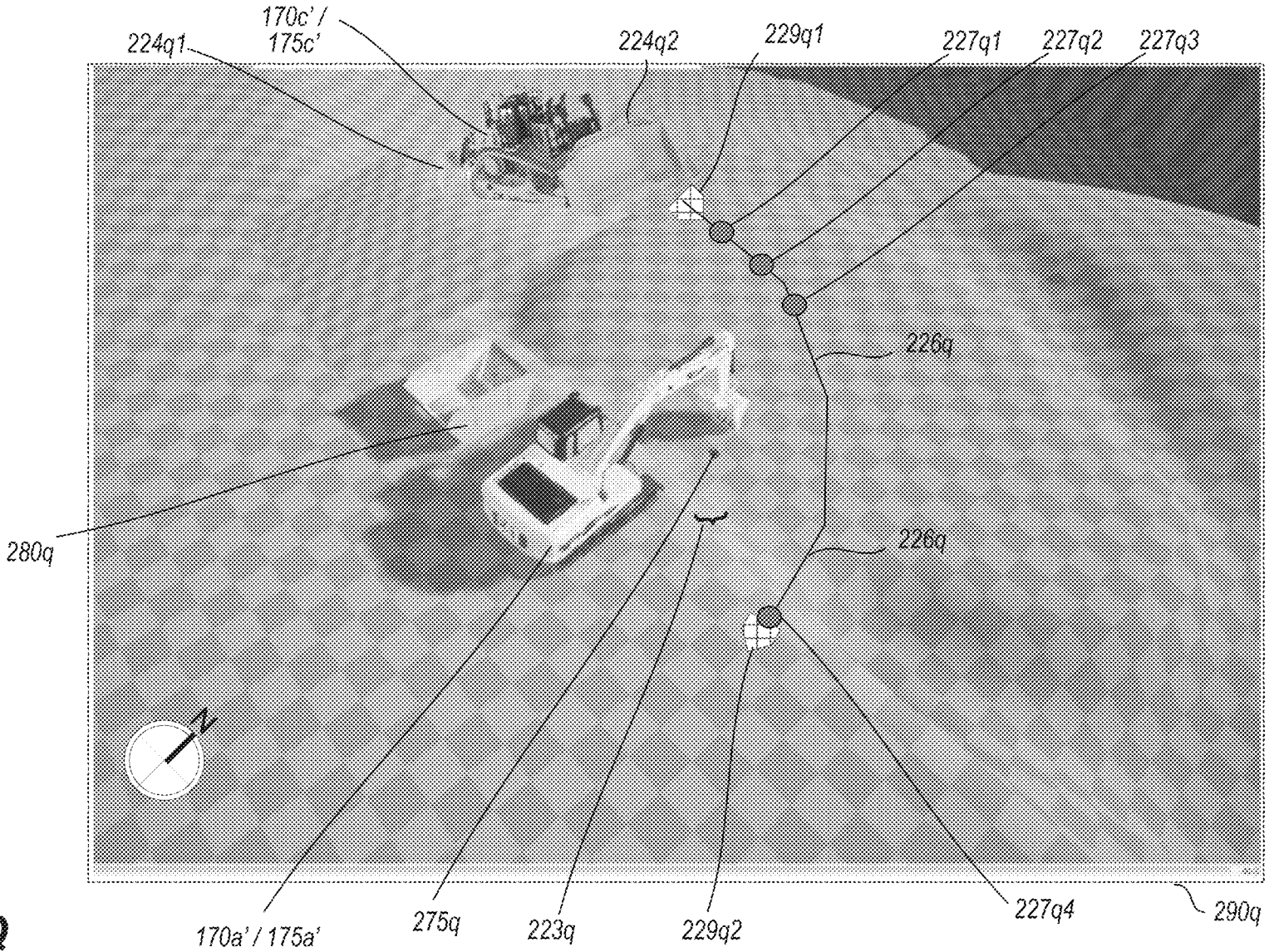

FIG. 2Q continues the examples of FIG. 2P, and illustrates information 290*q* showing an example of calibration activities used in at least one embodiment to calibrate a LiDAR sensor (not shown), which in this example is positioned on a bulldozer vehicle 170*c*'/175' (e.g., in a manner similar to that discussed with respect to FIGS. 2D-2F, such as on a hydraulic arm connecting the body and front tool attachment, on the front tool attachment, on a front portion of the body, etc.)—in this example, the bulldozer vehicle includes a front tool attachment 224*q*2 that is a bucket or blade tool, and a rear tool attachment 224*q*1 that is a ripper tool. In addition to the bulldozer vehicle, an additional excavator vehicle 170*a*'/175*a*' is shown beside a storage bin 280*q*, with the excavator vehicle being involved in a task that includes lifting a rock or other object 275*q* and depositing it in the storage bin, and with the object being on a lower level than the excavator vehicle due to a decline 223*q* in front of the excavator vehicle. In this example, the automated operations include capturing LiDAR data as the bulldozer vehicle moves along a predefined trajectory 226*q* beginning at starting location 229*q*1 and generates a 3D point cloud (not shown, and such as in a manner similar to that illustrated in FIG. 2-O) at each of multiple vehicle positions 227*q* along the movement path, such as positions 227*q*1, 227*q*2, 227*q*3, etc., while simultaneously capturing other sensor data from on-vehicle sensors for at least the same vehicle positions 227*q*—such other sensor data may include, for example, IMU (inertial measurement unit) data for at least inclinometers positioned on the vehicle (e.g., on the movable component part(s) on which the LiDAR sensor(s) are mounted, on the body, etc.), GPS location data, RTK (real-time kinematic) correction data for the GPS data, etc. The trajectory followed by the LiDAR sensor may then be determined by analyzing the LiDAR data, such as using CT-ICP (continuous-time iterative closest point) processing, and a best fitting transformation is then determined between the mount location (not shown) of the LiDAR sensor on the bulldozer vehicle and an additional reference point (not shown) on the bulldozer vehicle, such as a reference point at a lowest center point of the body or at which a GPS sensor is located (e.g., in a manner similar to that discussed with respect to FIGS. 2D-2F)—this transformation to a position having associated GPS data points (optionally RTK-corrected GPS data) enables extending absolute GPS data position of the reference point in a global common coordinate system to the position of the LiDAR sensor and the LiDAR data generated relative to it. In at least some embodiments, the position of the LiDAR sensor being calibrated is maintained at a constant position relative to a reference point on the vehicle (e.g., on the vehicle body), such as by not changing a position of a movable component of the vehicle on which the LiDAR sensor is positioned during the calibration activities—if so, the transformation may be determined between the constant position of the LiDAR sensor and the position of the reference sensor, using the current constant position of the LiDAR sensor based on the current position of the movable vehicle component on which the LiDAR sensor is attached and as represented using associated inclinometer data or other IMU data gathered for that movable component during the calibration activities. In other embodiments, the position of the LiDAR sensor being calibrated may be modified relative to the reference point on the vehicle one or more times during the calibration, such as to generate a transformation for each position of the LiDAR sensor, and to optionally unify the multiple transformations using the differing position information for the movable vehicle component on which the LiDAR sensor is mounted. In addition, after one or more initial transformations are determined for the LiDAR sensor based on the data gathered at positions 227*q*, a further optimization phase is performed to refine the determined transformation(s) by having the bulldozer vehicle travel a longer distance to end point 229*q*2 while similarly capturing LiDAR data and other sensor data, and performing similar analyses, as well as applying transformations to reflect the rotational differences between the LiDAR sensor mount position and a different reference point on the vehicle (e.g., the position at which a GPS sensor is mounted).

Figure 2R:
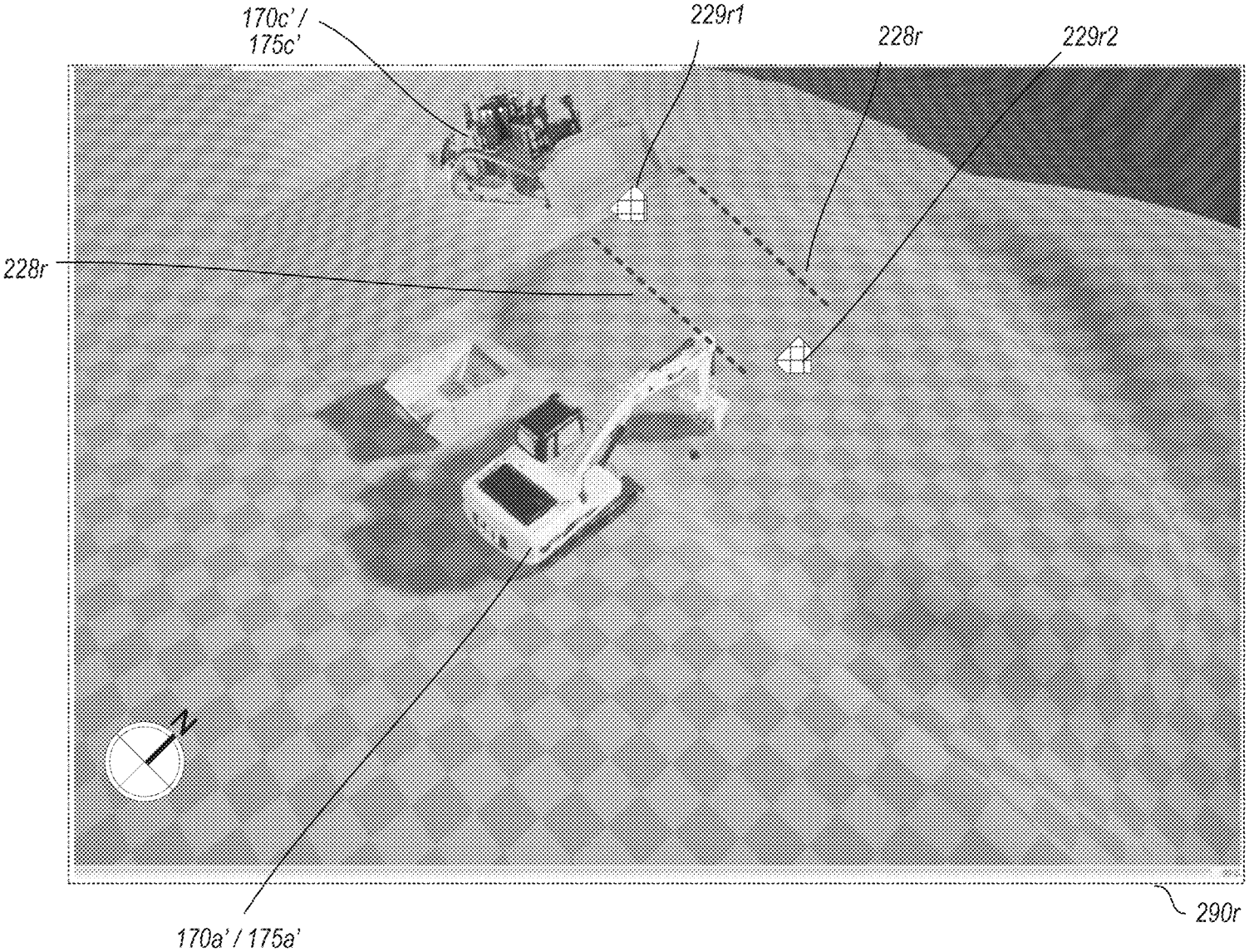

FIG. 2R continues the examples of FIGS. 2P-2Q, and illustrates information 290*r* showing an example of using previously calibration for a LiDAR sensor (not shown) mounted on the bulldozer vehicle 170*c*'/175*c*' (e.g., in a manner discussed with respect to FIGS. 2D-2F), and in particular to perform lane reconstruction operations for travel and other vehicle operations of the bulldozer vehicle along travel lane 228*r* (e.g., to push dirt, not shown) between start location 229*r*1 and end location 229*r*2. In particular, in this example the LiDAR data and optionally other sensor data during the vehicle operations is analyzed to determine the vehicle motion and the vehicle front tool attachment movement and resulting change in the surrounding environment (e.g., the surface along the travel path being flattened/smoothed), and optionally to further use that determined vehicle operations data (e.g., to compare to a planned travel path and associated task of pushing materials to verify whether the task was correctly performed).

Figure 2S:
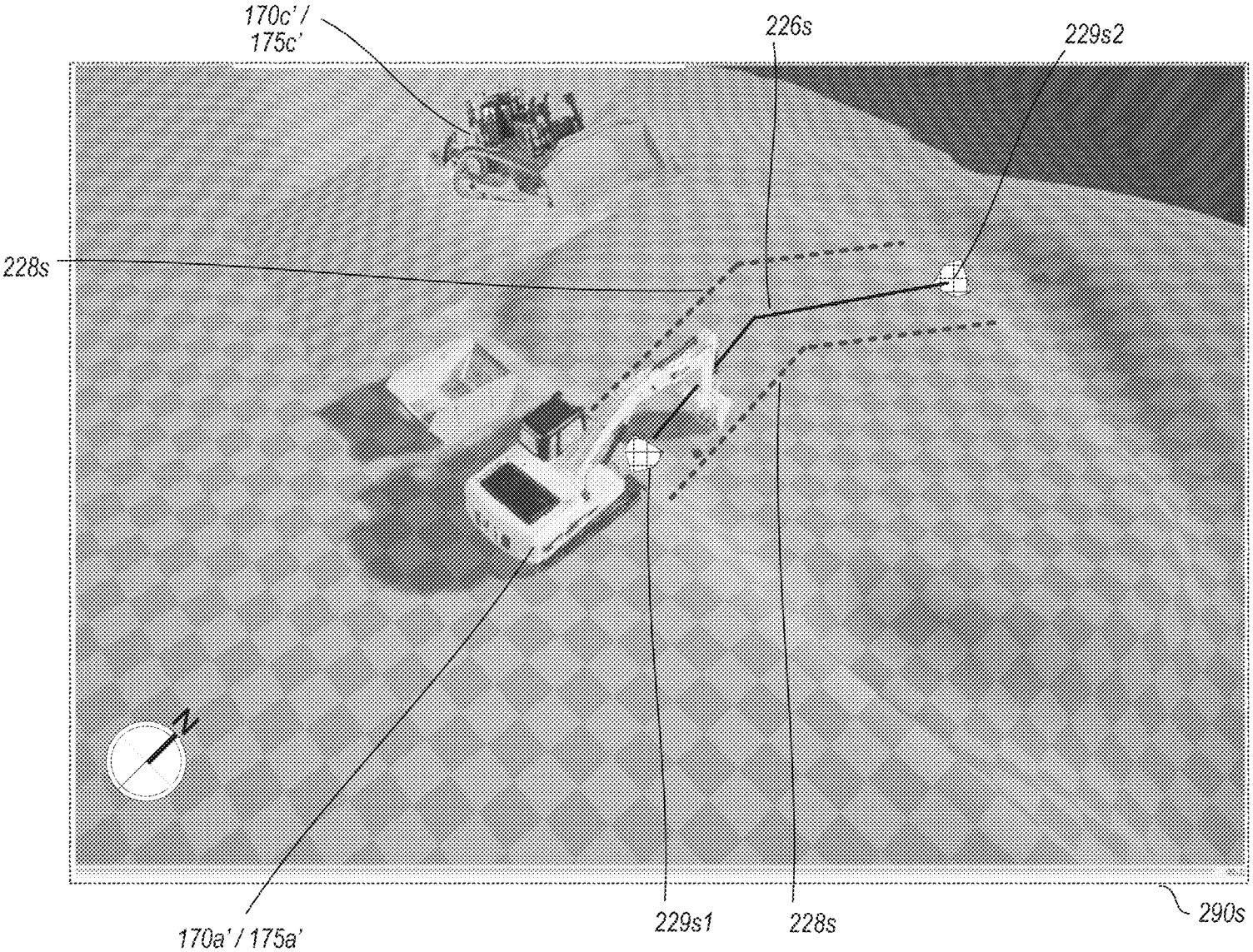

FIG. 2S continues the examples of FIGS. 2P-2R, and illustrates information 290*s* showing an example of using previously calibration for a LiDAR sensor (not shown) mounted on the excavator vehicle 170*a*'/175*a*' (e.g., in a manner discussed with respect to FIGS. 2A-2C and 2P), and in particular to perform lane reconstruction operations for travel and other vehicle operations of the excavator vehicle along travel lane 228*s* between start location 229*s*2 and end location 229*s*1 (e.g., to dig a trench 226*s*, not shown). In particular, in this example the LiDAR data and optionally other sensor data captured during the vehicle operations is analyzed to determine the vehicle motion and the vehicle front tool attachment movement and resulting change in the surrounding environment (e.g., the surface along the travel path being removed to form a trench), and optionally to further use that determined vehicle operations data (e.g., to compare to a planned travel path and associated task of trench construction to verify whether the task was correctly performed).

In addition, the information in FIGS. 2Q-2S is shown in part using rendered visualizations in this example (e.g., as part of a simulation determined by a planning module for one or more actual powered earth-moving vehicles on an actual job site, before initiating autonomous operations of actual powered earth-moving vehicle(s) to implement a selected movement plan on that actual job site, including to potentially move and/or avoid certain obstacles and/or to take other types of actions). It will be appreciated that the details of FIGS. 2Q-2S are provided for exemplary purposes, and that the invention is not limited to these details. As one non-exclusive example, while excavator and bulldozer vehicles are illustrated in these examples, other powered construction and/or mining and/or military and/or police and/or farming vehicles (e.g., vehicles that the same or similar types of tool attachments as discussed above) may similarly employ such operations. It will also be appreciated that various other types of operations, obstacles, safety configuration data, and powered earth-moving vehicles may be used in other embodiments and situations. In addition, as discussed elsewhere herein, prohibited 3D positions and vehicle movement/motion plan positions may be represented in various manners in various embodiments, including using angle-based representations, XYZ representations, etc., as well as using different types of representations for different types of vehicles (e.g., for a vehicle with only one or more initial hydraulic arms extending from the body but not having additional hydraulic arms connected to those initial hydraulic arms, to use only one angle to represent the initial hydraulic arm(s), and one or more additional angles to represent a tool attachment connected to the initial hydraulic arm(s)). For example, when using angle-based representations, a space may be defined around a current position of a point on a powered earth-moving vehicle based on the angles (e.g., for an excavator vehicle, based on cabin_rotation (a), boom_angle (b), stick_angle (c) and optionally attachment_angle (d)), and all attachment/arm positions may be precalculated and hashed for optimization purposes, such as using a grid search in the range of those angles, and optionally doing conversions from Euclidian space if needed (e.g., to convert 3D points for the surrounding environment to the angle-based representations). In addition, a global coordinate system for a site or other area around a powered earth-moving vehicle may in some embodiments and situations be specified in an absolute manner (e.g., using GPS coordinates), and in other embodiments and situations may be specified in a manner relative to a position of one or more points on the powered earth-moving vehicle, such as to measure X coordinates as distances in front of or back of the vehicle point(s) using a current forward orientation of the vehicle, to measure Y coordinates as distances to the left or right of the vehicle point(s) using that current forward orientation, and to measure Z coordinates as distances above or below the vehicle point(s), using a level vehicle orientation for the coordinates even if the actual vehicle orientation is non-level (e.g., is tilted in one or more of the pitch or roll dimensions).

The EMVAOC system may further perform additional automated operations in at least some embodiments as part of determining a motion/movement plan that includes a powered earth-moving vehicle moving from a current location to one or more target destination locations, with non-exclusive examples including the following: having the powered earth-moving vehicle create a road (e.g., by flattening or otherwise smoothing dirt or other materials of the terrain between the locations) along a selected path as part of the motion/movement plan, including to optionally select that path from multiple alternative paths based at least in part on a goal involving creating such a road at such a location; considering environmental conditions (e.g., terrain that is muddy or otherwise slick/slippery due to water and/or other conditions), including in some embodiments and situations to adjust classifications of some or all obstacles in an area between the current and target destination locations to reflect those environmental conditions (e.g., temporarily, such as until the environmental conditions change); considering operating capabilities of that particular vehicle and/or of a type of that particular vehicle (e.g., attachments, size, load weight and/or material type limits or other restrictions, etc.), including in some embodiments and situations to adjust classifications of some or all obstacles in an area between the current and target destination locations to reflect those operating capabilities (e.g., temporarily, such as for planning involving that particular vehicle and/or vehicle type); using motion/movement of some or all of the vehicle to gather additional data about the vehicle's environment (e.g., about one or more possible or actual obstacles in the environment), including in some embodiments and situations to adjust position of a moveable part of the vehicle (e.g., hydraulic arm, tool attachment, etc.) on which one or more sensors are mounted to enable gathering of the additional data, and/or to move location of the vehicle to enable one or more sensors that are mounted at fixed and/or moveable positions to gather the additional data; performing obstacle removal activities for an obstacle that include a series of actions by one or more powered earth-moving vehicles, such as involving moving a large pile of dirt (e.g., requiring numerous scoops, pushes or other actions), flattening or otherwise leveling some or all of a path (e.g., digging through a hill or other projection of material, filling a hole or ravine or other cavity, etc.); etc.

The EMVAOC system may perform other automated operations in at least some embodiments, with non-exclusive examples including the following: tracking motion/movement of one or more obstacles (e.g., people, animals, vehicles, falling or sliding objects, etc.), including in response to instructions from the EMVAOC system for those obstacles to move themselves and/or to be moved; tracking objects on some or all of a job site as part of generating analytics information, such as using data from a single powered earth-moving vehicle on the site or by aggregating information from multiple such earth-moving vehicles, including information of a variety of types (e.g., about a number of vehicles of one or more types that are currently on the site or have passed through it during a designated period of time; about a number of people of one or more types, such as workers or visitors, that are currently on the site or have passed through it during a designated period of time; about activities of a particular vehicle and/or a particular person at a current time and/or during a designated period of time, such as vehicles and/or people that are early or late with respect to a defined time or schedule, identifying information about vehicles and/or people such as license plates or RFID transponder IDs or faces or gaits; about other types of site activities, such as material deliveries and/or pick-ups, tasks being performed, etc.); etc.

Various details have been provided with respect to FIGS. 2A-2S, but it will be appreciated that the provided details are non-exclusive examples included for illustrative purposes, and other embodiments may be performed in other manners without some or all such details. For example, multiple types of sensors may be used to provide multiple types of data and the multiple data types may be combined and used in various ways in various embodiments, including non-exclusive examples of magnetic sensors and/or IMUs (inertial measurement units) to measure position data and whether in addition to or instead of the use of GPS and inclinometer data.

Figure 3A:
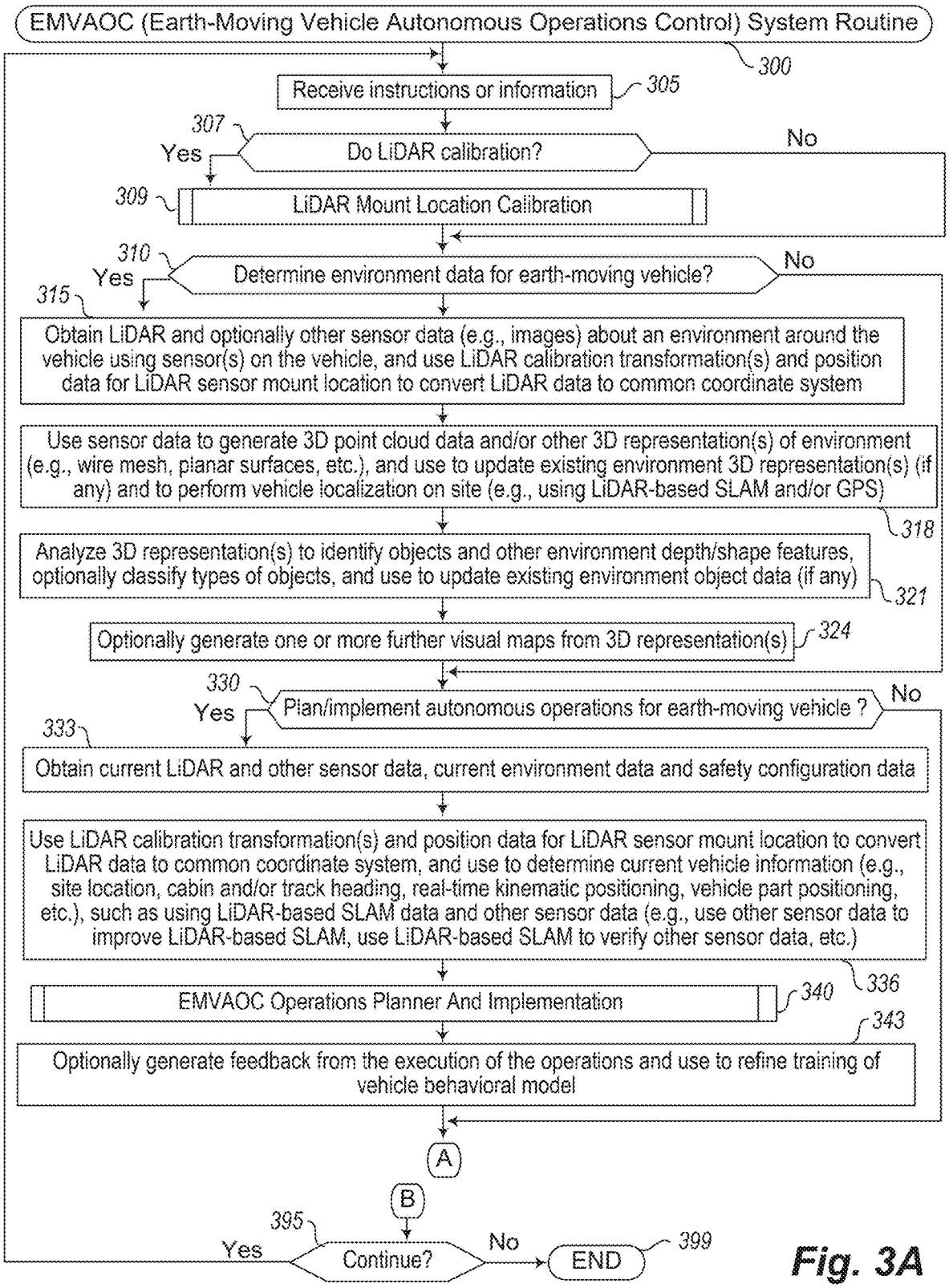

FIGS. 3A-3B are an example flow diagram of an illustrated embodiment of an EMVAOC (Earth-Moving Vehicle Autonomous Operations Control) System routine 300. The routine may be provided by, for example, execution of an embodiment of the EMVAOC system 140 of FIGS. 1A-1B and/or the EMVAOC system discussed with respect to FIGS. 2A-2S and elsewhere herein, such as to perform automated operations for implementing autonomous control of powered earth-moving vehicles, including to use data gathered by on-vehicle LiDAR sensors and other on-vehicle sensors to perform automated LiDAR-based SLAM vehicle positioning operations. While routine 300 is discussed with respect to controlling operations of a single powered earth-moving vehicle at a time, it will be appreciated that the routine 300 may be performed in other manners in other embodiments, including to control operations of multiple powered earth-moving vehicles of one or more types on a job site, to be implemented by one or more configured devices or systems (optionally in multiple locations and/or operating in a distributed or otherwise coordinated manner, such as with a computing device local to a powered earth-moving vehicle performing some of the automated operations while one or more remote server systems in communication with that computing device perform additional portions of the routine), etc.

The routine 300 begins in block 305, where instructions or other information are received (e.g., waiting at block 305 until such instructions or other information is received). The routine continues to block 307 to determine whether the instructions or information received in block 305 indicate to do calibration of one or more LiDAR sensors on a powered earth-moving vehicle, and if so continues to block 309 to perform a LiDAR Mount Location Calibration subroutine, with one example of such a routine being illustrated in FIG. 4. After block 309, or if it is instead determined that the instructions or information received in block 305 do not indicate to perform calibration of LiDAR sensor(s) on a powered earth-moving vehicle, the routine continues to block 310 to determine whether the instructions or information received in block 305 indicate to determine environment data for the earth-moving vehicle (e.g., using calibrated LiDAR sensors and optionally image sensors and/or other sensors located on the vehicle), and if so continues to perform blocks 315-324—in at least some embodiments, sensor data may be gathered repeatedly (e.g., continuously), and if so at least block 315 may be performed for each loop of the routine and/or repeatedly while the routine is performing other activities or otherwise waiting (e.g., at block 305) to perform other activities. In block 315, the routine in this example embodiment obtains LiDAR data and optionally other sensor data (e.g., one or more images) for an environment around the powered earth-moving vehicle using sensors positioned on the vehicle and optionally additional other sensors on or near the vehicle (e.g., for multiple powered earth-moving vehicles on a job site to share their respective environment data, whether in a peer-to-peer manner directly between two or more such vehicles, and/or by aggregating some or all such environment data in a common storage location accessible to some or all such vehicles), and with obtained data converted into a global coordinate system based in part on the determined calibration data (e.g., a determined transformation for the LiDAR component) and on current position information for the vehicle part on which the LiDAR component is mounted. In block 318, the routine then uses the sensor data to generate 3D point cloud data and optionally one or more other 3D representations of the environment (e.g., using wire mesh, planar services, voxels, etc.), such as in the global coordinate system, and uses the generated 3D representation(s) to update other existing environment data (if any). As discussed in greater detail elsewhere herein, such sensor data may be gathered repeatedly (e.g., continuously), such as in a passive manner for whatever direction the sensor(s) on the vehicle are currently facing and/or in an active manner by directing the sensors to cover a particular area of the environment that is of interest (including moving parts of the vehicle on which the sensors are mounted or otherwise attached to move the sensors to new positions from which additional data may be obtained), and environment information from different scans of the surrounding environment may be aggregated in the global coordinate system as data from new areas becomes available and/or to update previous data for an area that was previously scanned. In block 321, the routine then continues to analyze the 3D representation(s) to identify objects and other environment depth and shape features, to classify types of the objects as obstacles with respect to operations of the vehicle, and to update other existing information about such objects (if any). As discussed in greater detail elsewhere herein, such obstacle data and other object data may be used in a variety of manners, including by a planner module to determine autonomous operations for the vehicle to perform. In block 324, the routine then optionally generates one or more visual maps of some or all of the vehicle's site using the determined environment data, including to optionally update one or more previous visual maps if available.

After block 324, or if it is instead determined in block 310 that the instructions or information received in block 305 do not indicate to determine environment data for an earth-moving vehicle, the routine continues to block 330 to determine whether the instructions or information received in block 305 indicate to plan and implement autonomous operations of one or more earth-moving vehicles involving vehicle motion and/or tool attachment movement of some or all of one or more powered earth-moving vehicles on a job site to conform with specified safety rules or other specified safety configuration data, such as while performing one or more tasks and/or multi-task jobs (e.g., to identify one or more target destination locations and optionally tasks to be performed as part of vehicle motion to reach the target destination location(s), such as to create roads along particular paths and/or to remove particular obstacles), and including using environment data for the vehicle (e.g., data just determined in blocks 315-324), and if so continues to perform blocks 333-343 to perform the autonomous operations control. In block 333, the routine obtains current status information for the earth-moving vehicle(s) (e.g., sensor data for the earth-moving vehicle(s)), current environment data for the vehicle(s), and safety configuration data to use (e.g., as received in block 305, as retrieved from storage, etc.). After block 333, the routine continues to block 336, where it uses the determined LiDAR calibration data and current position information for the LiDAR component's position to convert the LiDAR data into the global coordinate system, and to use the data to determine additional information about the earth-moving vehicle (e.g., one or more of the earth-moving vehicle's on-site location, real-time kinematic positioning, cabin and/or track heading, positioning of parts of the earth-moving vehicle such as the arm(s)/bucket, particular attachments and/or other operational capabilities of the vehicle, etc.)—in at least some embodiments, the determination of vehicle positioning is performed at least in part using LiDAR-based SLAM processing. In block 340, the routine then submits input information to an EMVAOC Operations Planner And Implementation subroutine to determine and implement one or more movement/motion plans in light of the safety configuration data (e.g., implementing gradual turning activities, specifying planned pause instructions that will initiate controlled stoppage, implementing planned balancing-related operations balancing-related operations, avoiding prohibited 3D positions, etc.) and optionally one or more tasks and/or jobs to perform—one example of such a subroutine is discussed in greater detail with respect to FIGS. 5A-5C. After block 340, the routine in block 343 optionally generates feedback from the execution of the operations for use in subsequent refinement of the earth-moving vehicle behavioral model's training.

After block 343, or if it is instead determined in block 330 that the information or instructions received in block 305 are not to plan and implement automated operations of earth-moving vehicle(s), the routine continues instead to block 350 to determine if the information or instructions received in block 305 are to use LiDAR-based SLAM techniques to reconstruct vehicle operations (e.g., during fully autonomous operations), and if so the routine continues to block 353 to retrieve LiDAR data and other sensor data gathered for a prior period of time (e.g., corresponding to performance of one or more tasks). In block 356, the routine then performs a SLAM-based analysis on the retrieved data to determine the vehicle's motion and tool attachment(s)' movements during the prior period of time, and further determines attributes of any tasks performed with the vehicle attachment(s) during the prior period of time (e.g., material pushed, area dug, etc.). In block 360, the routine then provides information about the determined travel path and determined task attributes (if any).

After block 360, or if it is instead determined in block 350 that the information or instructions received in block 305 are not to use LiDAR-based SLAM techniques to reconstruct a travel lane or other vehicle operations, the routine continues instead to block 365 to determine if the information or instructions received in block 305 are to use environmental data for other purposes (e.g., for environmental data just generated in blocks 315-324), and if so the routine continues to block 368. In block 368, the routine obtains current environmental data, with newly obtained environmental data converted into a global coordinate system based in part on determined calibration data and current position information for the vehicle part on which the respective sensor(s) are located, and uses the environment data to perform one or more additional types of automated operations. Non-exclusive examples of such additional types of automated operations include the following: tracking movement of one or more obstacles (e.g., people, animals, vehicles, falling or sliding objects, etc.), including in response to instructions issued by the EMVAOC system for those obstacles to move themselves and/or to be moved; generating analytics information, such as tracking objects on some or all of a job site using data only from the earth-moving vehicle or by aggregating information from data from the earth-moving vehicle with data from one or more other earth-moving vehicles (e.g., about locations and/or activities of one or more other vehicles and/or people); etc.

If it is instead determined in block 365 that the information or instructions received in block 305 are not to use environment data for other purposes, the routine continues to block 390 to perform one or more other indicated operations as appropriate, such as if so indicated in the instructions or other information received in block 305. For example, the operations performed with respect to block 390 may include receiving and storing data and other information for subsequent use (e.g., safety configuration data, including thresholds and other settings to use for balancing-related operations and/or for slippage-related operations on a sloped and/or slick surface and/or for slippage-related operations related to vehicle pitch tilting and/or for controlled stoppage of a vehicle in motion and/or for performing gradual vehicle turning; actual and/or simulated operational data; sensor data; an overview workplan and/or other goals to be accomplished, such as for the entire project, for a day or other period of time, and optionally including one or more tasks to be performed; etc.), receiving and storing information about earth-moving vehicles on the job site (which vehicles are present and operational, status information for the vehicles, etc.), receiving and responding to requests for information available to the EMVAOC system (e.g., for use in a displayed GUI to an operator user that is assisting in activities at the job site and/or to an end user who is monitoring activities), receiving and storing instructions or other information provided by one or more users and optionally initiating corresponding activities, etc. While not illustrated here, in some embodiments the routine may perform further interactions with a client or other end user, such as before, during or after receiving or providing information in block 390, as discussed in greater detail elsewhere herein. In addition, it will be appreciated that the routine may perform operations in a synchronous and/or asynchronous manner.

After blocks 368 or 390, the routine continues to block 395 to determine whether to continue, such as until an explicit indication to terminate is received, or instead only if an explicit indication to continue is received. If it is determined to continue, the routine returns to block 305 to wait for additional information and/or instructions, and otherwise continues to block 399 and ends.

Figure 4:
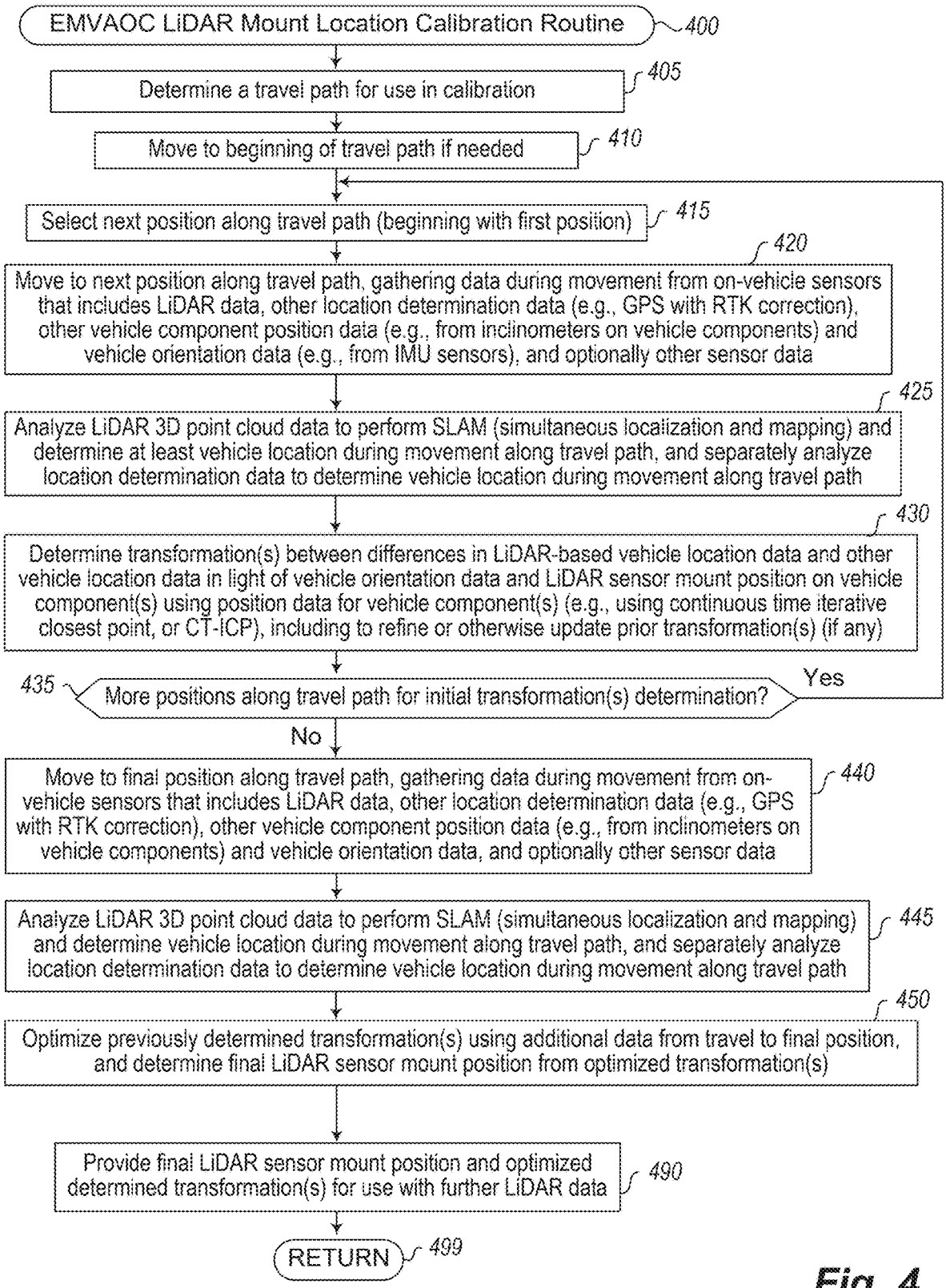
FIG. 4 is an example flow diagram of an illustrated embodiment of an EMVAOC SLAM-Based LiDAR Position/Orientation Calibration module routine.

FIG. 4 is an example flow diagram of an illustrated embodiment of an EMVAOC SLAM-Based LiDAR Mount Location Calibration routine 400. The routine may be provided by, for example, execution of an embodiment of module 146 of the EMVAOC system 140 of FIGS. 1A-1B and/or the EMVAOC system discussed with respect to FIGS. 2A-2S and elsewhere herein, such as to perform automated operations related to determining calibration information for one or more on-vehicle LiDAR sensors. The routine 400 may be invoked in various manners, including in block 309 of the EMVAOC System routine 300 as discussed in FIGS. 3A-3B, and if so may return to its invocation location after the routine returns. While routine 400 is discussed with respect to performing operations for a single LiDAR sensor of a single powered earth-moving vehicle at a time, it will be appreciated that the routine 400 may be performed in other manners in other embodiments, including to perform such operations for multiple powered earth-moving vehicles of the same type and/or multiple types on a job site, to perform corresponding operations for multiple LiDAR sensors on each of one or more powered earth-moving vehicles (e.g., simultaneously, serially, etc.), to be implemented by one or more configured devices or systems (optionally in multiple locations and/or operating in a distributed or otherwise coordinated manner, such as with a computing device local to a powered earth-moving vehicle performing some of the automated operations while one or more remote server systems in communication with that computing device perform additional portions of the routine), etc.

The routine begins in block 405, where it determines a travel path for the vehicle to use in calibration activities, such as to use a predefined travel path. In block 410, the routine then initiates automated operations to move the powered earth-moving vehicle to a beginning of the determined travel path, if not already there. The routine then performs a loop of blocks 415-430 for each of multipole positions along the travel path to determine an initial calibration transformation between a mount point or other attachment location of a LiDAR sensor on the powered earth-moving vehicle. In particular, the routine in block 415 selects a next position on the travel path at which to gather LiDAR and other sensor data, beginning with the first position (e.g., a location that is a specified distance along the travel path, etc.), and in block 420 moves to the selected position, gathering data during movement from on-vehicle sensors that includes LiDAR data, other location determination data (e.g., GPS with RTK correction), other vehicle component position data (e.g., from inclinometers on vehicle components) and vehicle orientation data (e.g., from one or more inclinometers on the vehicle body), and optionally other sensor data. In block 425, the routine then analyzes the gathered LiDAR 3D point cloud data to perform SLAM processing, including to determine at least the powered earth-moving vehicle's location during movement along the travel path, and separately analyzes captured GPS data or other location determination data to separately determine the vehicle location during movement along travel path with respect to a global common coordinate system in use. In block 430, the routine then determines one or more transformation(s) between the LiDAR sensor attachment position and that of a reference point associated with the global common coordinate system, such as based on differences in the LiDAR- based vehicle location data and other vehicle location data (e.g., RTK-corrected GPS data) in light of vehicle orientation data and position data for a vehicle component to which the LiDAR sensor is attached (e.g., using continuous time iterative closest point, or CT-ICP), including to optionally refine or otherwise update prior transformation(s) (if any) for the second and subsequent passes through the loop.

In block 435, the routine then determines if there are more positions on the travel path for which to gather further LiDAR data, and if so returns to block 415 to select a next position to which the powered earth-moving vehicle will travel. Otherwise, the routine continues to perform blocks 440-450 to optimize the transformation(s) determined in block 430. In particular, the routine in block 440 initiates automated operations of the powered earth-moving vehicle to move to a final position along the travel path, and gathers data during movement from on-vehicle sensors that includes LiDAR data and other sensors in a manner similar to block 420. In block 445, the routine proceeds to analyze the further gathered LiDAR 3D point cloud data to perform further SLAM processing in a manner similar to block 425, including to determine the vehicle location during the further movement along the travel path based on the SLAM processing and to separately analyze other gathered location determination data to separately determine the vehicle location during the movement along the travel path. In block 450, the routine then optimizes the previously determined transformation(s) using additional data from the travel to the final position, such as by performing further CT-ICP analysis, and determines a final LiDAR sensor mount location corresponding to the optimized transformation(s). In block 490, the routine then provides the determined final LiDAR sensor mount location and optimized determined transformation(s) for use with further gathered LiDAR data, and returns at block 499.

Figure 5A:
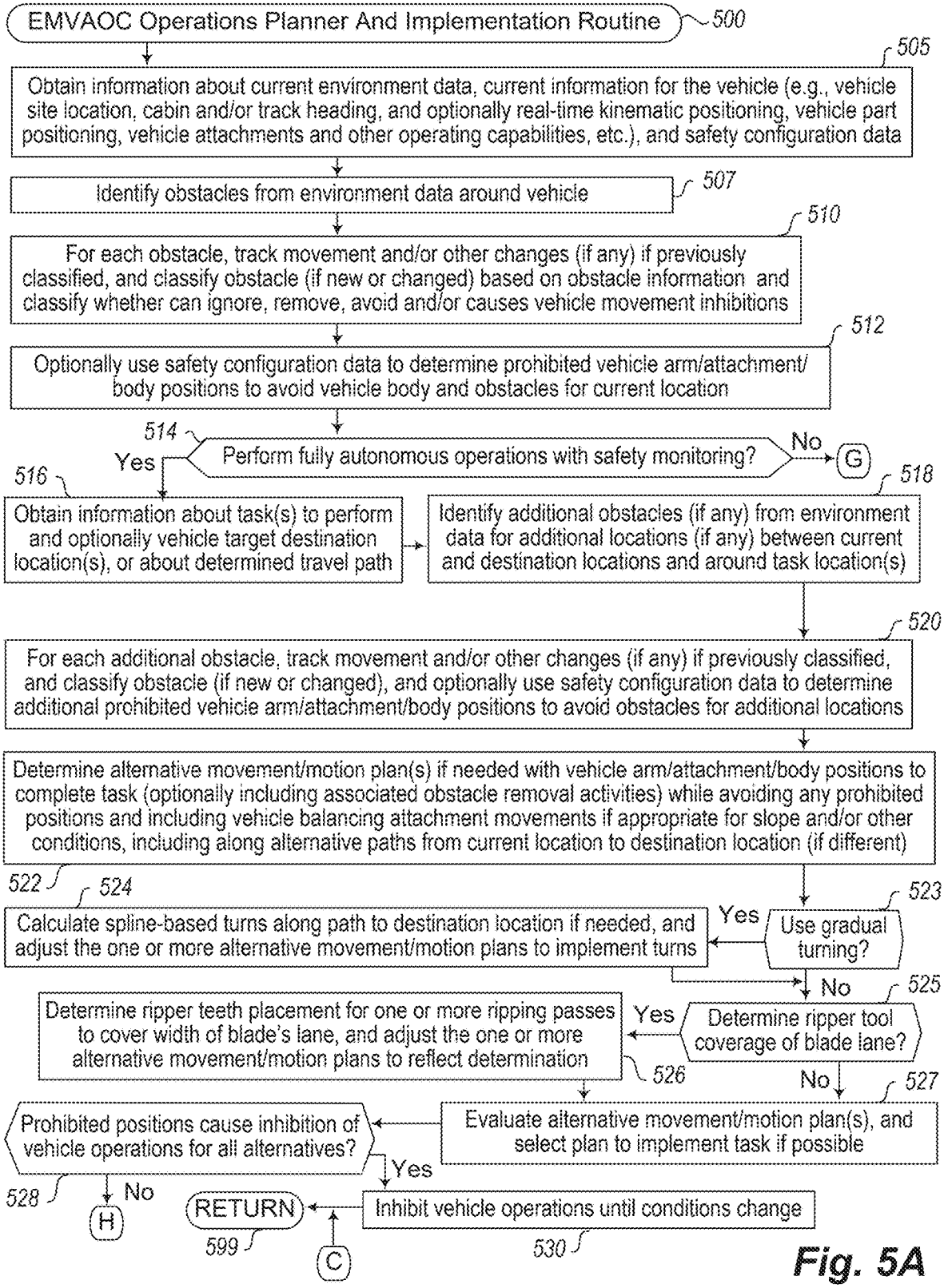
Figure 5B:
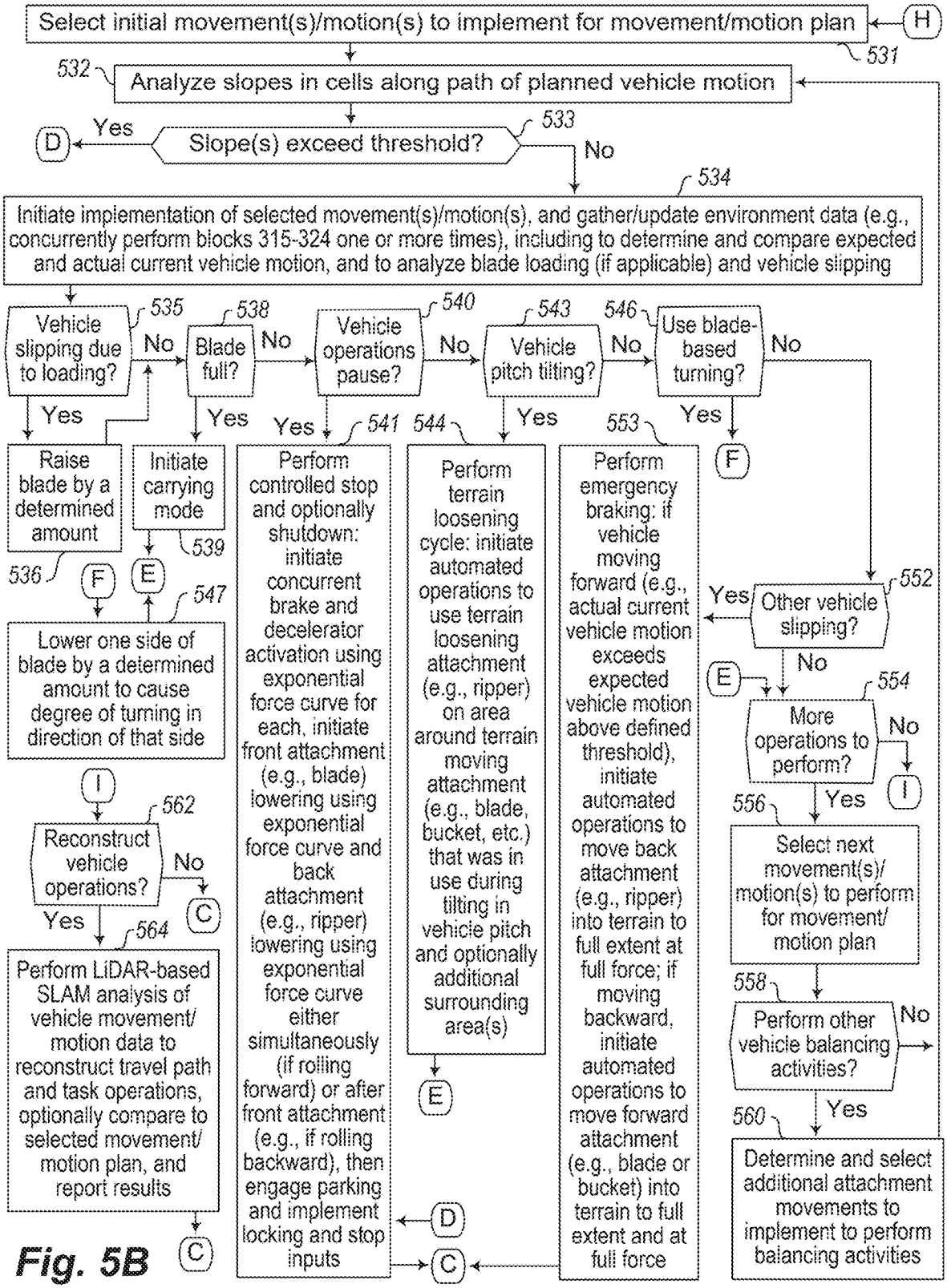

FIGS. 5A-5C are an example flow diagram of an illustrated embodiment of an EMVAOC (Earth-Moving Vehicle Autonomous Operations Control) Operations Planner And Implementation routine 500. The routine may be provided by, for example, execution of an embodiment of modules 147 and/or 145 and/or 146 of the EMVAOC system 140 of FIGS. 1A-1B and/or the EMVAOC system discussed with respect to FIGS. 2A-2S and elsewhere herein, such as to perform automated operations related to determining tasks to perform and determining additional operations to implement as part of such task performance if specified criteria occur (e.g., related to vehicle slippage, tilting, operational pauses, gradual turning, balancing, controlling loading of a blade tool attachment, controlling vehicle steering using a blade tool attachment, controlling use of a ripper tool attachment to loosen ground materials for subsequent blade tool operations, managing vehicle motion based in part on the slope of surrounding surfaces, calibrating on-vehicle sensors based in part on sensor position and orientation, etc.), including analyzing information about an environment of a powered earth-moving vehicle and determining corresponding information (e.g., slopes and other non-level surfaces, potential obstacles, classifications of the types of the obstacles, etc.), and determining how to accomplish a goal that includes controlling vehicle motion and/or attachment movement of one or more powered earth-moving vehicles on a job site (e.g., optionally including moving a powered earth-moving vehicle from its current location to a determined target destination location, and handling any possible obstacles between the current and destination locations) in accordance with specified safety rules or other specified safety configuration data (e.g., to avoid prohibited 3D positions, to reduce or eliminate vehicle slippage and tilting, etc.). The routine 500 may be invoked in various manners, including in blocks 340 and/or 370 of the EMVAOC System routine 300 as discussed in FIGS. 3A-3B, and if so may return to its invocation location after the routine returns. While routine 500 is discussed with respect to controlling operations of a single powered earth-moving vehicle at a time, it will be appreciated that the routine 500 may be performed in other manners in other embodiments, including to control operations of multiple powered earth-moving vehicles of the same type and/or multiple types on a job site, to be implemented by one or more configured devices or systems (optionally in multiple locations and/or operating in a distributed or otherwise coordinated manner, such as with a computing device local to a powered earth-moving vehicle performing some of the automated operations while one or more remote server systems in communication with that computing device perform additional portions of the routine), to separate the operations related to object determination and classification from those related to motion and movement planning (e.g., to be executed at different times), etc.

The routine begins in block 505, where it obtains information that includes current information about a powered earth-moving vehicle (e.g., vehicle location and positioning for various parts of the vehicle, operating capabilities for the vehicle, etc.), current environment data for an area around the vehicle, and safety configuration data to be used (e.g., information about tilting-related operations and other balancing-related operations, about slippage-related operations, about operations related to controlled pause of operations, about operations related to controlling loading of a blade tool attachment, about operations related to controlling vehicle steering using a blade tool attachment, about operations related to controlling use of a ripper tool attachment to loosen ground materials for subsequent blade tool operations, about operations related to managing vehicle motion based in part on the slope of surrounding surfaces, etc.), and with newly captured data converted into a global coordinate system based in part on determined calibration data (e.g., by using LiDAR-based SLAM processing for obtained LiDAR data). After block 505, the routine continues to block 507, where it uses the environment data to identify obstacles around the vehicle, and in block 510, classifies each obstacle as to its type, including to optionally track movement and/or other changes for previously identified obstacles and to reclassify them if needed—such operations for each object may include, for example, classifying the obstacle (if new or changed) based on obstacle information (e.g., size, shape, distance to vehicle, material type, surface conditions, etc.), and classifying whether it can be ignored, removed, avoided and/or causes vehicle movement inhibitions, such as to inhibit vehicle movement if it cannot be removed or avoided within specified safety parameters (e.g., if a heat signature and/or movement indicates a person, animal or vehicle), can be moveable if it fits within a tool attachment or otherwise satisfies defined limits for vehicle's operating capabilities, can be avoidable if it is not moveable but does not inhibit movement or otherwise exceed defined size or other safety criteria (e.g., is a structure, vehicle, etc.), and can be ignored if it satisfies criteria with respect to material type and size and surface conditions (e.g., slope and stickiness/slipperiness of non-level surfaces). In other embodiments and situations, the routine 500 may instead use obstacle-related information generated in block 321 of FIGS. 3A-3B to supplement or replace some or all of the operations of blocks 507 and/or 510. In block 512, the routine then optionally uses specified safety configuration data to determine prohibited 3D positions corresponding to the obstacles around the vehicle and to the vehicle parts through which other parts of the vehicle are not allowed to move, including slopes or other areas that the vehicle is not allowed to transit (e.g., slopes steeper than a defined threshold). In other embodiments, rather than identifying and using prohibited 3D positions based on obstacles and/or parts of the vehicle, some or all such positions may instead be restricted in one or more manners rather than prohibited, such as to include a buffer area around some or all obstacles that is to be used only if alternative movement/motion plans without such restrictive positions are not available, and/or to be used only in certain manners (e.g. at a reduced speed or in other manners to prevent damage to the vehicle and/or the obstacle).

After block 512, the routine continues to block 514, where it determines whether to implement fully autonomous operations along with safety monitoring operations if so specified, and if not proceeds to block 567. If it is determined to implement safety monitoring for fully autonomous operations, the routine continues to block 516, where it obtains information about a travel path to take (e.g., as specified as input) and/or about one or more tasks to be performed, optionally along with one or more target destination locations and/or orientations/directions different from a current location and orientation/direction of the vehicle, and with the task(s) to be performed at the current originating location and/or at the target destination location(s) and/or at one or more intermediate locations between the originating and destination locations. In block 518, the routine then identifies additional obstacles (if any) at the destination location(s) and at one or more additional locations (if any) between the vehicle's current location and the target destination location(s), and in block 520 classifies each additional obstacle along that movement path in a manner similar to that of block 510, and optionally determines additional prohibited 3D positions for the vehicle (e.g., for one or more hydraulic arms, one or more tool attachments, the body, wheels and/or tracks, and other parts of the vehicle body) in accordance with specified safety configuration data. After block 520, the routine continues to block 522 to determine one or more alternative movement/motion plans for the vehicle's tool attachment(s) movements and optionally vehicle motion to complete the task(s) while avoiding any prohibited 3D positions, including with vehicle motion along one or more alternative paths from the current location to the target destination location (if different from the current location), and optionally including associated obstacle removal activities in order to complete the task(s)—in the illustrated embodiment, the tool attachment(s) movements may further be determined to implement balancing activities for the vehicle while moving on non-level ground, although in other embodiments such balancing activities may not be performed using the tool attachment(s). In block 523, the routine then determines whether to use gradual vehicle turning for movement/motion plans that include motion between originating and destination locations and/or that include vehicle orientation (direction) changes (e.g., for tracked vehicles), and if not proceeds to block 525. Otherwise, the routine continues to block 524 to calculate one or more spline-based gradual turns along each path for the alternative movement/motion plan(s) in accordance with specified turn-related configuration data (e.g., to balance an amount of time used as the number of turns increases with an amount of track wear that occurs as the number of turns decreases, and/or to balance the number of turns with the length or amount of each turn, such as based on vehicle type and/or preferences) and to adjust the alternative movement/motion plan(s) to reflect the gradual turns, before proceeding to block 525—in some embodiments and situations, some or all of the gradual turns are performed while the vehicle is in motion (whether forward or backward), and in other embodiments and situations some or all of the gradual turns are performed while the vehicle's forward and backward motion is stopped. In other embodiments, such gradual turning may be always used or never used, or always or never used based on vehicle type (e.g., used for specified or all tracked vehicle types).

In block 525, the routine then determines whether the task(s) to be performed include using a ripper tool attachment to loosen ground material before subsequent use of one or more other tool attachments to move or otherwise manipulate the loosened ground material, and if so proceeds to block 525 to determine placement for the one or more ripper teeth of the ripper tool attachment to use in one or more passes of the ripper tool attachment in order to cover the width of a lane used by the one or more other tool attachments (e.g., the width of a blade tool attachment to be used in pushing/cutting the loosened ground material), and to adjust the one or more alternative movement/motion plans to reflect the determination. After block 526, or if it was determined in block 525 not to determine ripper tool coverage (e.g., if the task(s) do not include use of a ripper tool attachment), the routine in block 527 then scores or otherwise evaluates some or all of the alternative movement/motion plans with respect to one or more evaluation criteria (e.g., distance traveled; time involved; a safety score or other degree of safe operation, such as based at least in part on the obstacles and obstacle classifications; amount of tread wear and/or other measure of vehicle usage; fuel level and/or battery charge; etc.), and selects one of the movement/motion plans (e.g., a 'best' plan with respect to the evaluation criteria, such as having the highest or lowest score or other evaluation) to implement in order to perform the task(s) (along a selected vehicle motion path to the destination location if different from the originating location). In block 528, the routine then determines if there are prohibited 3D positions that cause vehicle operations to be halted or otherwise inhibited for all alternative movement/motion plans (e.g., if a plan could not be selected to avoid the prohibited 3D positions), and if so continues to block 530 to determine to initiate a halt or other inhibition (e.g., slow down) to vehicle operations until the conditions change (while optionally proceeding to perform one or more other tasks if possible), and otherwise continues to block 531.

In block 531, the routine then selects initial vehicle motion(s) and/or attachment movement(s) to implement, and in block 532 analyzes information about slopes in defined cells along a path (if any) of planned vehicle motion for the selected vehicle motion(s) and/or attachment movement(s). If it is determined in block 533 that a defined quantity (e.g., one or more) of the slopes along such a path exceed a defined threshold, the routine continues to block 541, and otherwise continues to block 534. In block 534, the routine then initiates an implementation of the selected motion(s) and/or movement(s), including to gather and update data about the vehicle and the environment during the implementation of the selected motion(s) and/or movement(s), such as by performing operations corresponding to some or all of blocks 312-324 of FIGS. 3A-3B—the selected initial vehicle motion(s) and/or attachment movement(s) may correspond to an amount of time (e.g., 1 second, 5 seconds, 1 minute, etc.), some or all of a subtask (e.g., a movement of a hydraulic arm, a movement of wheel(s) or track(s), etc.), etc.

The routine then proceeds to perform blocks 535-560 as part of further safety monitoring during the implementation of the selected movement/motion plan. In particular, in block 535 the routine determines whether the vehicle is estimated to be experiencing slipping due to loading of a blade tool attachment, and if so proceeds to block 536 to raise the blade tool by a determined amount to reduce friction caused by the material being moved by the blade tool—as discussed in greater detail elsewhere herein, the determination of whether the vehicle is estimated to be experiencing slipping may be based at least in part on output of a trained machine learning model that takes as input various parameters about performance of the vehicle and optionally additional input data about the blade tool attachment and its loading. After block 536, or if it is instead determined in block 535 that the vehicle is not estimated to be slipping due to loading of the blade tool attachment, the routine continues to block 538 to determine if a blade tool attachment is estimated to be full (or to otherwise have loading above a defined threshold) during pushing/cutting operations of a pushing/cutting mode, and if so continues to block 539 to initiate a switch to a carrying mode that includes lifting the blade tool attachment about the surface of the terrain and materials that were being pushed/cut—as discussed in greater detail elsewhere herein, the determination of whether the blade tool is estimated to be full may be based at least in part on output of a trained machine learning model that takes as input various parameters about performance of the vehicle and optionally additional input data about the blade tool attachment and its loading. After block 539, the routine continues to block 554.

If it is instead determined in block 538 that a blade tool attachment is not estimated to be full, the routine continues instead to block 540 to determine whether to pause vehicle operations and perform a controlled stop to vehicle operations and optional subsequent vehicle shutdown—such a pause in vehicle operations may be included as part of the movement/motion plan being implemented, and/or may be determined based on current conditions (e.g., an instruction received from a human operator, if the vehicle is nearly out of fuel or is overheating or another fault occurs, if continued operations would interfere with another vehicle and/or person, or if one or more other specified pause criteria are satisfied). If so, the routine continues to block 541 to perform the controlled stop to vehicle operations and optional subsequent vehicle shutdown, such as by initiating concurrent brake and decelerator activation (e.g., using a separate exponential force curve for each), subsequently initiating (e.g., at a specified time during or after the brake and decelerator activation) lowering of the front attachment (e.g., a blade or bucket) into the terrain (e.g., using an exponential force curve), and initiating lowering of the back attachment (e.g., a ripper) into the terrain (e.g., using an exponential force curve) either simultaneously with the front attachment (e.g., if the vehicle is rolling forward) or after the front attachment lowering has begun and optionally has completed (e.g., if the vehicle is rolling backward). After the vehicle is stationary and the vehicle tool attachment(s) movements have stopped, the operations then include engaging the vehicle parking, and optionally then performing locking activities and/or stopping inputs to the vehicle controls. After block 541, the routine continues to block 599 and returns.

If it is instead determined in block 540 not to pause vehicle operations, the routine continues to block 543 to determine whether the vehicle pitch has unplanned tilting relative to the terrain slope and/or tool attachments in use, such as if the front of the tracks or front wheels are lifting off the terrain due to use of the front tool attachment (e.g., using a blade or bucket or ripper to push through terrain or other otherwise push materials), or if the back of the tracks or back wheels are lifting off the terrain due to use of the back tool attachment (e.g., using a blade or bucket or ripper to push through terrain or other otherwise push materials). If so, the routine continues to block 544 to perform a terrain loosening cycle, such as by using one or more tool attachments (e.g., a ripper) to perform terrain loosening by breaking up or tearing through or otherwise loosening the terrain in an area that includes where the front or back tool attachments were working when the vehicle pitch tilting occurred, and optionally around additional areas (e.g., around some or all of the current location of the vehicle). After block 544, the routine continues to block 554. If it is instead determined in block 543 that the vehicle is not having unplanned tilting, the routine continues to block 546 to determine whether to use a blade tool attachment to assist in vehicle turning (e.g., during forward vehicle motion with the blade tool attachment in use for material pushing/cutting), such as if use of the tracks and/or wheels of the vehicle are not sufficiently maintaining the vehicle motion along a desired path, and if so continues to block 547 to determine a direction in which to correct the vehicle motion to return toward the desired path and to lower the blade tool attachment on the side of the determined direction (and/or to raise the blade tool attachment on the opposite side) while continuing the forward motion. After block 547, the routine continues to block 554.

If it is instead determined in block 546 to not use blade-based turning, the routine continues instead to block 552 to determine whether the vehicle and/or environment data gathered in block 534 indicates that the vehicle is slipping for one or more other reasons (e.g., due to a sloped and/or slick surface), and if so proceeds to block 553 to initiate corrective slippage-related activities, such as to perform automated emergency braking operations. The emergency braking operations may include determining whether the vehicle is slipping forwards or backwards, and using different vehicle tool attachments accordingly if the vehicle has both one or more front tool attachments (e.g., a bucket or blade) and one or more rear tool attachments (e.g., a ripper with one or more teeth)—if the vehicle has a mid-vehicle tool attachment (e.g., a main blade on a grader), it may be used as a front tool attachment if the vehicle has a back tool attachment but no other front tool attachment, as a back tool attachment if the vehicle has a front tool attachment but no other back tool attachment, or as neither or both if the vehicle has other front and back tool attachments (e.g., a grader vehicle). After block 553, the routine continues to block 599 and returns.

If it is instead determined in block 552 that the vehicle is not slipping for other reasons such as due to a sloped and/or slick surface, or after blocks 539 or 544 or 547, the routine continues to block 554 to determine whether there are more operations to perform for the movement/motion plan, and if not continues to block 562. Otherwise, the routine continues to block 556 to select next movement(s) and/or motion(s) to perform for the movement/motion plan, and in block 558 the routine then determines whether to perform other vehicle balancing-related activities during vehicle operations for the movement/motion plan, such as based at least in part on the determined slope and/or other determined conditions related to vehicle balancing, and if so continues to block 560 to determine additional attachment movements and/or other changes to implement for the selected movement/motion plan to perform the balancing activities. After block 560, or if it is instead determined in block 558 to not perform vehicle balancing activities, the routine returns to block 532 to analyze the slopes in defined cells corresponding to the selected vehicle motion, if any, before proceeding to block 534 to implement any such vehicle motion(s) and/or attachment movement(s) along with any determined vehicle balancing activities if it is not determined in block 533 that one or more of the slopes exceed a defined threshold.

If it is determined in block 554 that there are not more operations to perform for a movement/motion plan, the routine continues instead to block 562 to determine whether to generate a reconstruction of actual vehicle operations corresponding to the planned movement/motion plan, and if not continues to block 599 and returns. Otherwise, the routine continues to block 564 to perform a LiDAR-based SLAM analysis of LiDAR data gathered during the vehicle operations for the movement/motion plan in order to reconstruct the actual travel path and other vehicle operations, and to optionally further compare the generated reconstruction to the planned movement/motion plan, and to provide information about the reconstruction and the comparison if applicable. After block 564, the routine continues to block 599 and returns.

If it is instead determined in block 514 to not implement fully autonomous operations with optional safety monitoring, the routine continues instead to block 567 to determine whether to instead implement safety monitoring operations in a semi-autonomous manner that is based in part on input from at least one human operator, and if not proceeds to block 599—in other embodiments and situations, only one of fully autonomous operations and semi-autonomous operations may be included as part of an embodiment of the routine 500. If it is determined to implement safety monitoring operations in a semi-autonomous manner in the current example, the routine proceeds to block 568 to wait for and receive human operator input to one or more controls of the vehicle corresponding to intended vehicle motion and/or attachment movement. In block 570, the routine then determines predicted next positions for the vehicle components/parts based on the input, as well as whether any of the predicted next positions involve any prohibited 3D positions—in at least some embodiments, the predictions and other determination for block 570 are performed in a real-time or substantially real-time manner to enable automated actions to be taken if one or more predicted next positions involve prohibited 3D positions. If it is determined in block 572 that one or more prohibited 3D positions will be included (including any slopes exceeding a defined threshold), the routine continues to block 574 to halt the intended movement/motion corresponding to the input and optionally provide corresponding feedback to the human operator, and then proceeds to block 588—in other embodiments and/or situations, rather than halting the intended movement/motion, the routine may instead determine an alternative movement/motion to implement that avoids the prohibited 3D positions while reaching the same destination or otherwise achieving the same result as much as possible, and if so may instead change the movement/motion to that alternative movement/motion and proceed to block 576. If it is instead determined in block 572 that the intended movement/motion does not include any prohibited 3D positions (or an alternative movement/motion is determined in block 574), the routine continues instead to block 576 to determine whether the intended movement/motion involves moving a piston for a piston displacement mechanism to its endstop position at full speed (and optionally in some embodiments making an abrupt change from full speed movement of a movable vehicle part in one direction to a substantially opposite direction), and if so continues to block 578 to alter the intended movement/motion to reduce the speed as the endstop position is reached, although in some embodiments such checking may not be performed or may be overridden (e.g., if an operator user wants to shake material out of a bucket or other tool attachment). If it is instead determined in block 576 that the intended movement/motion does not involve reaching a piston endstop position (or direction change location) at full speed, or after block 578, the routine continues instead to block 580 to determine whether to perform vehicle balancing activities during vehicle operations for the movement/motion, such as based at least in part on the determined slope and/or other determined conditions related to vehicle balancing, and if so continues to block 582 to determine additional attachment movements and/or other changes to implement for the movement/motion to perform the balancing activities. After block 582, or if it is instead determined in block 580 to not perform vehicle balancing activities (e.g., due to the vehicle motion not involving any slopes above a defined minimum threshold or otherwise associated with balancing), the routine continues to block 584, where it implements the movement/motion corresponding to the input (and as optionally modified in blocks 574 and/or 578 and/or 582) using one or more piston displacement mechanisms, performs monitoring for any alarms corresponding to exceeding safety thresholds during the movement (e.g., based on pitch and/or roll angles exceeding defined thresholds, such as corresponding to unplanned vehicle pitch tilting and/or yaw tilting and/or roll tilting; based on unplanned slippage on a sloped and/or slick surface; based on conditions to cause controlled stoppage of the vehicle, etc.), and halts further movement (or otherwise takes corrective action) if one or more such alarms are sounded—in at least some embodiments and situations, the performance of block 584 may further include gathering and updating additional environment data that is used during the implementing of the movement (e.g., by concurrently performing some or all of blocks 315-324 one or more times). During and/or after block 584, the routine in block 586 performs further operations to, if vehicle motion causes changes to the vehicle location, further identify additional obstacles (if any) from the environment data for additional locations of the vehicle as it moves and to classify the additional obstacles in a manner similar to that for blocks 510 and 520, and to use any specified safety configuration data to determine additional prohibited 3D positions corresponding to the additional obstacles, such as for use during the vehicle motion and/or for additional operations at a final destination of the motion based on next inputs received from a human operator. While not illustrated here, in some embodiments the routine may further take additional fully automated actions after receiving input from a human operator user (whether to change the intended movement/motion corresponding to the input and/or to perform additional tasks after the movement/motion), and/or may further take additional fully automated actions that include providing results of determinations to the human operator to prompt possible changes in future input from the human operator user, such as in a manner similar to that discussed with respect to the fully autonomous operations in blocks 516-560, including related to vehicle pitch tilting in a manner similar to blocks 543-544, and/or related to other vehicle slipping in a manner similar to blocks 535-536 and/or 552-553, and/or related to vehicle operations pause in a manner similar to blocks 540-541, and/or related to a response to a full blade in a manner similar to blocks 538-539, and/or related to a response to a determination to use blade-based turning in a manner similar to blocks 546-547, and/or related to vehicle gradual turning in a manner similar to blocks 523-524, and/or related to ripper tool teeth placement in a manner similar to blocks 525-526, etc. After blocks 574 or 586, the routine continues to block 588 to determine whether to continue with the semi-autonomous monitoring operations (e.g., until the human operator provides input to indicate that the semi-autonomous monitoring operations are done), and if so returns to block 568 to wait for additional human input. Otherwise, the routine continues to block 599 and returns.

Aspects of the present disclosure are described herein with reference to flowchart illustrations and/or block diagrams of methods, apparatus (systems), and computer program products according to embodiments of the present disclosure. It will be appreciated that each block of the flowchart illustrations and/or block diagrams, and combinations of blocks in the flowchart illustrations and/or block diagrams, can be implemented by computer readable program instructions. It will be further appreciated that in some implementations the functionality provided by the routines discussed above may be provided in alternative ways, such as being split among more routines or consolidated into fewer routines. Similarly, in some implementations illustrated routines may provide more or less functionality than is described, such as when other illustrated routines instead lack or include such functionality respectively, or when the amount of functionality that is provided is altered. In addition, while various operations may be illustrated as being performed in a particular manner (e.g., in serial or in parallel, or synchronous or asynchronous) and/or in a particular order, in other implementations the operations may be performed in other orders and in other manners. Any data structures discussed above may also be structured in different manners, such as by having a single data structure split into multiple data structures and/or by having multiple data structures consolidated into a single data structure. Similarly, in some implementations illustrated data structures may store more or less information than is described, such as when other illustrated data structures instead lack or include such information respectively, or when the amount or types of information that is stored is altered.

From the foregoing it will be appreciated that, although specific embodiments have been described herein for purposes of illustration, various modifications may be made without deviating from the spirit and scope of the invention. Accordingly, the invention is not limited except as by corresponding claims and the elements recited therein. In addition, while certain aspects of the invention may be presented in certain claim forms at certain times, the inventors contemplate the various aspects of the invention in any available claim form. For example, while only some aspects of the invention may be recited as being embodied in a computer-readable medium at particular times, other aspects may likewise be so embodied.

What is claimed is:

1. An autonomous vehicle positioning system, comprising:

a powered earth-moving vehicle having a body, a tool attachment, one or more hydraulic arms connecting the tool attachment to the body, at least one of tracks or wheels, a LiDAR (light detection and ranging) component located at a mount position on a movable component that is the tool attachment or one of the hydraulic arms, one or more inclinometer sensors attached to the movable component, first controls for manipulating movement of the at least one of the tracks or wheels via one or more first piston displacement mechanisms, and second controls for manipulating movement of the one or more hydraulic arms and the tool attachment via one or more second piston displacement mechanisms;

a microcontroller unit on the powered earth-moving vehicle that is capable of effecting movement of the first and second piston displacement mechanisms; and a control system on the powered earth-moving vehicle that is configured to be in communication with the microcontroller unit and to perform automated operations including at least:

obtaining calibration data for the LiDAR component that provides a transformation between the mount position of the LiDAR component and an additional reference point on the body;

manipulating the one or more first piston displacement mechanisms to cause the powered earth-moving vehicle to move along a path on a job site;

gathering, while the powered earth-moving vehicle is moving along the path, a plurality of data sets at a plurality of locations along the path, the plurality of data sets including a plurality of inclinometer sensor readings obtained from the one or more inclinometer sensors attached to the movable component, and further including a plurality of three-dimensional ("3D") point cloud data sets that are obtained from the LiDAR component and that each has a plurality of data points with positions on surfaces of at least some of the job site, the positions of the data points being represented in a local coordinate system relative to the mount position;

analyzing the plurality of data sets to determine at least one position of the powered earth-moving vehicle on the job site relative to the surfaces of the at least some of the job site, the analyzing including using the plurality of inclinometer sensor readings for the movable component to determine one or more positions of the movable component relative to the body while the powered earth-moving vehicle is moving along the path, and further including aligning data points across the plurality of 3D point cloud data sets using iterative-closest-point analysis and the calibration data and the determined one or more positions of the movable component relative to the body; and using the determined at least one position of the powered earth-moving vehicle on the job site to perform one or more further activities involved in control of the powered earth-moving vehicle.

2. The autonomous vehicle positioning system of claim 1 wherein the obtaining of the calibration data for the LiDAR component includes:

gathering groups of data at multiple locations along a predetermined travel path followed by the powered earth-moving vehicle on the job site, each group of data for a location including an additional 3D point cloud data set obtained from the LiDAR component and having a plurality of data points with additional positions that are on surfaces of the job site and that are represented in a local coordinate system relative to the mount position, and further including one or more additional inclinometer sensor readings obtained from the one or more inclinometer sensors for the movable component, and further including one or more GPS (global positioning system) readings data points from a GPS component positioned at the additional reference point on the powered earth-moving vehicle;

analyzing the groups of data to determine a trajectory followed by the powered earth-moving vehicle along the predetermined travel path, including performing continuous-time iterative-closest-point processing after the powered earth-moving vehicle reaches an end of the predetermined travel path; and determining the transformation between the mount point of the LiDAR component and the additional reference point of the GPS component using the determined trajectory and using the additional inclinometer sensor readings to reflect positioning of the movable component.

3. The autonomous vehicle positioning system of claim 2 wherein the determined at least one position of the powered earth-moving vehicle on the job site relative to the surfaces of the at least some of the job site is determined in a common coordinate system that is not relative to the mount position, wherein the gathering of the plurality of data sets at the plurality of locations along the path further includes gathering a plurality of GPS absolute location data points, and wherein the automated operations further include converting the determined at least one position of the powered earth-moving vehicle on the job site in the common coordinate system into at least one absolute location position using the gathered plurality of GPS absolute location data points and the determined transformation.

4. The autonomous vehicle positioning system of claim 3 wherein the powered earth-moving vehicle includes a receiver for RTK (real-time kinematic) correction data, and wherein the gathering of the plurality of GPS absolute location data points includes determining RTK-corrected GPS absolute location data points.

5. The autonomous vehicle positioning system of claim 1 wherein the analyzing of the plurality of data sets includes using simultaneous localization and mapping (SLAM) processing techniques.

6. The autonomous vehicle positioning system of claim 1 wherein the using of the determined at least one position of the powered earth-moving vehicle on the job site to perform one or more further activities includes reconstructing the path traveled by the powered earth-moving vehicle, and providing information about the reconstructed path.

7. The autonomous vehicle positioning system of claim 1 wherein the using of the determined at least one position of the powered earth-moving vehicle on the job site to perform one or more further activities includes determining an additional travel path for the powered earth-moving vehicle on the job site, and controlling movement of the powered earth-moving vehicle along the additional travel path by manipulating at least the one or more first piston displacement mechanisms.

8. The autonomous vehicle positioning system of claim 1 wherein the automated operations further include, as part of the aligning of the data points across the plurality of 3D point cloud data sets using the iterative-closest-point analysis, at least one of:

reducing a search space for the iterative-closest-point analysis using additional sensor data from one or more additional hardware sensors on the powered earth-moving vehicle to eliminate one or more possible alignment solutions; or reducing a quantity of the data points of the 3D point cloud data sets by using other sensor data from the one or more additional hardware sensors to identify and remove some of the data points corresponding to one or more surfaces that satisfy one or more defined criteria; or determining a velocity of the powered earth-moving vehicle using a combination of GPS (global positioning system) data from one or more GPS components on the powered earth-moving vehicle and inclinometer data from at least one additional inclinometer sensor attached to the body of the powered earth-moving vehicle.

9. The autonomous vehicle positioning system of claim 1 wherein the automated operations further include, as part of the aligning of the data points in the plurality of 3D point cloud data sets using the iterative-closest-point analysis, at least one of:

reducing, drift errors in the determined at least one position by performing loop closure operations using data gathered at a position on the path that is traversed multiple times; or reducing a quantity of the data points of the 3D point cloud data sets by sampling a subset of those data points to reduce an amount of time for the aligning; or reducing an amount of time for the aligning by using one or more graphics processing units located on the powered earth-moving vehicle.

10. The autonomous vehicle positioning system of claim 1 wherein the powered earth-moving vehicle is one of a bulldozer vehicle or an excavator vehicle, wherein the control system is configured to implement at least some automated operations of an earth-moving vehicle autonomous operations control system by executing software instructions of the earth-moving vehicle autonomous operations control system, and wherein the automated operations are performed autonomously without receiving human input and without receiving external signals other than GPS signals and real-time kinematic (RTK) correction signals.

11. The autonomous vehicle positioning system of claim 1 wherein the using of the calibration data and the determined one or more positions during the aligning of the data points in the plurality of 3D point cloud data sets includes:

determining, for each of the plurality of data sets, a position of the movable component relative to the body of the powered earth-moving vehicle during gathering of that data set based at least in part on one or more of the inclinometer sensor readings that are part of that data set;

combining, for each of the plurality of data sets, the determined position of the movable component during gathering of that data set and the transformation between the mount position of the LiDAR component and the additional reference point on the body to convert each data point in a 3D point cloud data that is part of that data set into a global coordinate system; and using the converted data points in the global coordinate system for the aligning.

12. A computer-implemented method, comprising:

obtaining, by one or more configured hardware processors on a powered earth-moving vehicle located on a site, calibration data for a LiDAR (light detection and ranging) component located at a mount position on the powered earth-moving vehicle, the calibration data providing at least one transformation between the mount position and an additional reference point on a body of the powered earth-moving vehicle;

gathering, by the one or more configured hardware processors and while the powered earth-moving vehicle moves along a path on the site, a plurality of data sets at a plurality of locations along the path, the plurality of data sets including one or more sensor readings indicating a position of the LiDAR component on the powered earth-moving vehicle, and further including a plurality of 3D point cloud data sets that are obtained from the LiDAR component and that each has a plurality of data points with positions on surfaces of at least some of the site, the positions of the data points being represented in a local coordinate system relative to the mount position;

analyzing, by the one or more configured hardware processors, the plurality of data sets to determine at least one position of the powered earth-moving vehicle on the site relative to the surfaces of the at least some of the site, the analyzing including aligning the positions of data points across the plurality of 3D point cloud data sets using iterative-closest-point analysis and the calibration data and the one or more sensor readings indicating the position of the LiDAR component on the powered earth-moving vehicle; and using, by the one or more configured hardware processors, the determined at least one position of the powered earth-moving vehicle on the site to perform one or more further activities involved in control of the powered earth-moving vehicle.

13. The computer-implemented method of claim 12 wherein the powered earth-moving vehicle further has a tool attachment and one or more hydraulic arms connecting the tool attachment to the body, wherein the mount position of the LiDAR component is on a movable component that is the tool attachment or one of the hydraulic arms, and wherein the one or more sensor readings indicating the position of the LiDAR component on the powered earth-moving vehicle are from one or more inclinometer sensors attached to the movable component.

14. The computer-implemented method of claim 12 wherein the powered earth-moving vehicle further includes one or more GPS (global positioning system) antennas mounted at one or more positions on the body and capable of receiving GPS signals for use in determining GPS coordinates of at least some of the body, and one or more INS (inertial navigation system) units that each uses data from at least one IMU (inertial measurement unit) sensor, and wherein the plurality of data sets further includes GPS absolute location data from the one or more GPS antennas, and additional vehicle positioning data from the one or more INS units.

15. The computer-implemented method of claim 12 wherein at least one of the one or more hardware processors is a low-voltage microcontroller that is located on the powered earth-moving vehicle and is configured to implement at least some automated operations of an earth-moving vehicle autonomous operations control system by executing software instructions of the earth-moving vehicle autonomous operations control system, and wherein the gathering of the plurality of data sets and the analyzing of the plurality of data sets are performed autonomously without receiving human input and without receiving external signals other than GPS signals and real-time kinematic (RTK) correction signals.

16. The computer-implemented method of claim 12 wherein the obtaining of the calibration data for the LiDAR component includes:

gathering, by the one or more configured hardware processors, groups of data at multiple locations along a predetermined travel path followed by the powered earth-moving vehicle on the site, each group of data for a location including an additional 3D point cloud data set obtained from the LiDAR component and having a plurality of data points with additional positions that are on surfaces of the site and that are represented in a local coordinate system relative to the mount position, and further including one or more GPS (global positioning system) readings data points from a GPS component positioned at the additional reference point on the powered earth-moving vehicle;

analyzing, by the one or more configured hardware processors, the groups of data to determine a trajectory followed by the powered earth-moving vehicle along the predetermined travel path, including performing iterative-closest-point processing after the powered earth-moving vehicle reaches an end of the predetermined travel path; and determining, by the one or more configured hardware processors, the at least one transformation between the mount position of the LiDAR component and the additional reference point of the GPS component using the determined trajectory.

17. An autonomous vehicle positioning system, comprising:

a powered earth-moving vehicle having a body, a tool attachment, one or more hydraulic arms connecting the tool attachment to the body, at least one of tracks or wheels, a LiDAR (light detection and ranging) component located at a mount location on the powered earth-moving vehicle, first controls for manipulating movement of the at least one of the tracks or wheels via one or more first piston displacement mechanisms, and second controls for manipulating movement of the one or more hydraulic arms and the tool attachment via one or more second piston displacement mechanisms;

a microcontroller unit on the powered earth-moving vehicle that is capable of effecting movement of the first and second piston displacement mechanisms; and a control system on the powered earth-moving vehicle that is configured to be in communication with the microcontroller unit and to perform automated operations including at least:

manipulating the one or more first piston displacement mechanisms to cause motion of the powered earth-moving vehicle along a predetermined travel path on a job site;

gathering, while the powered earth-moving vehicle is moving along the predetermined travel path, groups of data at multiple locations along the predetermined travel path that include a plurality of 3D point cloud data sets captured using the LiDAR component, each of the 3D point cloud data sets having a plurality of data points on surfaces of at least some of the job site that are represented in a local coordinate system relative to a current position of the mount location at a time of capturing of that 3D point cloud data set;

analyzing the groups of data to determine a trajectory followed by the powered earth-moving vehicle along the predetermined travel path and to determine one or more transformations between the mount position of the LiDAR component and a reference point on the body, including performing continuous-time iterative-closest-point processing after the powered earth-moving vehicle reaches an end of the predetermined travel path to align the data points of the plurality of 3D point cloud data sets in a global coordinate system by compensating for different positions of the mount location at times of capturing the plurality of 3D point cloud data sets in light of additional location information for the powered earth-moving vehicle during the motion along the predetermined travel path, wherein the reference point has a known location within the global coordinate system; and providing the determined transformation to enable conversion of further 3D point cloud data set obtained from the LiDAR component to the global coordinate system.

18. The autonomous vehicle positioning system of claim 17 wherein the mount position is located on a movable component of the powered earth-moving vehicle that is the tool attachment or one of the hydraulic arms, wherein the powered earth-moving vehicle further has one or more inclinometer sensors attached to the movable component, wherein the group of data for each of the multiple locations further includes one or more inclinometer sensor readings obtained from the one or more inclinometer sensors for the movable component, and wherein determining of the one or more transformations further uses inclinometer sensor readings to reflect positions of the movable component during capturing of the plurality of 3D point cloud data sets.

19. The autonomous vehicle positioning system of claim 17 wherein the powered earth-moving vehicle further has a GPS (global positioning system) component attached to the body at a second mount position, wherein the group of data for each of the multiple locations further includes one or more GPS data points from the GPS component to provide absolute location data for the second mount position on the powered earth-moving vehicle for that location, wherein the additional location information for the powered earth-moving vehicle during the motion is based at least in part on the GPS data points, wherein the analyzing of the groups of data further includes using GPS data readings for the second mount position and a second transformation between the second mount position and the reference point to determine absolute location data for the reference point, and wherein the automated operations further include extending the absolute location data from the reference point to the data points of the 3D point cloud data sets.

* * * * *